US008104984B2

(12) United States Patent
Tani

(10) Patent No.: US 8,104,984 B2
(45) Date of Patent: Jan. 31, 2012

(54) FILLED MATERIAL EXTRUDING CONTAINER

(75) Inventor: Yoshikazu Tani, Tokyo (JP)

(73) Assignee: Tokiwa Corporation, Nakatsugawa-shi, Gifu (JP)

( * ) Notice: Subject to any disclaimer, the term of this patent is extended or adjusted under 35 U.S.C. 154(b) by 1079 days.

(21) Appl. No.: 12/000,588

(22) Filed: Dec. 14, 2007

(65) Prior Publication Data

US 2009/0154984 A1 Jun. 18, 2009

(51) Int. Cl.
*A45D 40/04* (2006.01)

(52) U.S. Cl. ..... 401/70; 401/71

(58) Field of Classification Search ..... 401/70, 401/71, 68, 69, 74, 75, 82, 84
See application file for complete search history.

(56) References Cited

U.S. PATENT DOCUMENTS 3,358,699 A * 12/1967 Bau ..... 401/70
5,653,338 A * 8/1997 Tani ..... 206/385
6,361,233 B1 * 3/2002 Yamanaka et al. ..... 401/68

* cited by examiner

*Primary Examiner* — David Walczak
(74) *Attorney, Agent, or Firm* — Bacon & Thomas, PLLC

(57) ABSTRACT

To enable a material extruding container to carry out various combined operations, first and second engagement portions (8, 9) are provided within a container (100), both the first and second engagement portions (8, 9) operate to move a moving body (6) forward when a container front portion (1) and a container rear portion (3) are relatively rotated in one direction, the engagement of the first engagement portion (8) is cancelled when the first engagement portion (8) operates in a fixed section corresponding to the relative rotation between the container front portion (1) and the container rear portions (1, 3) in one direction, and only the second engagement portion (9) operates to move the moving body (6) forward and backward when they are further relatively rotated in one direction, while leads of the first and second engagement portions (8, 9) may be differentiated or reverse moving screws may be set.

12 Claims, 50 Drawing Sheets

FILLED MATERIAL EXTRUDING CONTAINER

BACKGROUND OF THE INVENTION

1. Field of the Invention

The present invention relates to a filled material extruding container for extruding a material filled there in so as to use it.

2. Description of the Conventional Art

In conventional, as a cosmetic material feeding container, there has been known a structure in which a leading tube and a shaft tube constructing a container outer shape are coupled so as to be relatively rotatable, an intermediate shaft tube and a core chuck holding a cosmetic material are provided within the container so as to be movable in an axial direction, a first engagement portion is constructed by a first spiral groove provided on an inner peripheral surface of the shaft tube and a projection provided on an outer surface of a rear end portion of the intermediate shaft tube, and a second engagement portion is constructed by a second spiral groove provided on an inner peripheral surface of the intermediate shaft tube and a projection provided on an outer surface of a rear end portion of the core chuck, thereby being provided with a feeding mechanism having a double structure (for example, refer to Japanese Unexamined Patent Publication No. 8-112139). In Japanese unexamined Patent Publication No. 8-112139, when the leading tube and the shaft tube are relatively rotated, an engaging action of the first engagement portion is first activated, and the intermediate shaft tube is moved forward together with the core chuck. When the intermediate shaft tube reaches a forward moving limit, an engaging action of the second engagement portion is next activated and the core chuck is moved forward. Further, Japanese Unexamined Patent Publication No. 8-112139 describes that it is possible to differentiate pitches of the first spiral groove and the second spiral groove. Accordingly, when the pitches of the first spiral groove and the second spiral groove are differentiated as mentioned above, the cosmetic material is moved forward at a first speed on the basis of the engaging action of the first engagement portion until the intermediate shaft tube reaches the forward moving limit on the basis of the relative rotation in the feeding direction of the leading tube and the shaft tube. When the relative rotation is further carried on in the feeding direction, the cosmetic material can be moved forward at a second speed which is different from the first speed, on the basis of the engaging action of the second engagement portion. In other words, it is possible to feed at two stages in which the speed is changed, and it is possible to set a feeding specification, for example, quickly feeding the cosmetic material in the first stage feeding, and slowly feeding the cosmetic material in the second stage feeding.

SUMMARY OF THE INVENTION

Problem to be Solved by the Invention

However, in practice, the engaging action of the first engagement portion does not securely operate first, but there is a case that the engaging action of the second engagement portion operates first. Accordingly, the set two-stage feeding can not be always carried out with the changed speed.

The present invention is made for the purpose of solving the problem mentioned above, and an object of the present invention is to provide a filled material extruding container which can carry out various combined operations of feeding-out and retracting in addition to securely carrying out a set two-stage feeding-out and retracting operations at changed speeds.

Means for Solving the Problem

In accordance with the present invention, there is provided a filled material extruding container comprising:

a material filled in a filling region within the container;

a container front portion;

a container rear portion provided so as to be relatively rotatable with respect to the container front portion; and a moving body arranged within the container;

the moving body moving forward and backward so as to push and get forward the filled material or pull and get backward the filled material, when the container front portion and the container rear portion are relatively rotated, wherein a first engagement portion and a second engagement portion are provided within the container, wherein, when the container front portion and the container rear portion are relatively rotated in one direction, both of engaging actions of the first engagement portion and the second engagement portion operate and the moving body moves forward, wherein, when the engaging action of the first engagement portion operates in a fixed section corresponding to the relative rotation between the container front portion and the container rear portion in the one direction, the engagement of the first engagement portion is cancelled, and wherein when they are further relatively rotated in the one direction, only the engaging action of the second engagement portion operates and the moving body moves forward and backward.

In accordance with the filled material extruding container mentioned above, since the moving body moves forward in a fixed section on the basis of the engaging actions of the first engagement portion and the second engagement portion, and the moving body moves forward and backward on the basis of the engaging action generated only by the first engagement portion beyond the fixed section, it is possible to carry out various combined operations of feeding-out and retracting of the moving body in addition to securely carrying out a set two-stage feeding-out operation of the moving body at changed speeds.

As a concrete example, for example, the operation can be set such that the moving body moves forward for 4 mm in the fixed section with respect to one rotation, and the moving body moves forward for 1 mm beyond the fixed section with respect to one rotation, that is, the moving body quickly moves forward in the fixed section and slowly moves forward beyond the fixed section, by setting the lead of the first engagement portion to move forward for 3 mm with respect to one rotation of the relative rotation between the container front portion and the container rear portion, and setting the lead of the second engagement portion to move forward for 1 mm with respect to one rotation. Further, for example, the operation can be set such that the moving body moves forward for 1 mm in the fixed section with respect to one rotation, and the moving body moves forward for 2 mm beyond the fixed section with respect to one rotation, that is, the moving body slowly moves forward in the fixed section and quickly moves forward beyond the fixed section, by setting the lead of the first engagement portion to move forward for 1 mm with respect to one rotation, and setting the lead of the second engagement portion to move forward for 2 mm with respect to one rotation. Further, for example, the operation can be set such that the moving body moves forward for 1 mm in the fixed section with respect to one rotation, and the moving body moves backward for 2 mm beyond the fixed section with respect to one rotation, that is, the moving body slowly moves forward in the fixed section and quickly moves backward beyond the fixed section, by setting the lead of the first engagement portion to move forward for 3 mm with respect to one rotation, and setting the lead of the second engagement portion to move backward for 2 mm with respect to one rotation. Further, for example, the operation can be set such that the moving body moves forward for 3 mm in the fixed section with respect to one rotation, and the moving body moves backward for 1 mm beyond the fixed section with respect to one rotation, that is, the moving body quickly moves forward in the fixed section and slowly moves backward beyond the fixed section, by setting the lead of the first engagement portion to move forward for 4 mm with respect to one rotation, and setting the lead of the second engagement portion to move backward for 1 mm with respect to one rotation. Further, for example, the operation can be set such that the moving body moves forward at 1 mm in the fixed section with respect to one rotation, and the moving body moves backward for 1 mm beyond the fixed section with respect to one rotation, that is, the moving body moves forward in the fixed section and moves backward at the same speed as the speed in the fixed section beyond the fixed section, by setting the lead of the first engagement portion to move forward for 2 mm with respect to one rotation, and setting the lead of the second engagement portion to move backward for 1 mm with respect to one rotation. In this case, the same speed is defined by comparing with the fixed rotating speed of the relative rotation in one direction.

Further, in accordance with the present invention, there is provided a filled material extruding container comprising:

a material filled in a filling region within the container;

a container front portion;

a container rear portion provided so as to be relatively rotatable with respect to the container front portion; and a moving body arranged within the container;

the moving body moving forward and backward so as to push and get forward the filled material or pull and get backward the filled material, when the container front portion and the container rear portion are relatively rotated, wherein a first engagement portion and a second engagement portion are provided within the container, wherein, when the container front portion and the container rear portion are relatively rotated in one direction, both of engaging actions of the first engagement portion and the second engagement portion operate and the moving body, which has moved forward for an optional amount, moves backward, wherein, when the engaging action of the first engagement portion operates in a fixed section corresponding to the relative rotation between the container front portion and the container rear portion in the one direction, the engagement of the first engagement portion is cancelled, and wherein, when they are further relatively rotated in the one direction, only the engaging action of the second engagement portion operates and the moving body moves forward and backward.

In accordance with the filled material extruding container mentioned above, since the moving body moves backward in a fixed section on the basis of the engaging actions of the first engagement portion and the second engagement portion, and the moving body moves backward and forward beyond the fixed section on the basis of the engaging action generated only by the first engagement portion, it is possible to carry out various combined operations of feeding-out and retracting of the moving body in the same manner as the concrete example mentioned above, in addition to securely carrying out a set two-stage feeding-out operation of the moving body at changed speeds.

In this case, as a structure of the filled material extruding container preferably achieving the action mentioned above, there can be specifically indicated a structure in which the container front portion is constituted by a filling member provided with a filling region, a locking portion at a rear end side of the filling member is coupled to a locking portion of a rotating member rotatably arranged within the container rear portion so as to be synchronously rotatable, and the moving body is structured such as to be synchronously rotatable and movable in an axial direction with respect to the container rear portion and moves forward and backward on the basis of the relative rotation between the container front portion and the container rear portion.

Further, as a structure of the filled material extruding container preferably achieving the action mentioned above, there can be specifically indicated a structure in which the container front portion is constituted by a filling member provided with a filling region and a main body tube, the container rear portion is constituted by an operation tube, and the moving body is structured such as to be synchronously rotatable and movable in an axial direction with respect to the operation tube and moves forward and backward on the basis of the relative rotation between the filling member and the main body tube, and the operation tube.

In this case, it is preferable to be provided with an energizing means for energizing in such a manner that the first engagement portion is returned to be engaged, when the moving body is moved forward and backward in a fixed section and the engagement of the first engagement portion is cancelled. In the case of employing the structure mentioned above, when the engagement of the first engagement portion is cancelled, the first engagement portion is returned to be engaged on the basis of energizing force of the energizing means. Accordingly, in the case that the container front portion and the container rear portion are further relatively rotated and the moving body is moved forward and backward in such direction that the first engagement portion is returned to be engaged, the engaging action of the first engagement portion operates without any trouble and the moving body is moved forward and backward. Further, in the case that the engagement of the first engagement portion is cancelled, the container front portion and the container rear portion are further relatively rotated, and the moving body is moved forward and backward in such direction that the first engagement portion is cancelled to be engaged, the engagement cancellation of the first engagement portion and the engagement return by the energizing means are repeated, whereby a click feeling is generated, and a degree of the relative rotation and a movement of the moving body are sensed by a user.

EFFECT OF THE INVENTION

As mentioned above, in accordance with the present invention, it is possible to provide a filled material extruding container which can carry out the various combined operations of feeding-out and retracting in addition to securely carrying out the set two-stage feeding-out and retracting operations of the moving body at changed speeds.

DETAILED DESCRIPTION OF PREFERRED EMBODIMENT

Figure 1:
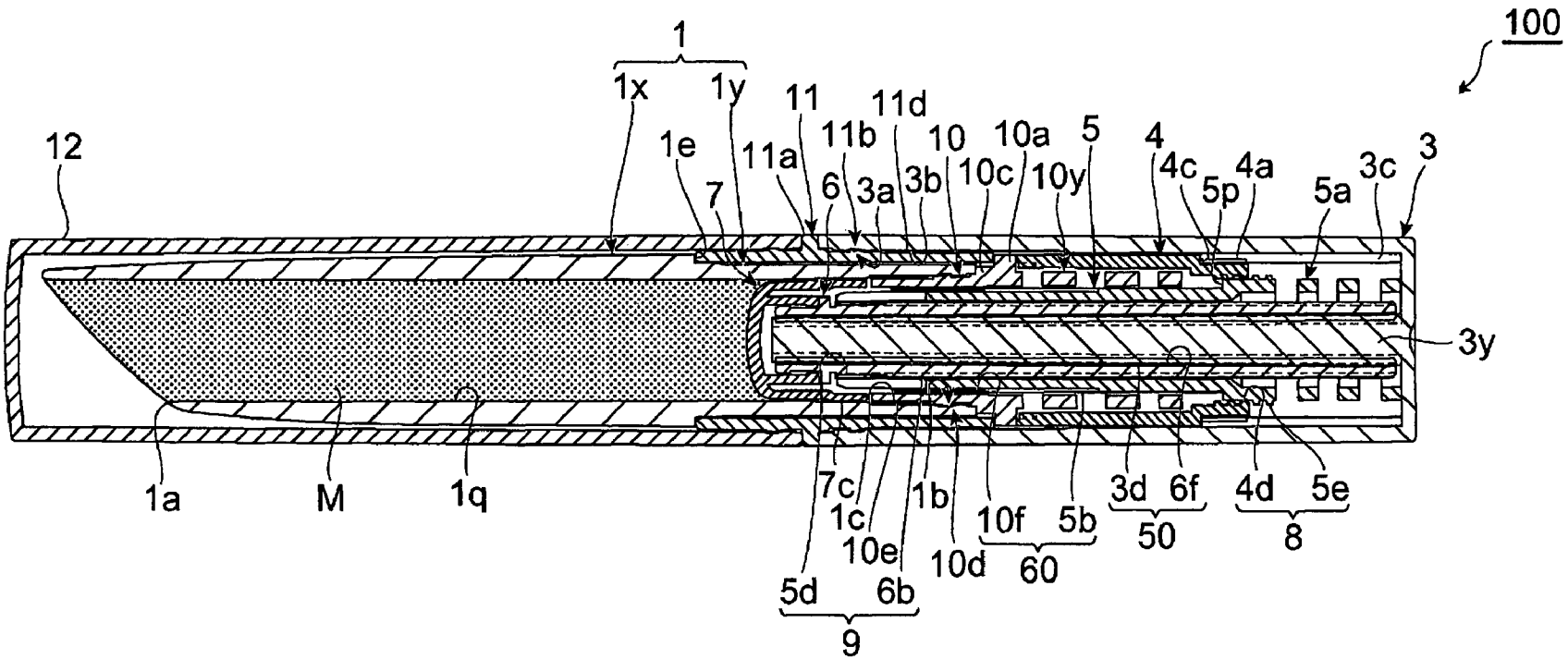
FIG. 1 is a vertical sectional view showing an initial state of a filled material extruding container in accordance with a first embodiment of the present invention.

A description will be given below of preferred embodiments of a filled material extruding container in accordance with the present invention with reference to FIGS. 1 to 50. In the drawings, the same reference numerals are attached to the same elements and an overlapping description will be omitted.

FIG. 1 to 22 show a first embodiment in accordance with the present invention, FIG. 23 to 29 show a second embodiment in accordance with the present invention, and FIGS. 30 to 50 show a third embodiment in accordance with the present invention, respectively. First, a description will be given of the first embodiment with reference to FIGS. 1 to 22.

Figure 3:
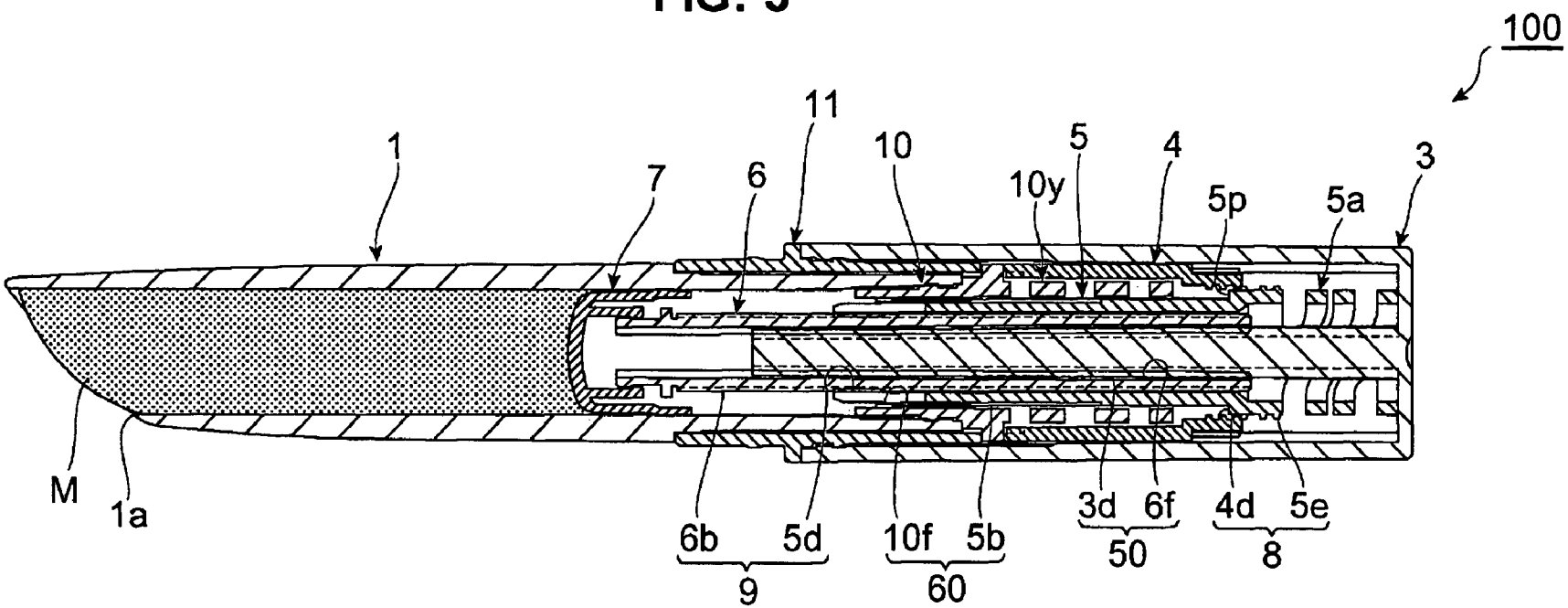
FIG. 3 is a vertical sectional view at a time when a filled material is used by the user in a state shown in FIG. 2, and the moving thread tube and the moving body are thereafter moved backward on the basis of an operation of the user and the moving thread tube is moved backward to a backward moving limit.
Figure 4:
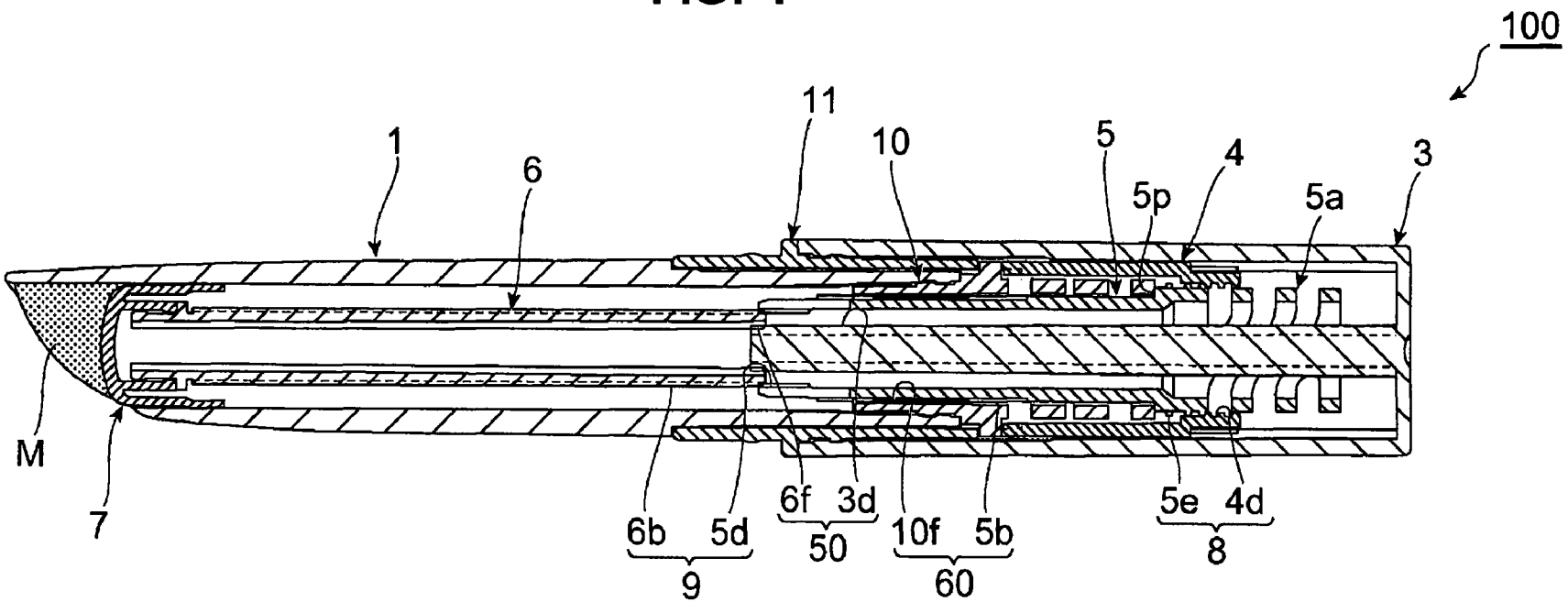
FIG. 4 is a vertical sectional view at a time when the moving body is moved forward to the maximum on the basis of an operation of the user from the state shown in FIG. 2.
Figure 5:
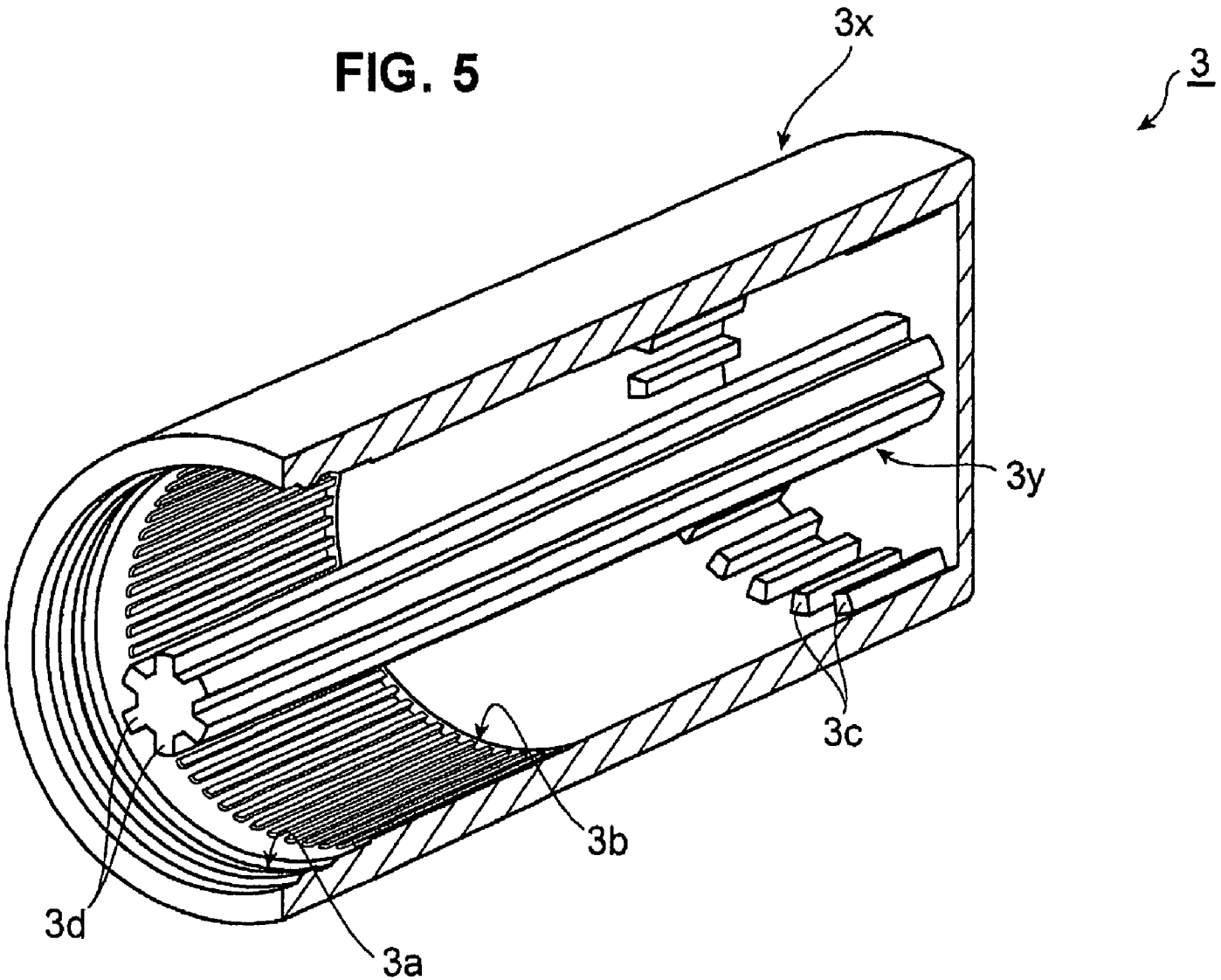
FIG. 5 is a broken perspective view showing a main body tube in FIGS. 1 to 4.
Figure 6:
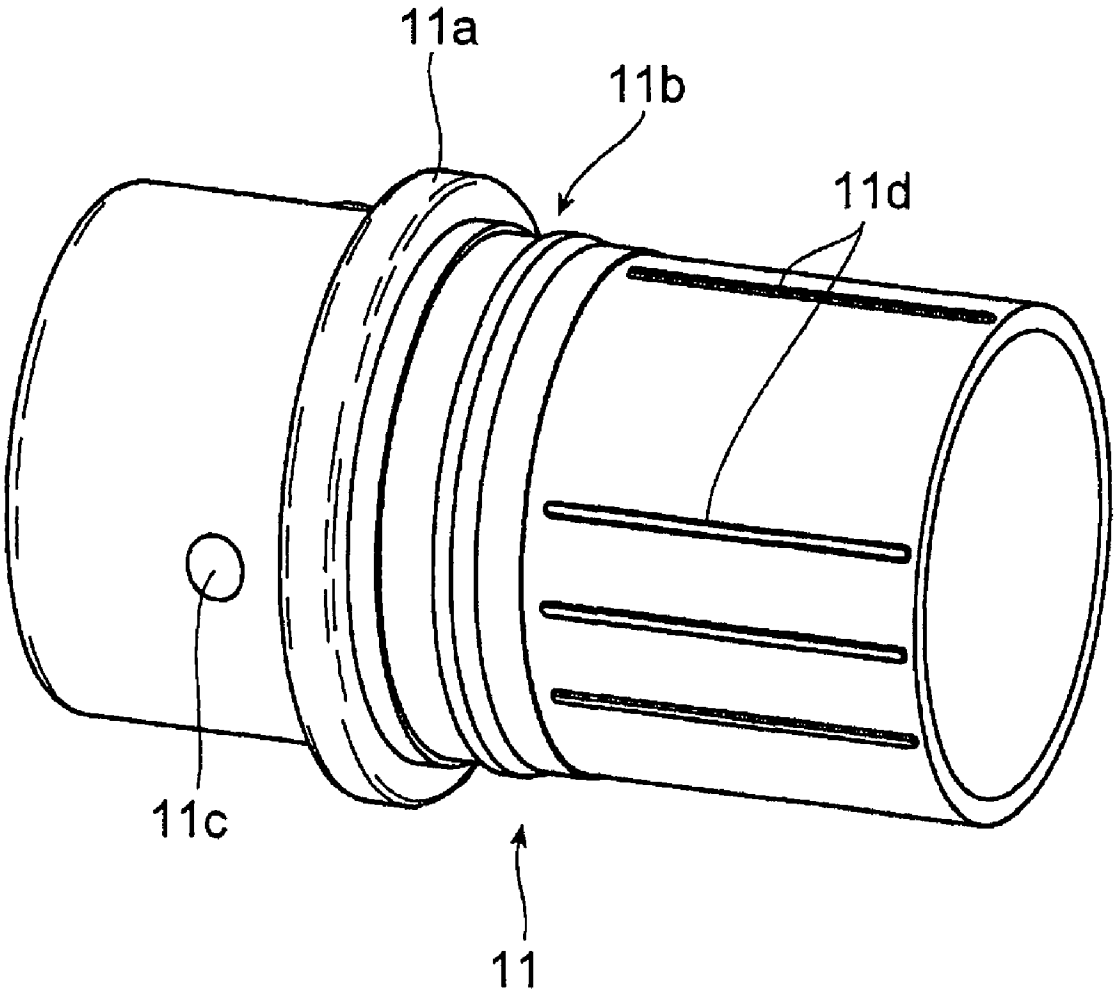
FIG. 6 is a perspective view showing an intermediate member in FIGS. 1 to 4.
Figure 7:
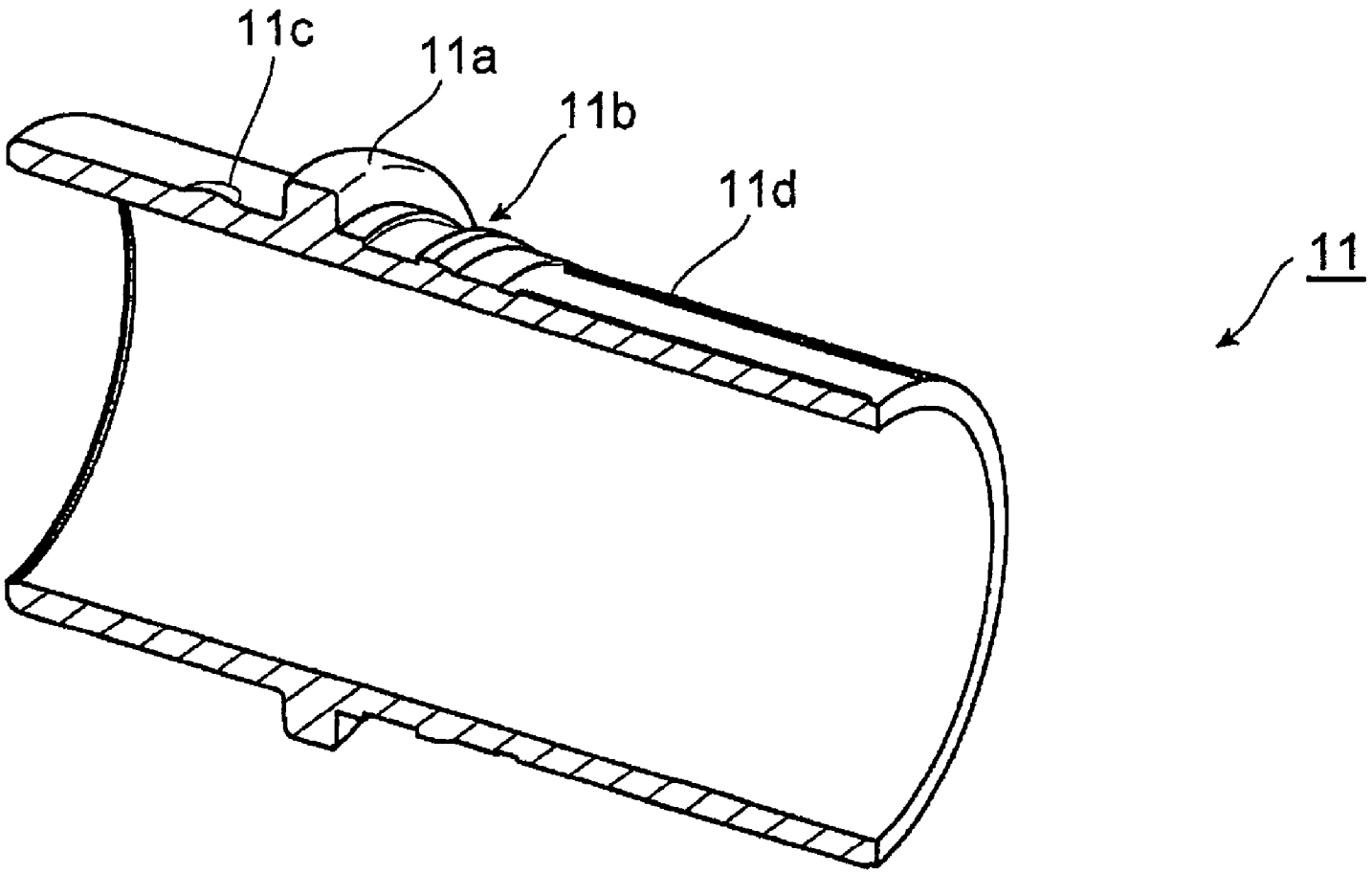
FIG. 7 is a vertical sectional perspective view of the intermediate member shown in FIG. 6.
Figure 8:
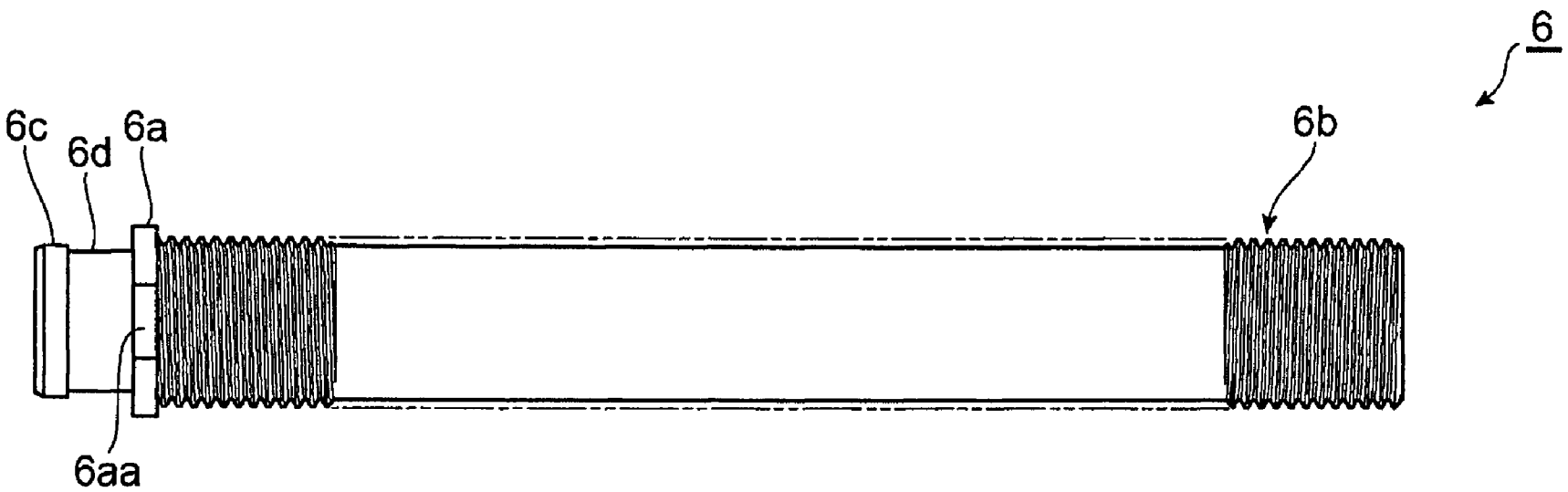
FIG. 8 is a side view showing the moving body in FIGS. 1 to 4.
Figure 9:
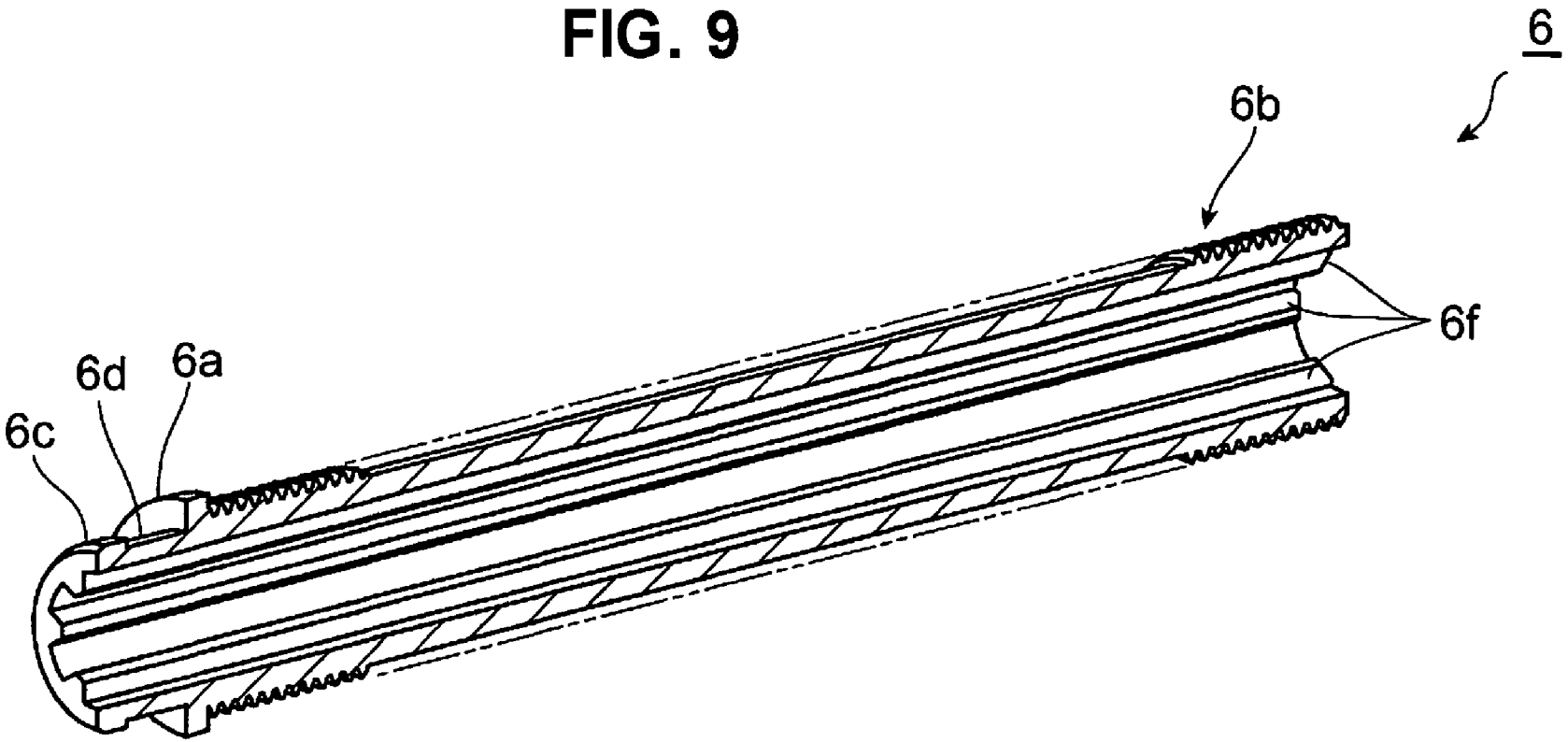
FIG. 9 is a vertical sectional perspective view of the moving body shown in FIG. 8.
Figure 10:
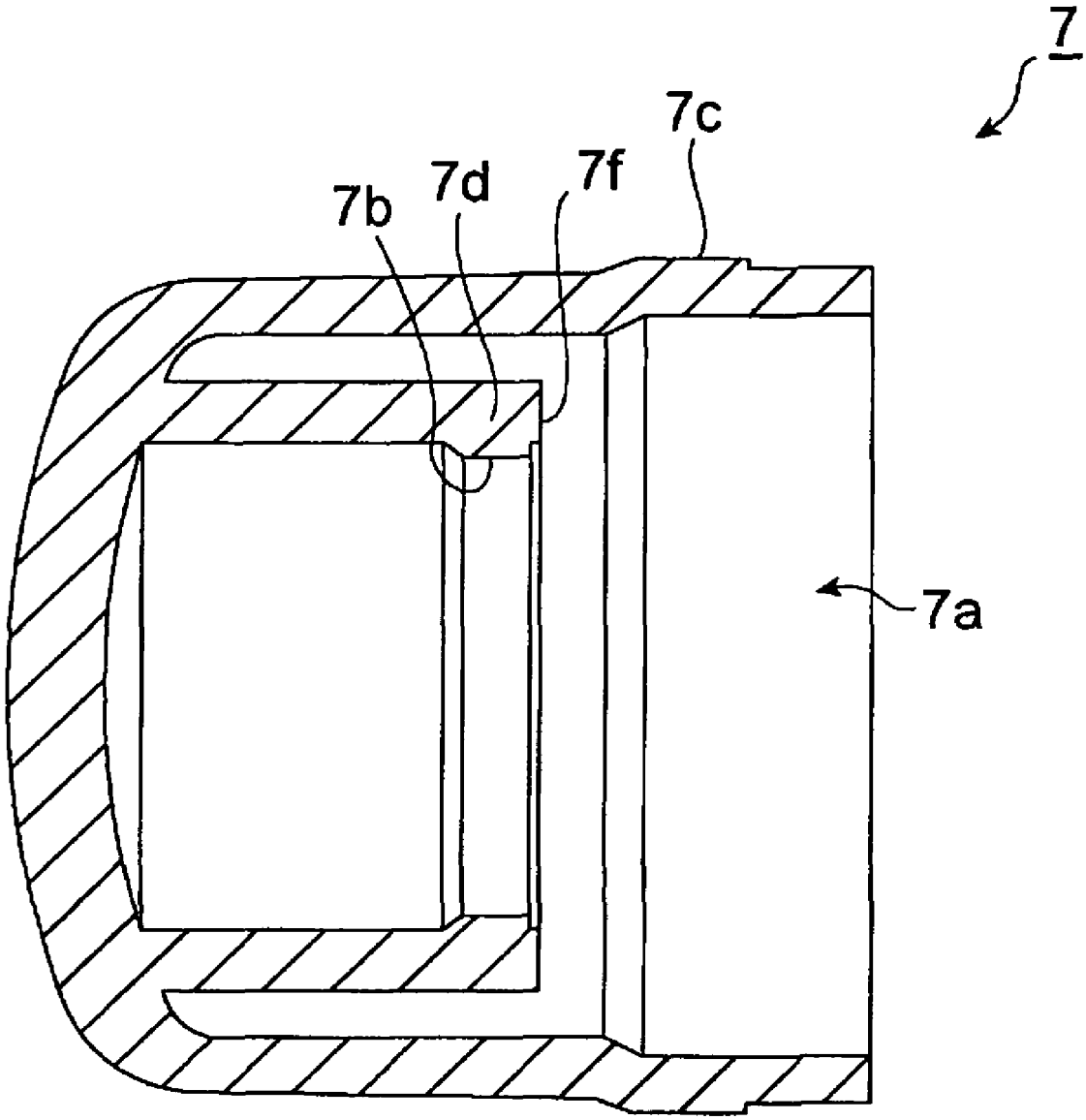
FIG. 10 is a vertical sectional view showing a piston in FIGS. 1 to 4.
Figure 11:
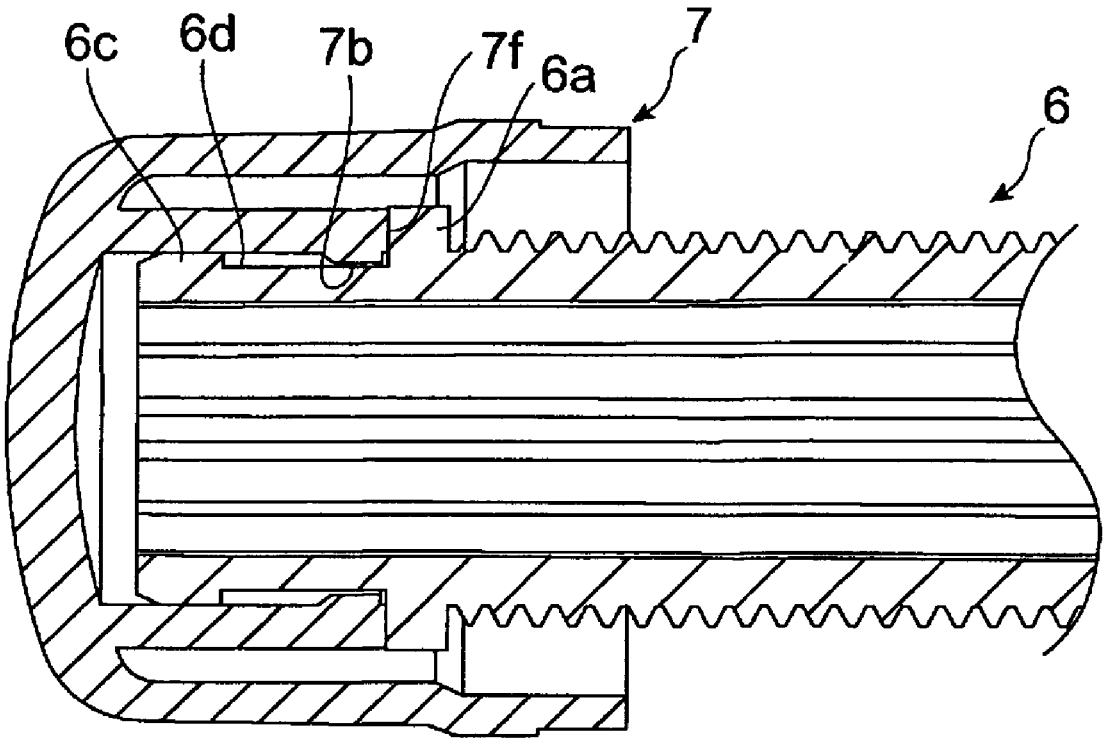
FIG. 11 is a vertical sectional view showing an installed state and a positional relation between the piston shown in FIG. 10 and the moving body shown in FIG. 8.
Figure 12:
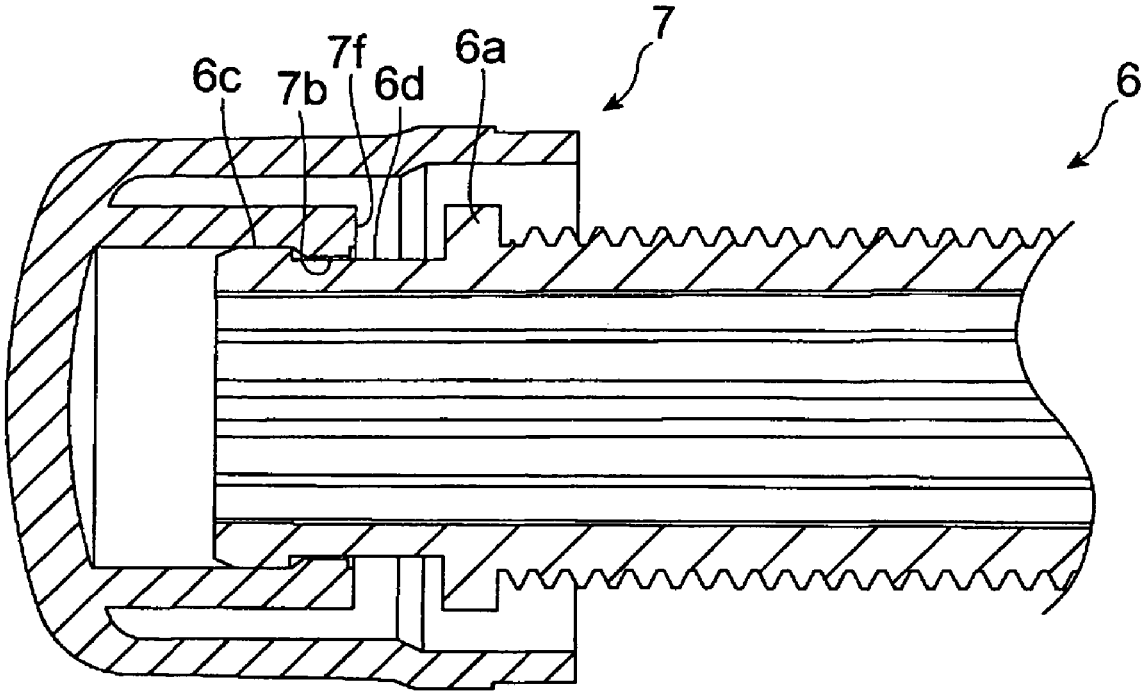
FIG. 12 is a vertical sectional view showing another positional relation than FIG. 11.
Figure 13:
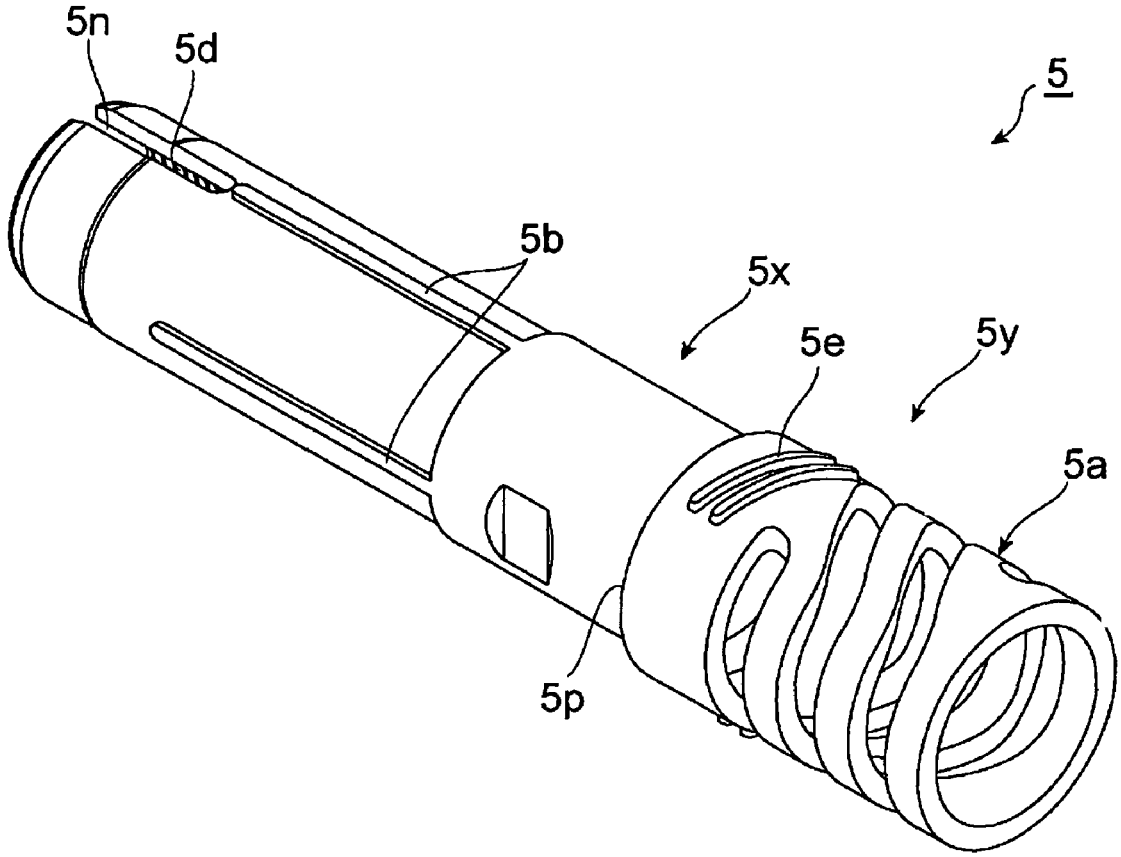
FIG. 13 is a perspective view showing the moving thread tube in FIGS. 1 to 4.
Figure 14:
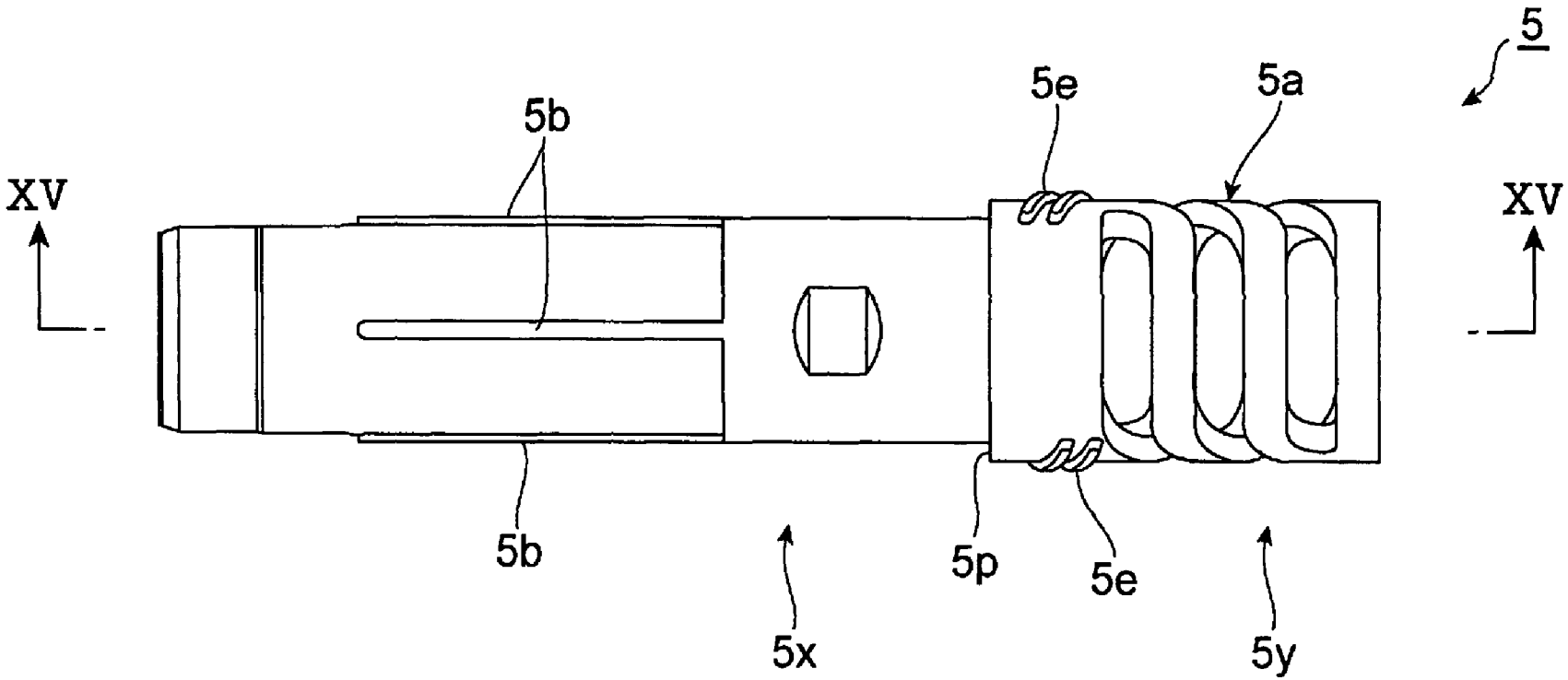
FIG. 14 is a side view of the moving thread tube shown in FIG. 13.
Figure 15:
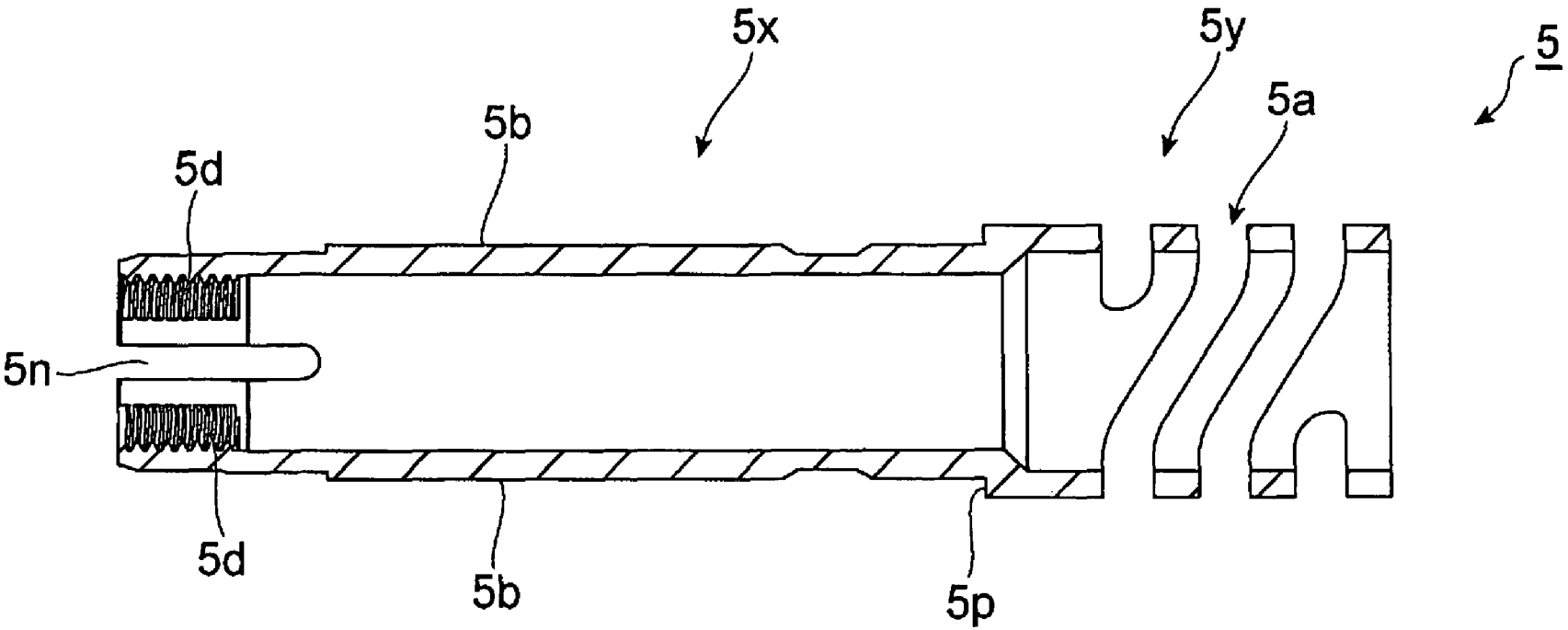
FIG. 15 is a view as seen in the direction of an arrow XV-XV in FIG. 14.
Figure 16:
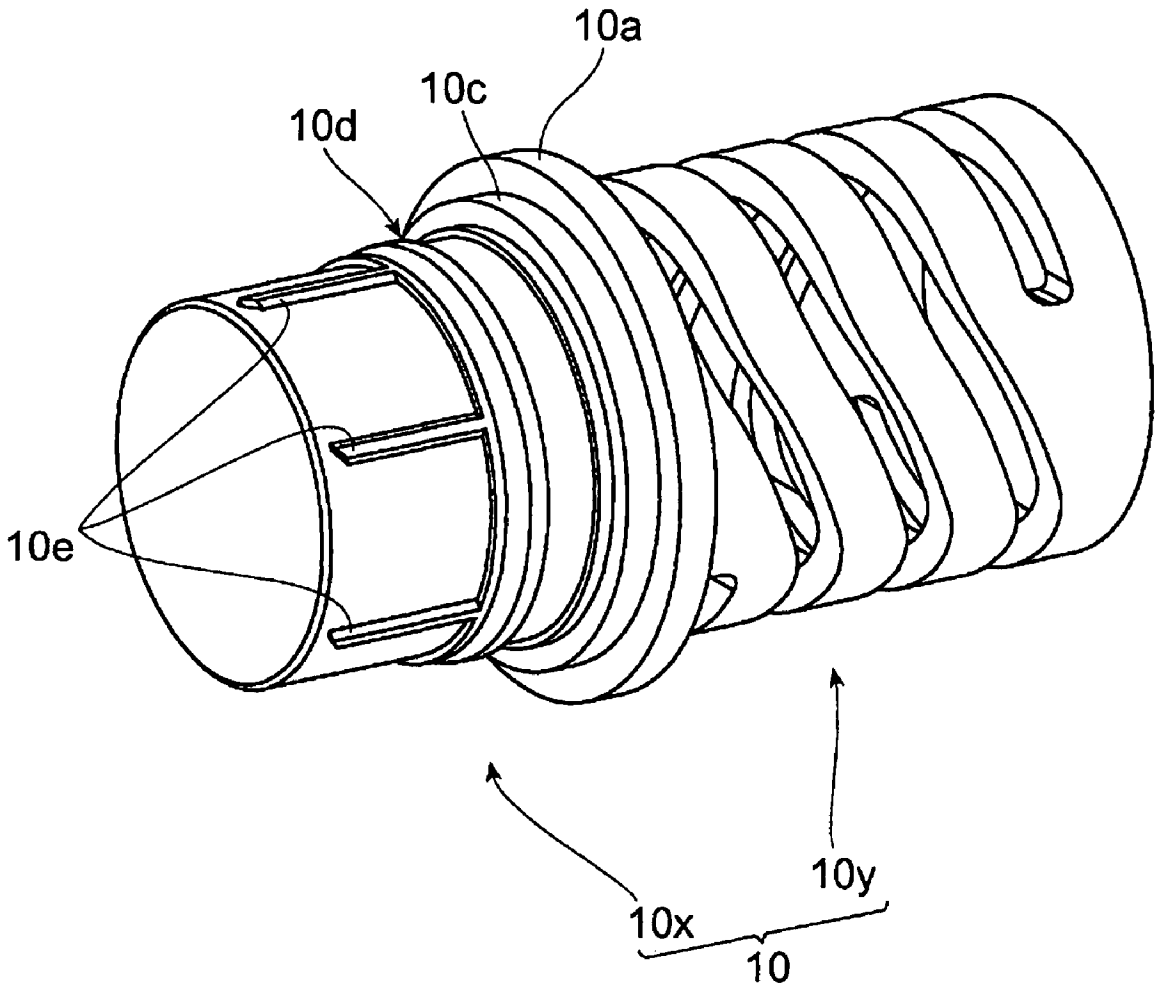
FIG. 16 is a perspective view showing a rotating member in FIGS. 1 to 4.
Figure 17:
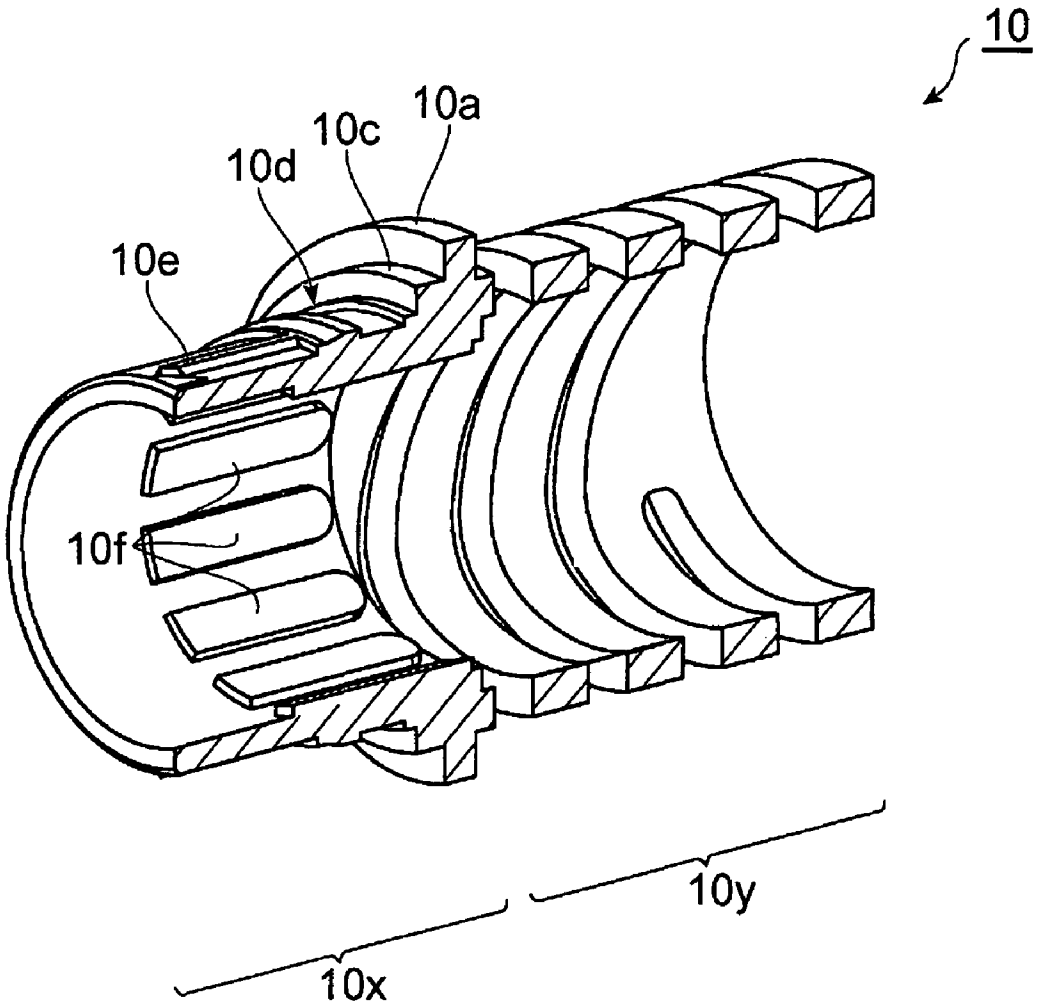
FIG. 17 is a vertical sectional perspective view of the rotating member shown in FIG. 16.
Figure 18:
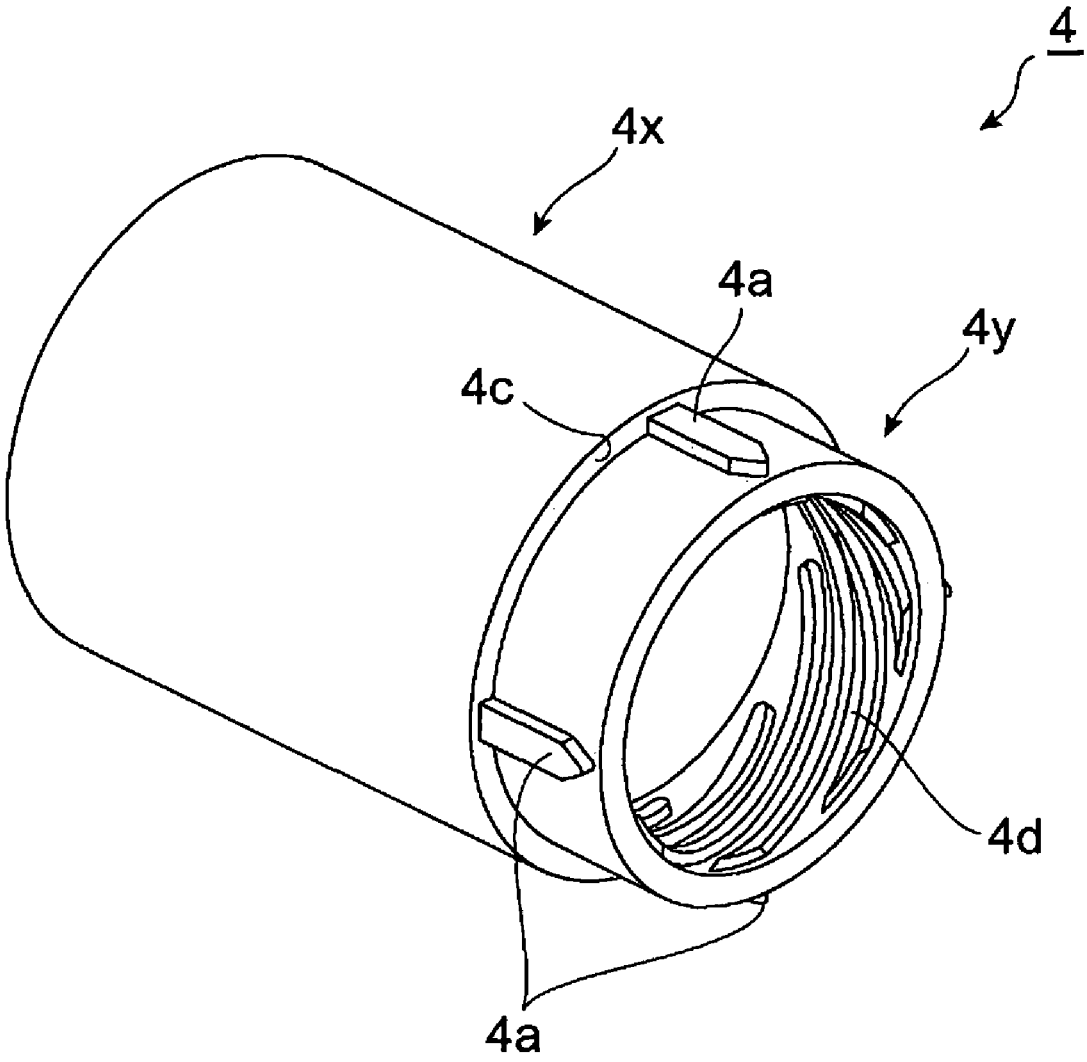
FIG. 18 is a perspective view showing the thread tube in FIGS. 1 to 4.
Figure 19:
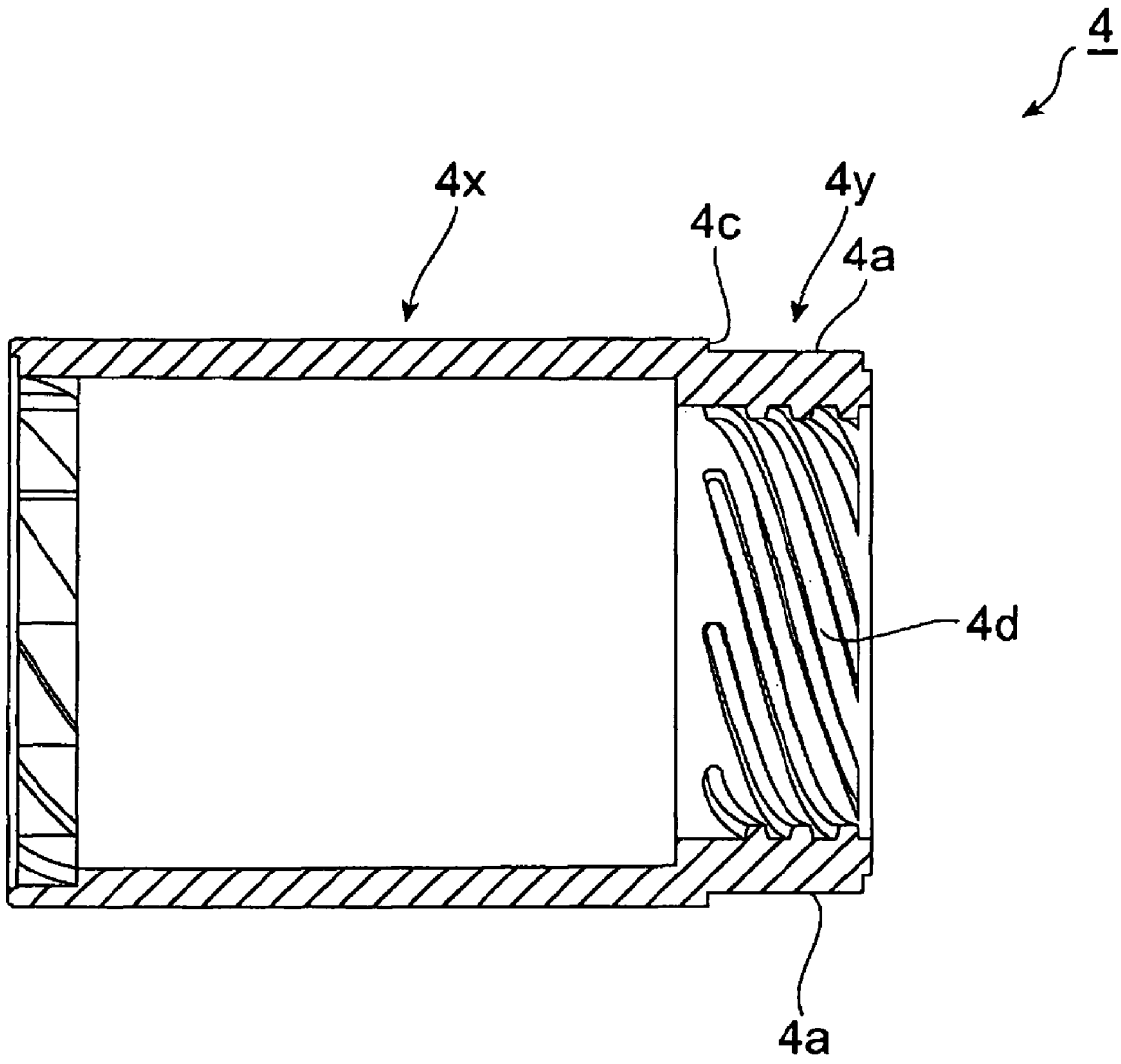
FIG. 19 is a vertical sectional view of the thread tube shown in FIG. 18.
Figure 20:
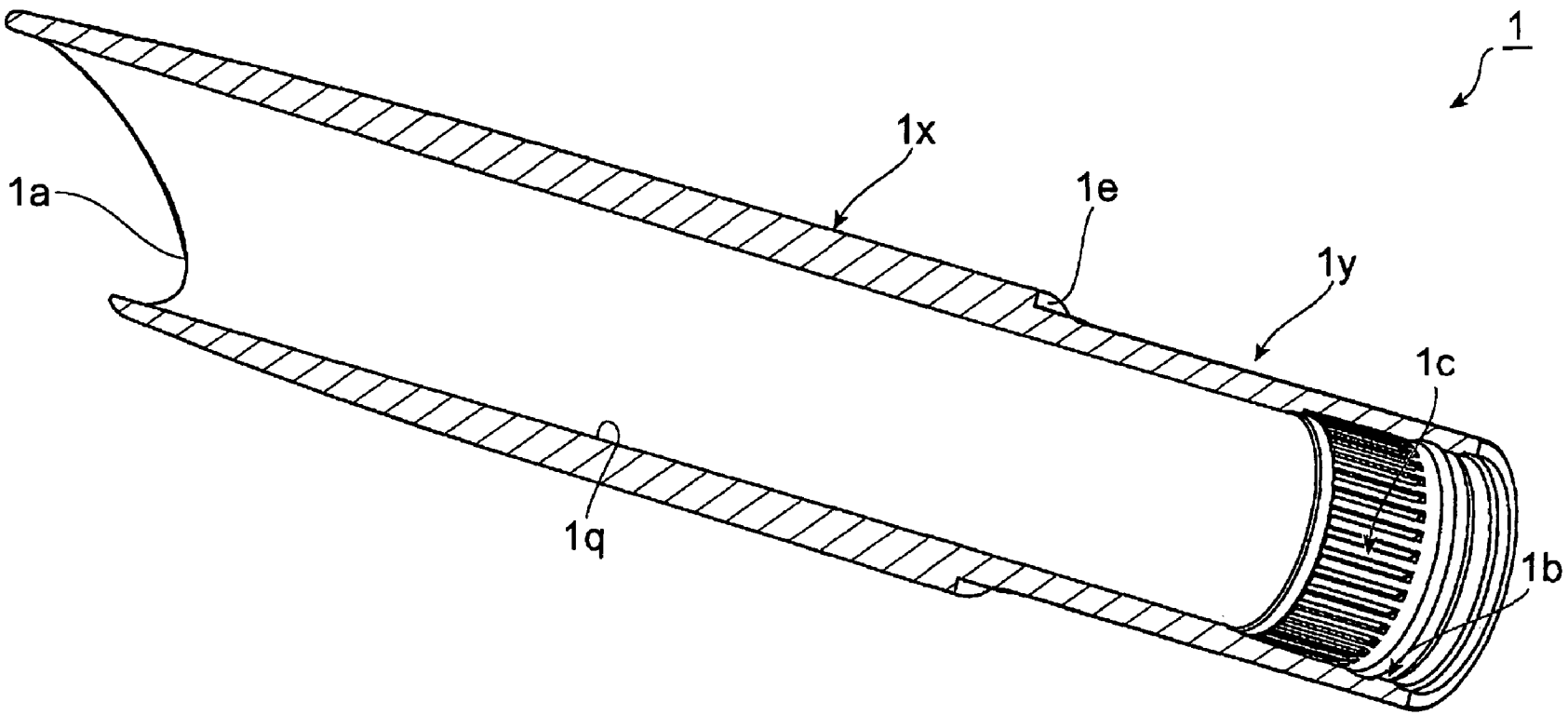
FIG. 20 is a vertical sectional perspective view showing a filling member in FIGS. 1 to 4.
Figure 21:
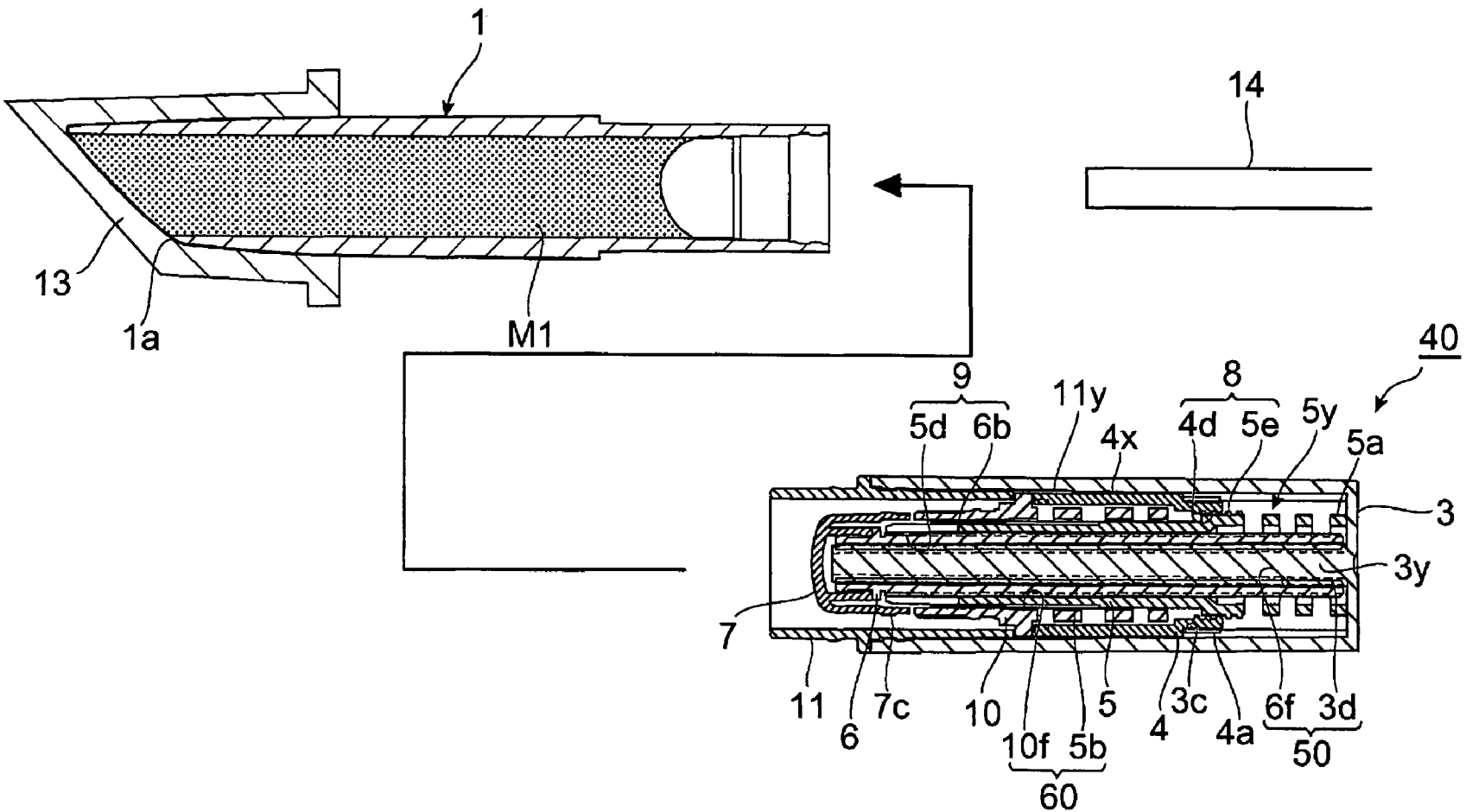
FIG. 21 is an explanatory view showing a manufacturing procedure of the filled material extruding container in accordance with the first embodiment of the present invention.
Figure 22:
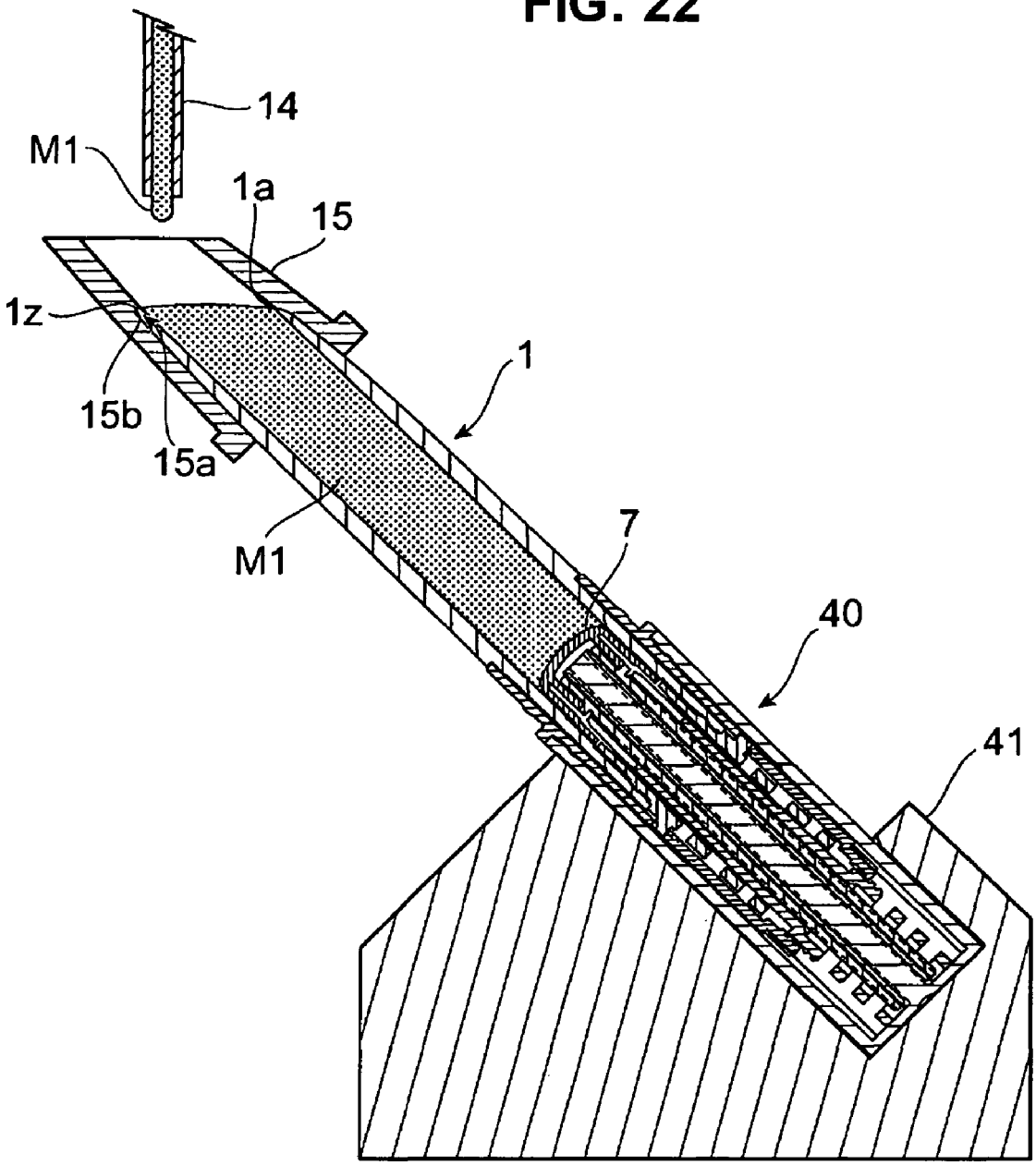
FIG. 22 is an explanatory view showing another manufacturing procedure.

FIGS. 1 to 4 are vertical sectional views respectively showing states of a filled material extruding container in accordance with the first embodiment of the present invention, FIG. 5 is a broken perspective view showing a main body tube, FIGS. 6 and 7 are respective views showing an intermediate member, FIGS. 8 and 9 are respective views showing a moving body, FIG. 10 is a vertical sectional view showing a piston, FIGS. 11 and 12 are respective vertical sectional views showing a state of a piston and a moving body, FIG. 13 to 15 are respective views showing a moving thread tube, FIGS. 16 and 17 are respective views showing a rotating member, FIGS. 18 and 19 are respective views showing a thread tube, FIG. 20 is a vertical sectional perspective view showing a filling member, and FIGS. 21 and 22 are respective explanatory views showing a manufacturing procedure of the filled material extruding container. The filled material extruding container in accordance with the present embodiment can appropriately push out and pull back a material filled therein on the basis of an operation of a user, as well as accommodating the material.

In this first embodiment, a stick-shaped material is used as the filled material M. The stick-shaped material can be, for example, various stick-shaped cosmetic materials including a lip stick, a lip gloss, an eye liner, an eye color, an eyebrow, a lip liner, a cheek color, a concealer, a beauty stick, a hair color or the like, and a stick-shaped lead of a writing instrument or the like, and it is preferable, in view of generation of a closely attaching action to a piston (extruding portion) 7 or a filling member 1 mentioned below, to employ a very soft (semisolid, soft solid, soft, jelly-like or mousse-like) stick-shaped material. Further, it is possible to use a small-diameter stick-shaped material having an outer diameter of 1 mm or less, and a thick stick-shaped material having an outer diameter of 10 mm or more.

As shown in FIG. 1, a filled material extruding container 100 is provided with a tubular filling member 1 which is open at both ends and has a filling region 1*q* for loading a filled material M in an inner portion, and a main body tube (a main body) 3 where a rear portion of the filling member 1 is inserted to a front portion thereof and the filling member 1 is coupled so as to be relatively rotatable and be undetachable in an axial direction, as an outer shape structure. A container front portion is constructed by the filling member 1, and a container rear portion is constructed by the main body tube 3.

Further, the filled material extruding container 100 is approximately provided in an inner portion with the filled material M loaded in the filling member 1, a thread tube 4 coupled to the main body tube 3 so as to be synchronously rotatable and be undetachable in the axial direction, a rotating member 10 coupled to the filling member 1 so as to be synchronously rotatable and be undetachable in the axial direction, an intermediate member 11 coupled to the main body tube 3 so as to be synchronously rotatable and be undetachable in the axial direction and making the rotating member 10 undetachable in the axial direction, a movable thread tube 5 engaging with the rotating member 10 so as to be synchronously rotatable and be movable in the axial direction, engaging with the thread tube 4 via a first engagement portion 8, moving forward when the filling member 1 constructing the container front portion and the main body tube 3 constructing the container rear portion are relatively rotated in a feeding out direction corresponding to one direction, stopping the forward movement when it moves forward to a predetermined forward moving limit, moving backward when the filling member 1 and the main body tube 3 are relatively rotated in a retracting direction corresponding to the other direction in an opposite direction to the one direction, and stopping the backward movement when it moves backward to a predetermined backward moving limit, a movable body 6 engaging with the main body tube 3 so as to be synchronously rotatable and be movable in the axial direction, engaging with the movable thread tube 5 via a second engagement portion 9, moving forward independently as well as moving forward together with the movable thread tube 5 when the filling member 1 and the main body tube 3 are relatively rotated in one direction, moving forward independently when the movable thread tube 5 reaches the forward moving limit and the filling member 1 and the main body tube 3 are relatively rotated further in the same direction, moving backward independently as well as moving backward together with the movable thread tube 5 when the filling member 1 and the main body tube 3 are relatively rotated in the other direction, and moving backward independently when the movable thread tube 5 reaches the backward moving limit and the filling member 1 and the main body tube 3 are relatively rotated further in the same direction, and a piston (an extruding portion) 7 installed to a leading end portion of the movable body 6 and inserted into the filling member 1 so as to form a rear end of the filling region 1*q* and to slide in the filling member 1.

The main body tube 3 is structured, as shown in FIG. 5, such as to be provided with a main body portion 3*x* constructed in a closed-end cylindrical shape, and a shaft body 3*y* provided in a rising manner at a center of a bottom portion of the main body portion 3*x* toward a leading end side.

The main body portion 3*x* is provided with annular convex and concave portions (in which convex and concave portions are arranged in parallel in the axial direction) 3*a* for engaging the intermediate member 11 in the axial direction, on an inner peripheral surface of a leading end portion thereof, and is provided with a knurling 3*b* in which a lot of concave and convex portions are provided in parallel in a peripheral direction and the concave and convex portions extend at a predetermined length in the axial direction, as a structure for engaging the intermediate member 11 in a rotating direction, on an inner peripheral surface at a rear side from the annular convex and concave portions 3*a*. Further, the main body portion 3*x* is provided with a lot of protrusions 3*c* provided in parallel along the peripheral direction and extending toward a leading end side from a bottom portion, as a structure for engaging the thread tube 4 in the rotating direction, on an inner peripheral surface at the bottom portion side.

The shaft body 3*y* is formed in a non-circular cross sectional shape provided with protrusions 3*d* which are arranged at six uniformly arranged positions along the peripheral direction on an outer peripheral surface of a columnar body in such a manner as to protrude to an outer side in a radial direction so as to extend in the axial direction, and the protrusions 3*d* are formed as a rotation stopper constituting one of rotation stop mechanisms (rotation stop portions) 50 of the main body tube 3 and the movable body 6.

As shown in FIGS. 6 and 7, the intermediate member (a rotating member pressing member) 11 is made approximately in a cylindrical shape, is provided with a collar portion 11*a* in which an outer surface in the middle in the axial direction is enlarged in the radial direction, and is provided with annular concave and convex portions (in which concave and convex portions are arranged in parallel in the axial direction) 11*b* as a structure engaging with the annular convex and concave portions 3*a* of the main body tube 3 in the axial direction, on an outer peripheral surface at a rear side from the collar portion 11*a*. Further, a plurality of protrusions 11*d* arranged in parallel along the peripheral direction and extending in the axial direction are provided as a structure engaging with the knurling 3*b* of the main body tube 3 in the rotating direction, on an outer peripheral surface at a rear side from the annular concave and convex portions 11*b* of the intermediate member 11. Further, a plurality of protruding portions (so-called dowels) 11*c* for detachably engaging the cap 12 shown in FIG. 1 in the axial direction are provided along the peripheral direction, on an outer peripheral surface at a front side from the collar portion 11*a* of the intermediate member 11.

The intermediate member 11 is structured, as shown in FIG. 1, such that a portion at a rear side from the collar portion 11*a* is inserted into the main body tube 3, a rear end surface of the collar portion 11*a* is brought into contact with the leading end surface of the main body tube 3, the protrusions 11*d* are engaged with the knurling 3*b* of the main body tube 3 in the rotating direction, and the annular concave and convex portion 11*b* is engaged with the annular convex and concave portions 3*a* of the main body tube 3 in the axial direction, thereby being installed to the main body tube 3 so as to be synchronously rotatable and be undetachable in the axial direction, and being integrated with the main tube portion 3.

The movable body 6 is formed as an injection molded product by resin, is structured in a cylindrical shape having a collar portion 6*a* at a leading end side, and is provided with a male thread 6*b* constituting one part of a second engagement portion (an engagement mechanism) 9, on an outer peripheral surface extending from a rear side of the collar portion 6*a* to a rear end, as shown in FIGS. 8 and 9. An outer shape of the collar portion 6*a* positioned at a front side of the male thread 6*b* is formed in a shape provided with two flat surface portions 6*aa* oppositely on an outer periphery in a circular shape.

Further, the front side of the collar portion 6*a* of the movable body 6 is formed as a cylinder portion having a smaller diameter than the collar portion 6*a*, and a small-diameter collar portion 6*c* is provided at a leading end of the cylinder portion, whereby an annular groove portion 6*d* which is wide in the axial direction is formed between the small-diameter portion 6*c* and the collar portion 6*a*. The wide annular groove portion 6*d* is provided for engaging the piston 7 so as to be movable in the axial direction.

Further, an inner peripheral surface corresponding to a tube hole of the movable body 6 is formed as a hole having a circular cross sectional shape, and protrusions 6*f* radially protruding at a predetermined length toward an inner side and extending in the axial direction are provided at six uniformly arranged positions along the peripheral direction of a peripheral surface of the hole. The protrusions 6*f* are formed as a rotation stopper constituting the other part of the rotation stop portion (the rotation stop mechanism) 50 between the main body tube 3 and the movable body 6.

The movable body 6 is fitted onto the shaft body 3*y* of the main body tube 3, as shown in FIG. 1, and each of the protrusions 6*f* enters into a portion between the protrusions 3*d* and 3*d* of the shaft body 3*y* of the main body tube 3 so as to engage in the rotating direction, thereby the movable body 6 being installed to the main body tube 3 so as to be synchronously rotatable and be movable in the axial direction.

The piston 7 is molded by a comparatively soft raw material such as a polypropylene (PP), a high density polyethylene (HDPE), a linear low density polyethylene (LLDP) or the like, is formed in a shape which is curved gently toward the leading end, and is provided with a concave portion 7*a* recessed in such a manner as to copy an outer surface from a rear end surface toward a leading end side, as shown in FIG. 10. A cylinder portion 7*d* extending short toward a rear side is provided at the outer peripheral side of the inner side of the leading and portion of the piston 7, and an annular protruding portion 7*b* is provided on an inner peripheral surface of the cylinder portion 7*d*. The annular protruding portion 7*b* and a rear end surface 7*f* of the cylinder portion 7*d* are provided for engaging with the movable body 6 so as to be movable in the axial direction. Further, the piston 7 is provided with an annular protruding portion 7*c* closely attached to the inner peripheral surface of the filling member 1 so as to secure airtightness on an outer peripheral surface of a rear end portion thereof.

The piston 7 is fitted onto the movable body 6, and the annular protruding portion 7*b* enters into the annular groove portion 6*d* of the movable body 6, thereby the piston 7 being installed to the movable body 6 so as to be rotatable and be movable in the axial direction (movable within a predetermined range, which will be described below in detail) as shown in FIG. 11. In this case, the piston 7 and the movable body 6 can be structured such as to be synchronously rotatable. Further, the piston 7 is set to such a state in which the rear end surface 7*f* of the cylinder portion 7*d* is brought into contact with the surface at the front side of the collar portion 6*a* of the movable body 6 as shown in FIG. 11, in the filled material extruding container 100 in the initial state shown in FIG. 1.

The movable thread tube 5 is formed as an injection molded product by resin, is structured in a stepped cylindrical shape having an outer diameter large-diameter portion 5*y* at a rear side and an outer diameter small-diameter portion 5*x* provided at the front side therefrom via a step surface 5*p* as shown in FIGS. 10 and 11.

The outer diameter small-diameter portion 5*x* is provided with protrusions 5*b* extending in the axial direction at four uniformly arranged positions along the peripheral direction, on an outer peripheral surface at the middle in the axial direction, for engaging the rotating member 10 in the rotating direction. The protrusions 5*b* are formed as a rotation stopper constructing one part of a rotation stop mechanism (a rotation stop portion) 60 between the rotating member 10 and the movable thread tube 5.

Further, the outer diameter small-diameter portion 5*x* is provided with a pair of slits 5*n* extending from a leading end of the outer diameter small-diameter portion 5*x* to a portion near the protrusions 5*b* and making the inner side communicate with the outer side, at both sides of the axis. Function of the slits 5*n* will be described later.

Further, the outer diameter small-diameter portion 5*x* is provided with a female thread 5*d* constituting the other part of the second engagement portion (the thread mechanism) 9 on an inner surface of a leading end portion thereof in such a manner as to cross the slits 5*n* and 5*n* and form a semicircular arc shape.

Further, the outer diameter large-diameter portion 5*y* of the movable thread tube 5 is provided with a plurality of engagement projections (circular arc shaped protrusions) 5*e* as a male thread constituting one part of the first engagement portion (engagement mechanism) 8 on the outer peripheral surface of the leading end portion thereof. Further, the outer diameter large-diameter portion 5*y* of the movable thread tube 5 is provided continuously and integrally with a spring portion (an energizing means) 5*a*, which is so-called a resin spring capable of extension and contraction in the axial direction, at the rear side from the engagement protrusions 5*e*.

The female thread 5*d* of the movable thread tube 5 having the structure mentioned above is molded by a core pin (a molding die) having a thread portion on an outer peripheral surface for forming the female thread 5*d*. The core pin is drawn out to a leading end side or a rear end side in the axial direction, so-called forcedly drawn out, after hardening of the resin at a time of the resin molding, however, the leading end portion of the movable thread tube 5 is opened to an outer side in the diametrical direction by the slits 5*n* and 5*n* at a time of forcedly drawing, whereby the core pin is easily drawn out without giving any damage to the female thread 5*d*. As mentioned above, since the movable thread tube 5 is structured to make it possible to employ the forcedly drawing method in place of a method of turning and drawing the core pin by using a motor, a rack or the like, it is possible to mold rapidly, and it is possible to reduce a manufacturing cost and a metal mold cost.

Further, the movable thread tube 5 is fitted onto the movable body 6 as shown in FIG. 1, and the female thread 5*d* is set to a state of engaging with the male thread 6*b* of the movable body 6. In this state, the movable thread tube 5 is set to a state that the rear end surface of the spring portion (energizing means) 5*a* thereof is brought into contact with the bottom surface of the main body tube 3.

The rotating member 10 is formed as an injection molded product by resin, and is formed in a stepped cylindrical shape provided with a spring portion (an energizing means) 10*y* at a rear portion side, and a main body portion (an energizing means) 10*x* at a front side from the spring portion 10*y*, as shown in FIGS. 16 and 17.

The main body portion 10*x* is structured such that an outer diameter is made larger in stages toward a rear side, is provided, at a rear portion, with a collar portion 10*a* for holding the thread tube 4 in the axial direction, provided with a collar portion 10*c* for contacting with the rear end surface of the filling member 1, on an outer peripheral surface at a front side of the collar portion 10*a*, and provided with an annular convex and concave portion 10*d* as a structure for engaging the filling member 1 in the axial direction, on an outer peripheral surface at a front side of the collar portion 10*c*. Further, a plurality of protrusions 10*e* arranged in parallel along the peripheral direction and extending in the axial direction are provided as a structure for engaging the filling member 1 in the rotating direction, on an outer peripheral surface at a front side of the annular convex and concave portion 10*d* of the main body portion 10*x*. Further, protrusions 10*f* extending in the axial direction are provided as a structure for engaging with the protrusions 5*b* of the movable thread tube 5 in the rotating direction at a plurality of positions along the peripheral direction, on an inner peripheral surface of the main body portion 10*x*. The protrusions 10*f* are structured as a rotation stopper constituting the other part of the rotation stop mechanism (the rotation stop portion) 60 between the rotating member 10 and the movable thread tube 5.

The spring portion 10*y* is integrally provided at a rear side of the main body portion 10*x* continuously, and is constituted by a so-called resin spring which can be contracted and extended in the axial direction.

The rotating member 10 provided with the main body portion 10*x* and the spring portion 10*y* is fitted onto the movable thread tube 5 as shown in FIG. 1, and the collar portion 10*a* is brought into contact with the rear end surface of the intermediate member 11 so as to be relatively rotatable, thereby being prevented from being detached to the front side in the axial direction. The protrusions 10*f* are engaged with the protrusions 5*b* of the movable thread tube 5 in the rotating direction in this state, thereby making the movable thread tube 5 synchronously rotatable and movable in the axial direction. Further, in this state, a predetermined space for forward moving the movable thread tube 5 is provided between the rear end surface of the spring portion 10*y* of the rotating member 10 and the step surface 5*p* of the movable thread tube 5. In this case, the predetermined space may be omitted.

The thread tube 4 is formed as an injection molded product by resin, is structured in a stepped cylindrical shape as shown in FIGS. 18 and 19, and is provided with a small-diameter portion 4*y* at a rear side, and a large-diameter portion 4*x* at a front side therefrom via a step surface 4*c*. A plurality of protrusions 4*a* arranged in parallel along the peripheral direction and extending in the axial direction are provided as a structure for engaging with the protrusions 3*c* of the main body tube 3 in the rotating direction, on an outer peripheral surface of the small-diameter portion 4*y*. An inner peripheral surface of the small-diameter portion 4*y* is formed so as to have a smaller diameter than an inner peripheral surface of the large-diameter portion 4*x*, and a female thread 4*d* constituting the other part of the first engagement portion (the engagement mechanism) 8 is provided on an inner peripheral surface of the small-diameter portion 4*y*.

The thread tube 4 is inserted between the main body tube 3 and the movable thread tube 5 as shown in FIG. 1, and a leading end surface thereof is brought into contact with the collar portion 10*a* of the rotating member 10, whereby the protrusions 4*a* are engaged with the protrusions 3*c* of the main body tube 3 in the rotating direction, in a state in which the step surface 4*c* is brought into contact with the leading end surface of the protrusions 3*c* of the main body tube 3, and thus the thread tube 4 is installed to the main body tube 3 so as to be synchronously rotatable and undetachable in the axial direction, and integrated with the main body tube 3. In this state, the collar portion 10*a* of the rotating member 10 is set to be relatively rotatable with respect to the intermediate member 11 integrated with the main body tube 3 and the thread tube 4. Further, in this state, the female thread 4*d* of the thread tube 4 is set to a state of being engaged with the engagement projections 5*e* of the movable thread tube 5. Specifically, the leading ends of the engagement protrusions 5*e* of the movable thread tube 5 are engaged with the rear end of the female thread 4*d* of the thread tube 4 and, in this state, the movable thread tube 5, in which the rear end surface of the spring portion 5*a* is brought into contact with the bottom surface of the main body tube 3, is set to a state that the engagement protrusions 5*e* are energized toward front side.

In the first engagement portion 8 constituted by the engagement projections 5*e* of the movable thread tube 5 and the female thread 4*d* of the thread tube 4, and the second engagement portion 9 constituted by the female thread 5*d* of the movable thread tube 5 and the male thread 6*b* of the movable body 6, a lead of the first engagement portion 8 is made larger than a lead of the second engagement portion 9, as shown in FIGS. 15 and 19. In this case, the lead means a distance of moving in the axial direction at a time of one rotation of the thread. In this embodiment, for example, the first engagement portion 8 is set to have 8 mm lead, 8 thread lines, 1 mm pitch, and left thread so as to move forward (backward) for 8 mm by one relative rotation of the main body tube 3 to the filling member 1 and the second engagement portion 9 is set to have 0.5 mm lead, 1 thread line, 0.5 mm pitch and right thread so as to move forward (backward) for 0.5 mm by one relative rotation of the main body tube 3 to the filling member 1.

Further, as shown in FIG. 21, the main body side tube body constituted by the main body tube 3 and the intermediate member 11 is provided with (incorporates) the extruding mechanism having the rotation stop portion 50 constituted by the first and second engagement portions 8 and 9, the protrusions 6*f* of the movable body 6 and the protrusions 3*d* of the shaft body 3*y* of the main body tube 3, and the rotation stop portion 60 constituted by the protrusions 5*b* of the movable thread tube 5 and the protrusions 10*f* of the rotating member 10, the thread tube 4, the movable thread tube 5, the movable body 6, the piston 7 and the rotating member 10, whereby a main body side assembly 40 is structured.

In this case, it is preferable that the thread tube 4, the movable thread tube 5, the movable body 6, the rotating member 10 and the intermediate member 11 are made by an injection molding raw material having a high sliding performance, such as a polyacetal (POM), an ultra high molecular weight polyethylene (UHMWPE) or the like.

The filling member 1 is provided for loading the filled material M into the filling region 1*q* in an inner portion as shown in FIG. 1, and is provided so as to make the filled material M appear from the leading end portion in accordance with an operation by a user. It is preferable that the filling member 1 and a cap 12 are formed by an injection molding raw material such as the ABS, a polypropylene (PP), a polyethylene terephthalate (PET), a poly-cyclohexane dimethylene terephthalate (PCT) group PETG, PCTG and PCTA and the like, and that a transparent raw material is used in order to check out a color tone and an loading state of the filled material M, or a colored material having a color of the filled material M or another color is used.

As shown in FIGS. 1 and 20, the filling member 1 is structured in a stepped cylindrical shape, and is provided with a small-diameter portion 1*y* at a rear side, and a large-diameter portion 1*x* at a front side therefrom via a step surface 1*e*. The large-diameter portion 1*x* is formed in such a shape that an outer periphery is somewhat tapered toward a leading end, and an opening 1*a* at the leading end is formed as an opening for making the filled material M appear. Further, in this case, the leading end surface of the filling member 1 and the leading end surface of the filled material M are formed as an inclined surface which is inclined with respect to a surface orthogonal to the axis as seen in the vertical direction to a paper surface of FIG. 1.

As shown in FIG. 20, an annular concave and convex portion 1*b* is provided as a structure engaging with the annular convex and concave portion 10*d* of the rotating member 10 in the axial direction, on an inner peripheral surface of a rear end portion of the small-diameter portion 1*y*, and a knurling 1*c*, in which a lot of concave and convex portions are provided in parallel in the peripheral direction and the concave and convex portions extend at a predetermined length in the axial direction, is provided as a structure engaging with protrusions 10*e* of the rotating member 10 in the rotating direction, on an inner peripheral surface at a front side of the annular concave and convex portion 1*b*.

The filling member 1 is inserted to a portion between the rotating member 10 and the piston 7, and the intermediate member 11 from a rear portion side thereof, as shown in FIG. 1, is structured such that a rear end surface is brought into contact with the collar portion 10*c* of the rotating member 10, the annular concave and convex portion 1*b* is engaged with the annular convex and concave portion 10*d* of the rotating member 10 in the axial direction, and the protrusions 10*e* of the rotating member 10 are engaged with the knurling 1*c* in the rotating direction, whereby the filling member 1 is installed to the rotating member 10 so as to be synchronously rotatable and be undetachable in the axial direction, and is integrated with the rotating member 10. The rotating member 10 is prevented from being detached to the front side in the axial direction and is made synchronously rotatable with the movable thread tube 5 by the intermediate member 11 integrated with the main body tube 3, as mentioned above, the movable thread tube 5 is engaged with the movable body 6 via the second engaging portion 9, and the movable body 6 is made synchronously rotatable with the main body tube 3. Accordingly, the filling member 1 is installed to the main body tube 3 so as to be relatively rotatable and undetachable in the axial direction. Further, the piston 7 (the annular protruding portion 7*c*) is inserted into the rear end portion of the filling member 1 so as to be closely attached to the filling member 1.

Further, as shown in FIG. 1, since the cap 12 is detachably installed to the intermediate member 11, the filling member 1 is protected by the cap 12.

Next, a description will be given of an example of a manufacturing procedure of the filled material extruding container 100 having the structure mentioned above with reference to FIG. 21. First, the movable thread tube 5 is screwed to the movable body 6 until it comes to the initial position. Alternatively, it is pressed to the initial position while forcedly getting over a thread ridge. Next, the rotating member 10 is fitted onto the movable thread tube 5 in such a manner that the protrusions 5*b* of the movable thread tube 5 engage with the portions between the protrusions 10*f* and 10*f* of the rotating member 10, the piston 7 is next installed to the movable body 6, the large-diameter portion 4*x* of the thread tube 4 is inserted to the outer-diameter large-diameter portion 5*y* of the movable thread tube 5, and the female thread 4*d* on the inner peripheral surface of the thread tube 4 is engaged with the engagement projections 5*e* on the outer peripheral surface of the movable thread tube 5, and is rotated in the retracting direction so as to be moved back to a predetermined position, whereby a preliminary assembly is obtained.

Next, the preliminary assembly is inserted from the opening side of the main body tube 3, the thread tube 4 is inserted to the main body tube 3 while engaging the protrusions 4*a* of the thread tube 4 with the portions between the protrusions 3*c* and 3*c* of the main body tube 3, as well as the movable body 6 is fitted onto the shaft body 3*y* while engaging the protrusions 6*f* of the movable body 6 with the portions between the projections 3*d* and 3*d* of the shaft body 3*y* of the main body tube 3, and the rear end surface of the spring portion 5*a* of the movable thread tube 5 is brought into contact with the bottom surface of the main body tube 3. Next, the intermediate member 11 is inserted to the main body tube 3 so as to be installed, the intermediate member 11 makes the rotating member 10 and thread tube 4 via the rotating member 10 undetachable toward the front side in the axial direction, and the main body side assembly 40 is obtained.

On the other hand, as for the filling member 1, in a state in which the opening 1*a* at the leading end is closed by a seal member 13 and the filling member 1 is inverted, a predetermined amount of a molten filling material M1 is discharged into the inner portion from a nozzle 14 so as to be loaded partway to the rear end from the leading end of the filling member 1 and form a state in which no space exists within the leading end of the filling member 1. Further, when the molten filling material M1 is cooled and solidified so as to form the filled material M, the leading end side of the main body side assembly 40 is fitted onto the filling member 1 loaded with the filled material M from an upper side, and the filling member 1 is installed to the main body tube 3 (the intermediate member 11) while inserting the piston 7 to the filling member 1. At this time, the filling member 1 is engaged with the main body tube 3 while the inner peripheral surface thereof comes into slidable contact with the annular protruding portion 7*c* for securing airtightness of the piston 7.

Further, when the seal member 13 is detached from the filled material extruding container obtained as mentioned above, the filled material extruding container 100 in the initial state is obtained as shown in FIG. 1. It is sanitary if the user (the consumer) detaches the seal member 13 after buying. Further, an inner shape of the cap 12 may be changed so as to be used as the seal member 13.

Further, in accordance with another manufacturing procedure, as shown in FIG. 22, the filling member 1 is first installed to the main body side assembly 40, the assembly is set to the jig 41 in such a manner that the inclined leading end surface 1*z* of the filling member 1 becomes horizontal, and a cylindrical heat insulating member 15, for example, made of a rubber material or the like is fitted and set onto the leading end portion of the filling member 1. At this time, an inner peripheral surface of the heat insulating member 15 is provided with a step portion 15*a* by which an inner diameter at a rear side (a lower side in the drawing) is made larger, an end surface 15*b* constituting the step portion 15*a* contacts with a leading end surface 1*z* of the filling member 1, and an inner peripheral surface at a front side from the step portion 15*a* of the heat insulating member 15 is made approximately flush with the opening 1*a* at the leading end of the filling member 1.

Next, a molten filling material M1 is discharged from the nozzle 14 positioned above the opening at the leading end of the heat insulating member 15, and the molten filling material M1 is loaded from the piston 7 side, and is loaded somewhat more than capacity. At this time, the air is hardly involved between the piston 7 and the molten filling material M1, and the filled material M is well retracted on the basis of a sucking action caused by the backward movement of the piston 7. Further, it is possible to prevent the surplus molten filling material M1 from dripping off from the leading end of the filling member 1, on the basis of the heat insulating member 15.

The molten filling material M1 is cooled and solidified, however, since the leading end side of the filling member 1 is kept warm by the heat insulating member 15 at this time, the molten filling material M1 is cooled gradually from the piston 7 side toward the leading end of the filling member 1, bubbles within the molten filling material M1 are well gone out from an upper end of the molten filling material M1, and it is possible to prevent the bubbles from staying within the filled material.

Further, after the molten filling material M1 is cooled and solidified, the filled material extruding container 100 in the initial state shown in FIG. 1 can be obtained by detaching the heat insulating member 15 and cutting the leading end of the filled material M to perform a finish processing.

In accordance with the filled material extruding container 100 structured as mentioned above, since the filled material M is loaded only in the tubular filling member 1, the thickness of the filling member 1 is set comparatively uniform and the thickness in the diametrical direction of the filled material M is made constant along the axial direction, so that it is possible to stabilize a temperature condition after loading the molten filling material M1 till the molten filling material M1 is solidified. As a result, it is possible to well load the filled material M and a manufacturing yield ratio is improved.

Further, in the filled material extruding container shown in FIG. 21, on the basis of the structure in which the filling member 1 loaded with the filled material M is assembled in the main body side assembly 40, it is easy to manufacture the container. In the filled material extruding container shown in FIG. 22, on the basis of the structure in which the filled material M is loaded in the filing member 1 assembled in the main body side assembly 40, it is further easy to manufacture the container.

Further, on the basis of the structure in which the filling member 1 loaded with the filled material M is assembled in the main body side assembly 40, or the structure in which the filled material M is loaded in the filling member 1 assembled in the main body side assembly 40, it is possible to safely protect the filled material in the filling member 1, even if the filled material is constituted by a soft semisolid stick-shaped material, an elongated frail stick-shaped material or a soft, jelly-like or mousse-like stick-shaped material.

Further, in this state, the piston 7 is closely attached to the inner peripheral surface of the filling member 1, the filled material M is closely attached to the inner peripheral surface of the filling member 1, and the piston 7 and the filled material M are in a closely attached state.

In the filled material extruding container 100 in the initial state shown in FIG. 1 and structured as mentioned above, when the cap 12 is detached by a user and the filling member 1 and the main body tube 3 are relatively rotated in the feeding out direction, the thread tube 4 synchronously rotating with the main body tube 3 and the movable thread tube 5 are relatively rotated by the rotation stop portion 60 between the rotating member 10 synchronously rotating with the filling member 1 and the movable thread tube 5, and the rotation stop portion 50 between the main body tube 3 and the movable body 6, and the movable thread tube 5 and the movable body 6 are relatively rotated. Accordingly, there is applied an engaging action of the first engagement portion 8 constructed by the engagement projections 5*e* of the movable thread tube 5 and the female thread 4*d* of the thread tube 4, and the second engagement portion 9 constructed by the female thread 5*d* of the movable thread tube 5 and the male thread 6*b* of the movable body 6, the movable thread tube 5 is moved forward, and the movable body 6 is moved forward with respect to the movable thread tube 5. In other words, the movable body 6 is moved forward independently, at the same time of being moved forward together with the movable thread tube 5.

At this time, since the lead of the first engagement portion 8 is set to make 8 mm forward movement by one relative rotation between the filling member 1 and the main body tube 3 and the lead of the second engagement portion 9 is set to make 0.5 mm forward movement by one relative rotation, the movable thread tube 5 is large and quickly moved forward (8 mm per rotation), and the movable body 6 itself is small and slowly moved forward (0.5 mm per rotation). Accordingly, the movable body 6 is moved forward from the position in the initial state shown in FIG. 1 for an amount obtained by adding a small forward moving amount of the movable body 6 itself to a large forward moving amount of the movable thread tube 5 (8.5 mm per rotation). The movable body 6 is quickly moved forward in accordance with the cooperation of the first engagement portion 8 and the second engagement portion 9.

Figure 2:
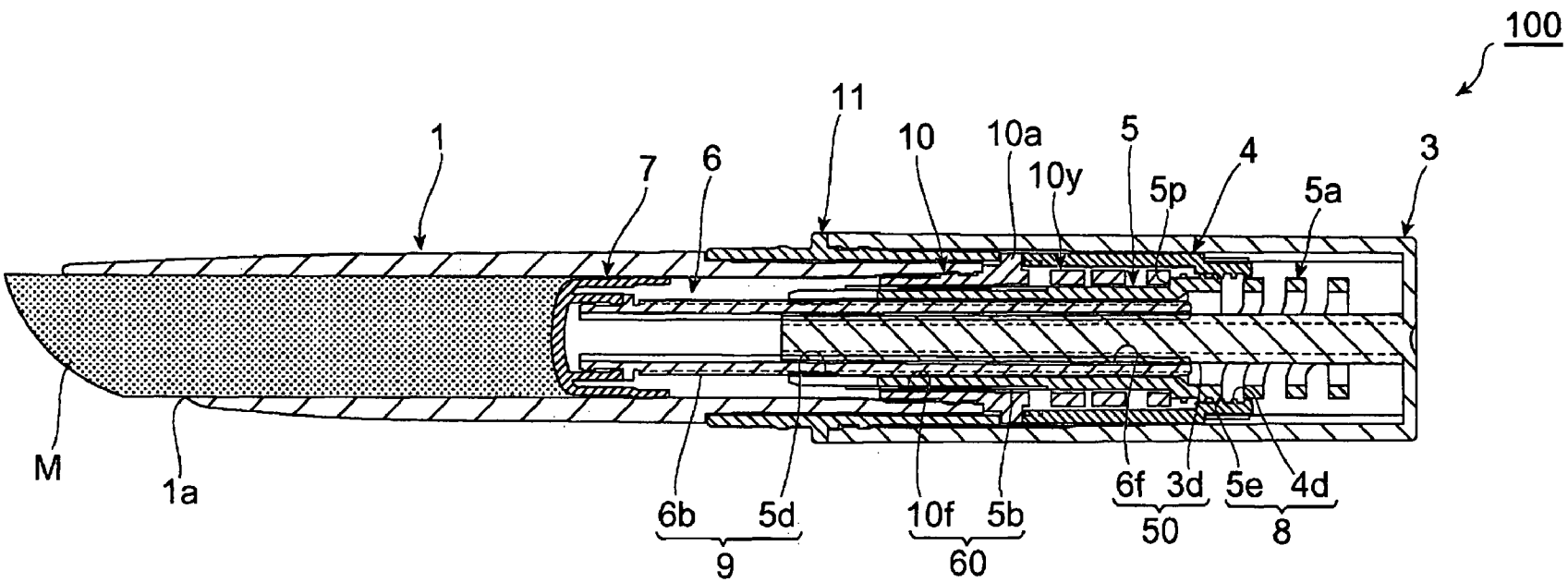
FIG. 2 is a vertical sectional view at a time when a cap is detached from a state shown in FIG. 1, and a moving thread tube and a moving body are moved forward on the basis of an operation of a user.

Further, when the movable thread tube 5 is quickly moved forward as mentioned above, the step surface 5*p* of the movable thread tube 5 is brought into contact with the rear end surface of the spring portion 10*y* of the rotating member 10, the movable thread tube 5 is moved forward and the engagement projections 5*e* of the movable thread tube 5 are detached from the leading end of the female thread 4*d* of the thread tube 4, while the spring 10*y* of the rotating member 10 is compressed so as to store an energizing force, in accordance with the relative rotation in the feeding out direction between the filling member 1 and the main body tube 3, whereby the engagement of the first engagement portion 8 is cancelled, as shown in FIG. 2.

In this engagement cancel state, the movable thread tube 5 is energized to the rear side on the basis of the energizing force of the spring portion 10*y* of the rotating member 10. Accordingly, when the relative rotation in the feeding out direction between the filling member 1 and the main body tube 3 is further kept, the engagement projections 5*e* of the movable thread tube 5 energized to the rear side enter to the adjacent leading end in the rotating direction of the female thread 4*d* of the thread tube 4, and the first engagement portion 8 is returned to be engaged. Further, when the relative rotation in the feeding out direction between the filling member 1 and the main body tube 3 is further kept, the movable thread tube 5 is moved forward while the spring portion 10*y* of the rotating member 10 is compressed, and the engagement projections 5*e* of the movable thread tube 5 are detached from the leading end of the female thread 4*d* of the thread tube 4 so as to cancel the engagement. Further, the engagement is returned on the basis of the further relative rotation in the same direction, and the engagement cancel and the engagement return of the first engagement portion 8 are repeated as mentioned above.

In this case, a sliding resistance is generated between the piston 7 installed to the movable body 6 and the inner peripheral surface of the filling member 1, and the sliding resistance becomes resistance against the energizing force of the spring portion 10*y* applied to the movable body 6 via the second engagement portion 9 at a time of returning of the engagement of the first engagement portion 8 on the basis of the energizing force of the spring portion 10*y* of the rotating member 10. In some cases, there is a risk that the first engagement portion 8 is not returned to be engaged on the basis of the energizing force of the spring portion 10*y* of the rotating member 10, however, in the present embodiment, the movable body 6 can be moved for a predetermined amount in the axial direction with respect to the piston 7, as mentioned above.

In other words, when the engagement of the first engagement portion 8 is cancelled and the movable body 6 is energized to the rear side via the second engagement portion 9 on the basis of the energizing force of the spring portion 10*y* of the rotating member 10, the movable body 6 is moved from the position shown in FIG. 11 to the rear side with respect to the piston 7 without receiving the sliding resistance between the piston 7 and the inner peripheral surface of the filling member 1 as shown in FIG. 12, and the first engagement portion 8 is returned to be engaged at the position at which the leading end surface of the annular groove portion 6*d* of the movable body 6 is brought into contact with the root at the leading end side of the annular protruding portion 7*b* of the piston 7. Further, when the movable thread tube 5 is moved forward while the spring portion 10*y* of the rotating member 10 is compressed, on the basis of the further relative rotation in the feeding out direction between the filling member 1 and the main body tube 3, the movable body 6 is moved forward via the second engagement portion 9 to be in the state shown in FIG. 11, and the engagement of the first engagement portion 8 is cancelled. As mentioned above, the movable body 6 moves forward and backward within a predetermined short range (the annular groove portion 6*d* of the movable body 6) in the axial direction with respect to the piston 7 without receiving the sliding resistance between the piston 7 and the inner peripheral surface of the filling member 1, the engagement cancel and the engagement return of the first engagement portion 8 are repeated, and the first engagement portion 8 is smoothly and well returned to be engaged.

Further, in the state in which the movable thread tube 5 is moved forward for a predetermined amount so as to reach the forward moving limit on the basis of the application of the engaging action of the first engagement portion 8, the relative rotation in the feeding out direction between the filling member 1 and the main body tube 3 is kept, and the engagement cancel and the engagement return of the first engagement portion 8 are repeated (in the state in which the engaging action of the first engagement portion 8 does not substantially work), only the engaging action of the second engagement portion 9 is applied, and only the movable body 6 is moved forward, as shown in FIG. 2, on the basis of the cooperation with the rotation stop portion 50. In this case, at a time when only the movable body 6 is moved forward, the movable body 6 is moved forward while moving forward and backward within the predetermined short range in the axial direction, on the basis of the repeat of the engagement cancel and the engagement return of the first engagement portion 8, as mentioned above.

In this case, since the engagement cancel and the engagement return of the first engagement portion 8 are repeated on the basis of the relative rotation in the feeding out direction between the filling member 1 and the main body tube 3, as mentioned above, in the state in which the movable thread tube 5 reaches the forward moving limit and only the movable body 6 is moved forward, a click feeling is accordingly given, and a degree of the relative rotation in the feeding out direction and a moving degree of the movable body 6 are well sensed by a user.

Further, only the movable body 6 is moved forward on the basis of the relative rotation in the feeding out direction between the filling member 1 and the main body tube 3 accompanying the click feeling, and the filled material M is pushed out by the piston 7 at the leading end so as to appear through the opening 1*a*.

At this time, since the lead of the second engagement portion 9 is made small as 0.5 mm per rotation, the movable body 6 is slowly fed out in accordance with the small lead of the second engagement portion 9, and the filled material M suitably appears from the opening 1*a* of the filling member 1 so as to be set to the use state. In other words, the filled material M does not erroneously come out too much.

In the case of using from the initial state or the like, specifically, in the case that the leading end surface of the filled material M exists near the opening 1*a* at the leading end of the filing member 1 and the movable thread tube 5 does not reach the forward moving limit, the filled material M appears through the opening 1*a* even if the movable thread tube 5 does not reach the forward moving limit.

Further, when the filling member 1 and the main body tube 3 are relatively rotated in the retracting direction after being used, the engagement projections 5*e* of the movable thread tube 5 energized to the rear side enter into the leading end of the female thread 4*d* of the thread tube 4, and the first engagement portion 8 is returned to be engaged. When the relative rotation in the retracting direction between the filling member 1 and the main body tube 3 is further kept, the engaging action of the first engagement portion 8 and the second engagement portion 9 is actuated by the rotation stop portion 60 and the rotation stop portion 50, the movable thread tube 5 is moved backward, and the movable body 6 is moved backward with respect to the movable thread tube 5. In other words, the movable body 6 is moved backward independently at the same time of being moved backward together with the movable thread tube 5.

At this time, since the lead of the first engagement portion 8 is set to make 8 mm backward movement by one relative rotation between the filling member 1 and the main body tube 3 and the lead of the second engagement portion 9 is set to make 0.5 mm backward movement by one relative rotation, the movable threat tube 5 is large and quickly moved backward (8 mm per rotation), and the movable body 6 itself is small and slowly moved backward (0.5 mm per rotation). Accordingly, the movable body 6 is moved backward for an amount obtained by adding the small backward moving amount of the movable body 6 itself to the large backward moving amount of the movable thread tube 5 (8.5 mm per rotation). The movable body 6 is quickly moved backward in accordance with the cooperation of the first engagement portion 8 and the second engagement portion 9.

When the movable thread tube 5 and the movable body 6 are moved backward as mentioned above, since the piston 7 is closely attached to the inner peripheral surface of the filling member 1, the filled material M is closely attached to the inner peripheral surface of the filling member 1, and the piston 7 and the filled material M are closely attached, as mentioned above, thereby a sucking action (an action for maintaining the close attachment) generated by decompression is applied to the portion between the piston 7 and the filled material M in accordance with the backward movement of the piston 7, and the filled material M is pulled back within the filling member 1 so as to be moved backward, and the filled material M is retracted from the opening 1*a* at the leading end of the container, as shown in FIG. 3. Particularly, in the case that the filled material M is constituted, for example, by a soft, jelly-like or mousse-like stick-shaped material, the stick-shaped material tends to be closely attached to the filling member 1 and the piston 7. Accordingly, the sucking action mentioned above better works.

When a moving thread tube 5 is quickly moved backward on the basis of the relative rotation in the retracting direction between a filling member 1 and a main body tube 3, the rear end surface of a spring portion 5*a* of the moving thread tube 5 is brought into contact with the bottom surface of the main body tube 3, and the moving thread tube 5 is moved backward and an engagement projection 5*e* of the moving thread tube 5 is detached from the rear end of a female thread 4*d* of a thread tube 4 while the spring portion 5*a* of the moving thread tube 5 is compressed so as to accumulate energizing force in accordance with the relative rotation in the retracting direction between the filling member 1 and the main body tube 3, whereby the engagement of a first engagement portion 8 is cancelled.

In this engagement cancelled state, the moving thread tube 5 is energized to the front side on the basis of the energizing force of the spring 5*a* of the moving thread tube 5. Accordingly, when the relative rotation in the retracting direction between the filling member 1 and the main body tube 3 is further carried on, the engagement projection 5*e* of the moving thread tube 5 energized to the front side enters into the rear end adjacent in the rotating direction of the female thread 4*d* in the thread tube 4, and the first engagement portion 8 is returned to be engaged. Then, when the relative rotation in the retracting direction between the filling member 1 and the main body tube 3 is further carried on, the moving thread tube 5 is moved backward while the spring portion 5*a* of the moving thread tube 5 is compressed, so that the engagement projection 5*e* of the moving thread tube 5 is detached from the rear end of the female thread 4*d* of the thread tube 4 whereby the engagement is cancelled, and the engagement is returned on the basis of the further relative rotation in the same direction. The engagement cancellation and the engagement return of the first engagement portion 8 mentioned above are repeated.

At this time, a moving body 6 is energized to the front side via a second engagement portion 9 from the position at which the engagement is cancelled shown in FIG. 12, on the basis of the energizing force of the spring portion 5*a* of the moving thread tube 5, and is moved to the front side with respect to a piston 7 without being exposed to the sliding resistance between the piston 7 and the inner peripheral surface of the filling member 1, as shown in FIG. 11, and the first engagement portion 8 is returned to be engaged at the position where a collar portion 6*a* of the moving body 6 is brought into contact with a rear end surface 7*f* of a cylinder portion 7*d* of the piston 7. Then, when the moving thread tube 5 is moved backward while the spring portion 5*a* of the moving thread tube 5 is compressed, on the basis of the further relative rotation in the retracting direction between the filling member 1 and the main body tube 3, the moving body 6 is moved backward via the second engagement portion 9 so as to become in a state shown in FIG. 12, and the engagement of the first engagement portion 8 is cancelled. As mentioned above, in the same manner as the case at the forward moving time, the moving body 6 moves and backs within a predetermined short range (an annular groove portion 6*d* of the moving body 6) in the axial direction with respect to the piston 7 without being exposed to the sliding resistance between the piston 7 and the inner peripheral surface of the filling member 1, the engagement cancellation and the engagement return of the first engagement portion 8 are repeated, and the first engagement portion 8 is smoothly and well returned to be engaged.

Further, in the state in which the engaging action of the first engagement portion 8 operates as mentioned above, the moving thread tube 5 is moved backward for the predetermined amount so as to reach the backward moving limit, the relative rotation in the retracting direction between the filling member 1 and the main body tube 3 is carried on, and the engagement cancellation and the engagement return of the first engagement portion 8 are repeated (in the state in which the engaging action of the first engagement portion 8 is not substantially activated), only the engaging action of the second engagement portion 9 operates, and only the moving body 6 is moved backward as shown in FIG. 3 on the basis of the cooperation with a rotation stop portion 50. At a time when only the moving body 6 is moved backward, the moving body 6 repeatedly moves and backs within the predetermined short range in the axial direction on the basis of the repeat of the engagement cancellation and the engagement return of the first engagement portion 8 as mentioned above.

In the state in which the moving thread tube 5 reaches the backward moving limit and only the moving body 6 is moved backward, the engagement cancellation and the engagement return of the first engagement portion 8 are repeated on the basis of the relative rotation in the retracting direction between the filling member 1 and the main body tube 3, as mentioned above. Accordingly, a click feeling is generated, and a degree of the relative rotation in the retracting direction, and a movement of the moving body 6 are preferably sensed by a user.

Further, when only the moving body 6 is moved backward on the basis of the relative rotation accompanying the click feeling in the retracting direction between the filling member 1 and the main body tube 3, since a lead of the second engagement portion 9 is set to a small lead in which the second engagement portion 9 is moved backward for 0.5 mm with respect to one rotation, the moving body 6 is slowly retracted in accordance with the small lead of the second engagement portion 9, and a filled material M is slowly drawn back together with the moving body 6. Accordingly, it is possible to prevent the filled material M from being retracted excessively, and it is possible to thereafter retract the filled material M by a fine adjustment.

In the case that the filled material M is set to the use state from this state, the same operation as mentioned above is executed, and the operation mentioned above is repeated.

Further, as shown in FIG. 4, when the piston 7 is moved forward to the maximum on the basis of the relative rotation in the feeding out direction between the filling member 1 and the main body tube 3, the filled material M is almost used up.

As mentioned above, in accordance with the filled material extruding container 100 of the present embodiment, since the moving body 6 is moved forward (moved backward) in the fixed section on the basis of the engaging actions of the first engagement portion 8 and the second engagement portion 9, and the moving body is moved forward (moved backward) beyond the fixed section on the basis of the engaging action generated only by the second engagement portion 9, it is possible to securely carry out the set two-stage feeding-out and retracting operations of the moving body 6 at changed speed.

Particularly, in the present embodiment, since the moving body 6 is quickly moved forward in the fixed section on the basis of the cooperation of the first and second engagement portions 8 and 9, and is thereafter slowly moved forward on the basis of the engaging action generated only by the second engagement portion 9, it is possible to prevent the filled material M from being erroneously fed out excessively.

Further, in the present embodiment, since there is provided with a spring portion 10*y* of a rotating member 10 and the spring portion 5*a* of the moving thread tube 5 which correspond to the energizing means for energizing in such a manner as to make the first engagement portion 8 be returned to be engaged when the moving body 6 is moved forward and backward in the fixed section and the engagement of the first engagement portion 8 is cancelled, the first engagement portion 8 is returned to be engaged on the basis of the energizing force of the energizing means when the engagement of the first engagement portion 8 is cancelled. Accordingly, in the case that the filling member 1 and the main body tube 3 are further relatively rotated and the moving body 6 is moved forward and backward in such direction that the first engagement portion 8 is returned to be engaged, the engaging action of the first engagement portion 8 is activated without any trouble, and the moving body 6 is moved forward and backward. Further, in the case that the engagement of the first engagement portion 8 is cancelled, the filling member 1 and the main body tube 3 are further relatively rotated, and the moving body 6 is moved forward and backward in such direction that the engagement of the first engagement portion 8 is cancelled, the engagement cancellation of the first engagement portion 8 and the engagement return by the energizing means are repeated, whereby the click feeding is generated, and the degree of the relative rotation and the movement of the moving body 6 are sensed by the user.

Further, in this embodiment, the following effect can be also achieved. Since the structure is made such that the piston 7 is closely attached within the filling member 1, the filled material M is closely attached within the filling member 1, and the filled material M and the piston 7 are closely attached within the filling member 1, the filled material M is extruded in accordance with the forward movement of the piston 7 so as to appear from the opening 1*a* at the leading end of the container and, on the other hand, the sucking action generated by decompression is applied between the piston 7 and the filled material M in accordance with the backward movement of the piston 7, the filled material M is pulled back within the filling member 1, whereby it is possible to feed out and refract the filled material M without trouble.

Further, in the case that the impact, the vibration or the like is applied and the external action is added, a decompressed state is generated and a closely attaching action is applied between the piston 7 and the filled material M, if they are going to separate from each other. Accordingly, the filled material M does not separate from the piston 7, and it is possible to prevent the filled material M from falling off from the container 100.

Further, since the filled material M is closely attached within the filling member 1 (particularly, the soft filled material is closely attached within the filling member 1), as mentioned above, the broken portion does not fall away from the filling member 1 even if the filled material M is broken within the filling member 1, so that it is possible to continuously use the filled material M. Further, the closely attachment of the filled material M to the inner wall of the filling member 1 prevents the filled material M from being fallen off from the container 100.

Further, in accordance with the filled material extruding container 100 of the present embodiment, it is possible to use the particularly soft stick-shaped material such as the jelly-like or mousse-like stick-shaped material which can not be ordinarily maintained as the normal stick-shaped material.

In this case, if the inner peripheral surface of the filling member 1 is formed in such a shape (taper shape) as to be made narrower toward the leading end side gradually, it is possible to particularly hold a soft stick-like material, and it is possible to further prevent the stick-like material from falling out in the case that an external action such as an impact, a vibration or the like is applied at a time of storing so as to safely hold it, so that this structure is preferable. Further, if an opening 1*a* of the filling member 1 is made narrower than a tube hole (tube hole in the filling member 1) at the rear side thereof, the same operation and effect can be achieved. Further, in the structure in which the opening 1*a* is narrowed, since the filled material M which is once solidified is extruded by the piston 7 while being squeezed trough the narrow opening 1*a*, its composition is collapsed and becomes soft, and a proper use feeling is obtained. Further, it is possible to hold the filled material M blended with a volatile component by making a fitting portion of a cap to be airtight.

Further, according to the present embodiment, since the engagement portion of the filled material extruding container 100 is constructed as the double spiral structure constituted by the first and second engagement portions 8 and 9, it is possible to secure the length of the filled material while saving the length in the axial direction of the container 100.

In the present embodiment, when the lead of the first engagement portion 8 is set such as to be moved forward (moved backward) for 8 mm with respect to one rotation of the relative rotation between the filling member 1 and the main body tube 3, and the lead of the second engagement portion 9 is set such as to be moved forward (moved backward) for 0.5 mm with respect to one rotation, the moving body 6 is moved forward (moved backward) for 8.5 mm in the fixed section with respect to one rotation, and the moving body 6 is moved forward (moved backward) for 0.5 mm beyond the fixed section with respect to one rotation. In other words, as mentioned above, the moving body 6 can be quickly moved forward (moved backward) in the fixed section, and can be slowly moved forward (moved backward) beyond the fixed section. However, the structure may be made as follows.

For example, reversely moving screws may be set such that the lead of the first engagement portion 8 is moved backward (moved forward) for 1 mm with respect to one rotation, and the lead of the second engagement portion 9 is moved forward (moved backward) for 2 mm with respect to one rotation. Accordingly, the moving body 6 is moved forward (moved backward) for 1 mm in the fixed section with respect to one rotation, and the moving body 6 is moved forward (moved backward) for 2 mm beyond the fixed section with respect to one rotation. In other words, it is possible to obtain a motion that the moving body is slowly moved forward (moved backward) in the fixed section, and is quickly moved forward (moved backward) beyond the fixed section. In accordance with the structure mentioned above, in the case of checking the filled material M by feeding out the filled material M much, it is possible to feed out the filled material M at a stroke by quickly moving forward the filled material M beyond the fixed section, and it is possible to use the filled material M while finely retracting it by slowly moving backward the filled material M in the fixed section at a time of using. Further, after using, it is possible to retract it at a stroke after the filled material M is retracted finely.

Further, for example, reversely moving screws may beset such that the lead of the first engagement portion 8 is moved forward (moved backward) for 3 mm with respect to one rotation, and the lead of the second engagement portion 9 is moved backward (moved forward) for 2 mm with respect to one rotation. Accordingly, the moving body 6 is moved forward (moved backward) for 1 mm in the fixed section with respect to one rotation, and the moving body 6 is moved backward (moved forward) for 2 mm beyond the fixed section with respect to one rotation. In other words, it is possible to obtain a motion that the moving body is slowly moved forward (moved backward) in the fixed section, and is quickly moved backward (moved forward) beyond the fixed section. Further, for example, reversely moving screws may be set such that the lead of the first engagement portion 8 is moved forward (moved backward) for 4 mm with respect to one rotation, and the lead of the second engagement portion 9 is moved backward (moved forward) for 1 mm with respect to one rotation. Accordingly, the moving body 6 is moved forward (moved backward) for 3 mm in the fixed section with respect to one rotation, and the moving body 6 is moved backward (moved forward) for 1 mm beyond the fixed section with respect to one rotation. In other words, it is possible to obtain a motion that the moving body is quickly moved forward (moved backward) in the fixed section, and is slowly moved backward (moved forward) beyond the fixed section. Further, for example, the reversely moving screws may be set such that the lead of the first engagement portion 8 is moved forward (moved backward) for 2 mm with respect to one rotation, and the lead of the second engagement portion 9 is moved backward (moved forward) for 1 mm with respect to one rotation. Accordingly, the moving body 6 is moved forward (moved backward) for 1 mm in the fixed section with respect to one rotation, and the moving body 6 is moved backward (moved forward) for 1 mm beyond the fixed section with respect to one rotation. In other words, it is possible to obtain a motion that the moving body is moved forward (moved backward) in the fixed section, and is moved backward (moved forward) beyond the fixed section at the same speed as that of the fixed section. As mentioned above, it is possible to obtain a particular structure in which the moving direction of the moving body 6 is reversed on the basis of the relative rotation in the same direction between the filling member 1 and the main body tube 3.

In summary, in accordance with the present embodiment, it is possible to provide the filled material extruding container which can carry out the various combined operations of feeding-out and retracting in addition to securely carrying out the set two-stage feeding-out and retracting operation of the moving body 6 at changed speed.

Figure 26:
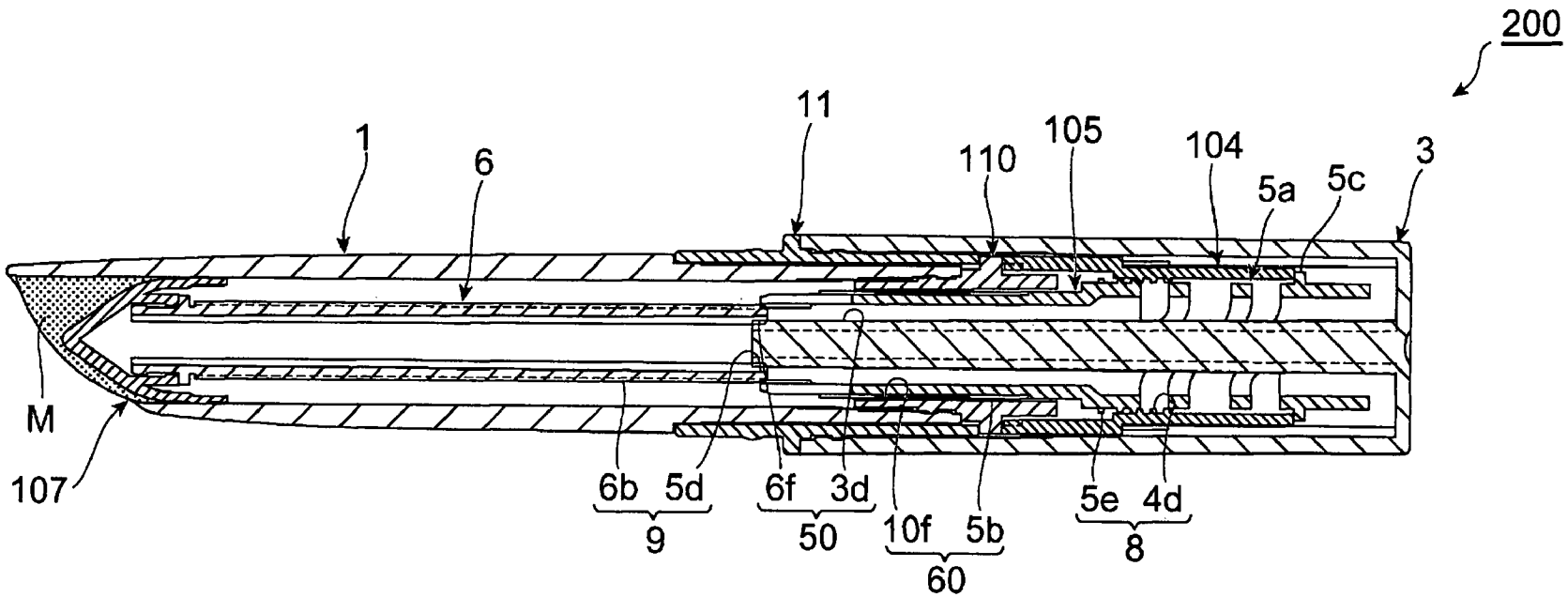
FIG. 26 is a vertical sectional view at a time when the moving body is moved forward to the maximum on the basis of an operation of the user from the state shown in FIG. 24.
Figure 27:
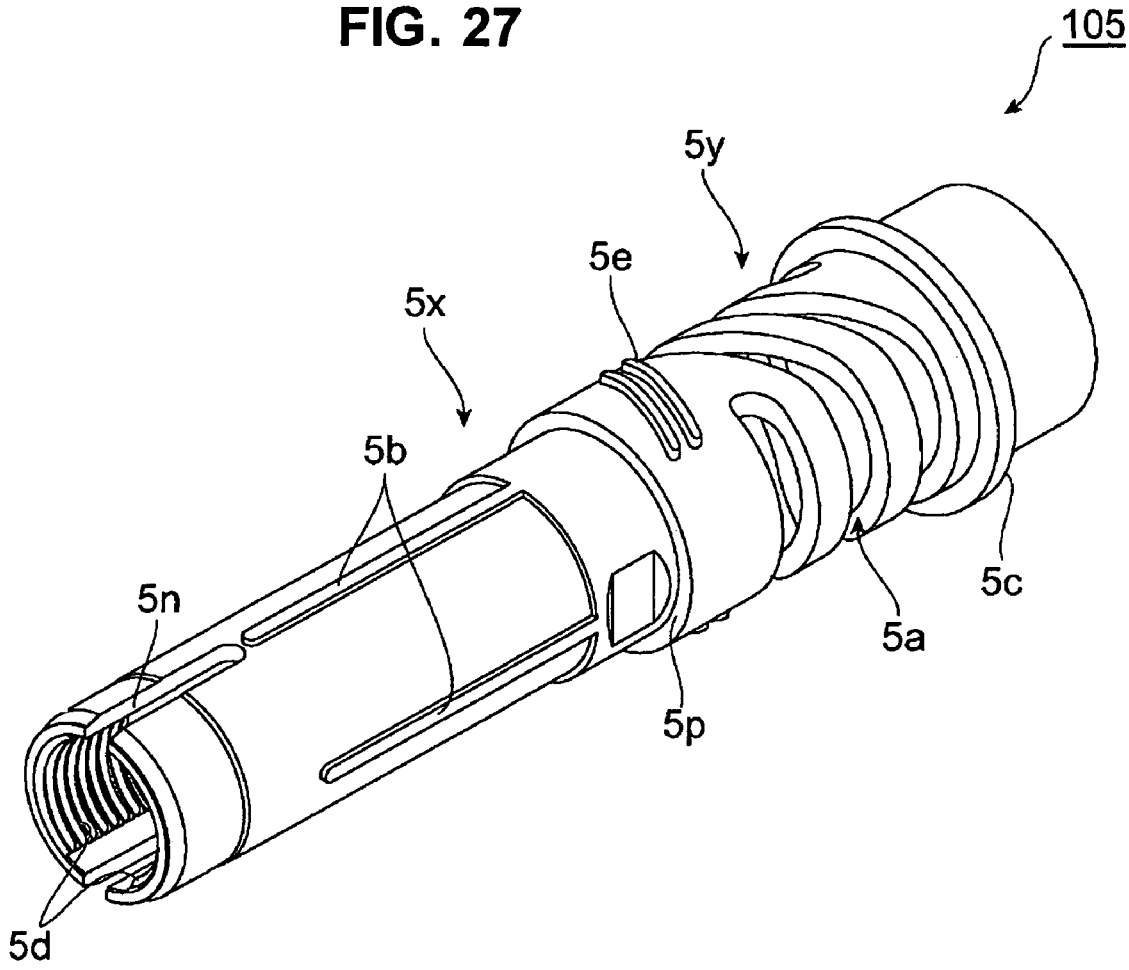
FIG. 27 is a perspective view showing the moving thread tube in FIGS. 23 to 26.
Figure 28:
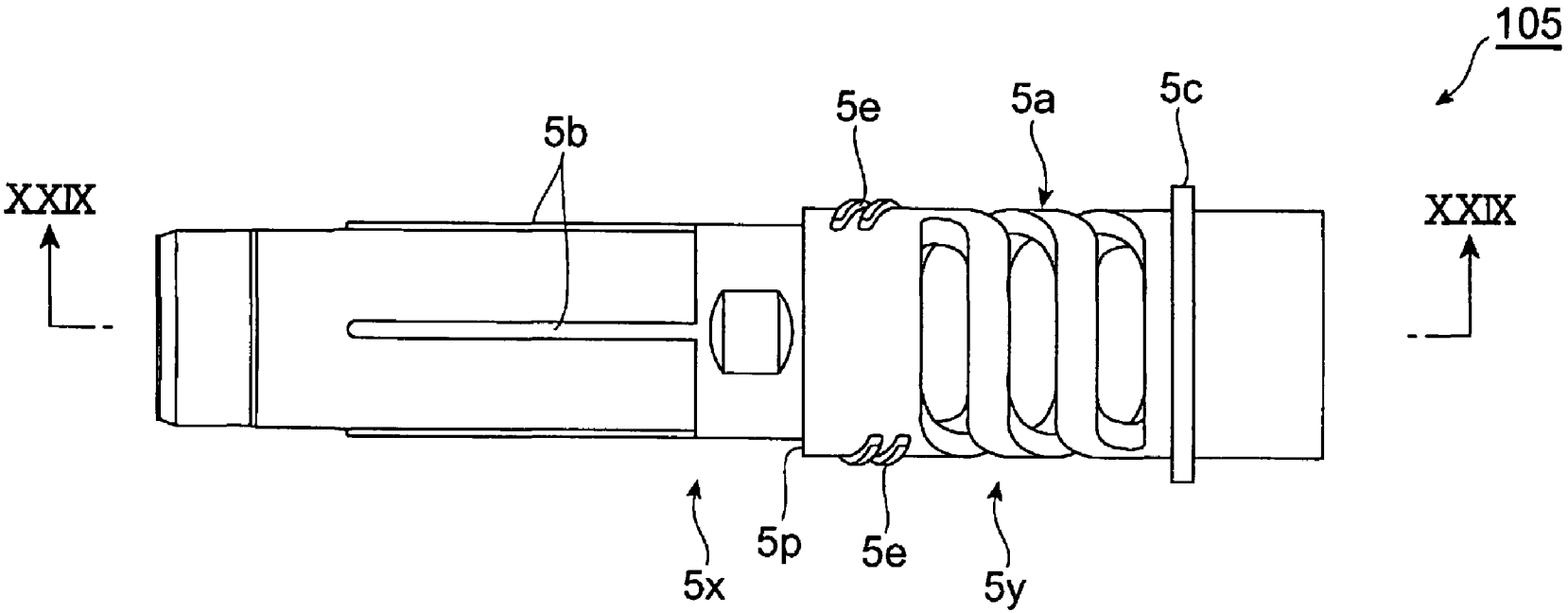
FIG. 28 is a side view of the moving thread tube shown in FIG. 27.
Figure 29:
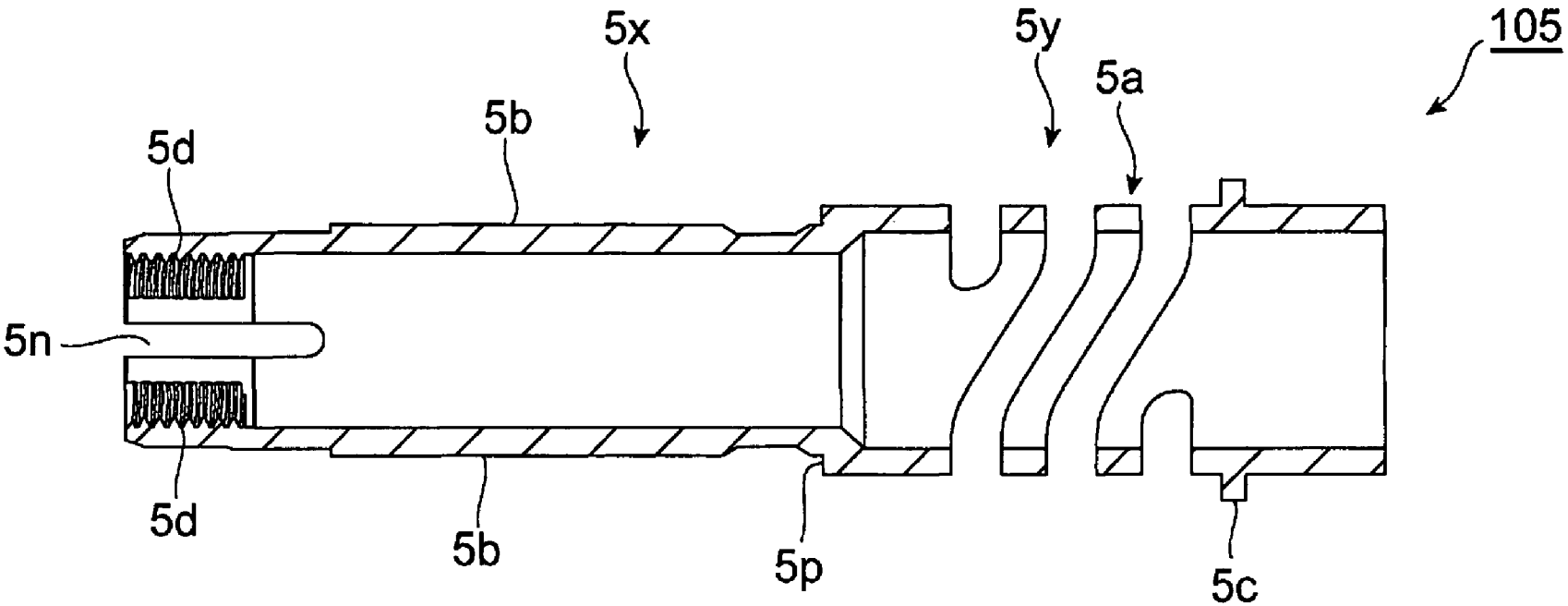
FIG. 29 is a view as seen in the direction of an arrow XXIX-XXIX in FIG. 28.

FIGS. 23 to 26 are respective longitudinal sectional views showing respective states of a filled material extruding container in accordance with a second embodiment of the present invention, and FIGS. 27 to 29 are respective views showing a movable thread tube.

A filled material extruding container 200 in accordance with the second embodiment is different from the filled material extruding container 100 in accordance with the first embodiment in a point that a movable thread tube 105 shown in FIGS. 27 to 29 is used in place of the movable thread tube 5 shown in FIGS. 13 to 15. Further, a rotating member 110 in which the shape of the rotating member 10 is somewhat modified is employed in place of the rotating member 10, a thread tube 104 in which the shape of the thread tube 4 is somewhat modified is employed in place of the thread tube 4, and a piston 107 in which the shape of the piston 7 is somewhat modified is employed in place of the piston 7, as shown in FIG. 23.

As shown in FIGS. 27 to 29, a moving thread tube 105 is different from the moving thread tube 5 shown in FIGS. 13 to 15 in a point that the rear end of an outer diameter large-diameter portion 5*y* is extended to the rear side, and a collar portion 5*c* is provided in the middle. The collar portion 5*c* is brought into contact with the rear end surface of a thread tube 104 at a time when the moving thread tube 105 is moved forward and serves as a locking portion at the forward moving limit of the collar portion 5*c* of the moving thread tube 105. The other structures are set to the same.

Figure 23:
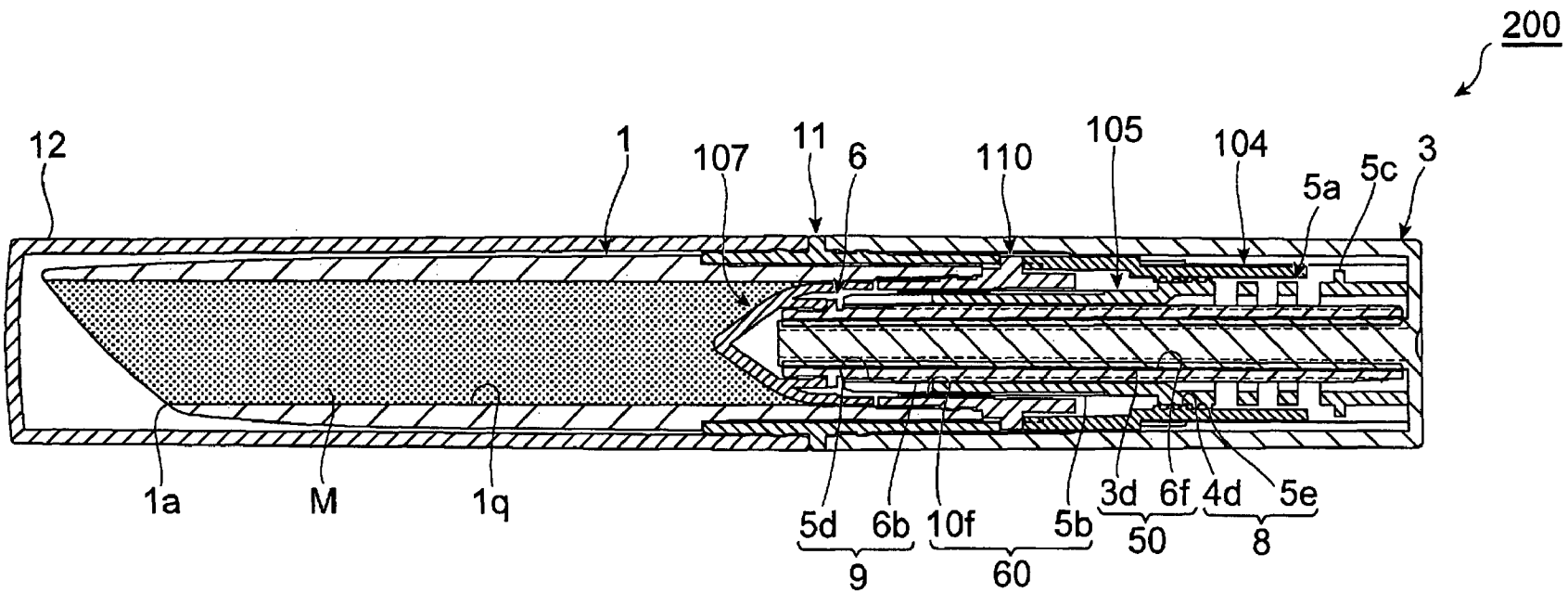
FIG. 23 is a vertical sectional view showing an initial state of a filled material extruding container in accordance with a second embodiment of the present invention.

As shown in FIG. 23, the rotating member 110 is formed in a shape in which the spring portion 11*y* of the rotating member 10 shown in FIGS. 16 and 17 is omitted, and the other structures are set to the same.

The thread tube 104 is formed in a shape in which the rear end of the thread tube 4 shown in FIGS. 18 and 19 is extended to the rear side, and the other structures are set to the same.

A piston 107 is formed in a bell shape in which the leading end portion of the piston 7 shown in FIG. 10 is curved in an umbrella shape so as to be protruded, and the other structures are set to the same.

Further, the moving thread tube 105 in a filled material extruding container 200 in an initial state shown in FIG. 23 is structured such that the rear end surface thereof is brought into contact with the bottom surface of the main body tube 3, the spring portion 5*a* thereof is compressed, the engagement projection 5*e* is energized to the front side, and the leading end of the engagement projection 5*e* is engaged with the rear end of the female thread 4*d* of the thread tube 4, whereby the first engagement portion 8 is structured.

In the filled material extruding container 200 in the initial state shown in FIG. 23 structured as mentioned above, when the filling member 1 and the main body tube 3 are relatively rotated in the feeding-out direction, the engaging actions of the first engagement portion 8 and the second engagement portion 9 are activated, the moving thread tube 105 is quickly moved forward, and the moving body 6 is slowly moved forward with respect to the moving thread tube 105. Accordingly, the moving body 6 is quickly moved forward on the basis of the cooperation of the first and second engagement portions 8 and 9.

Figure 24:
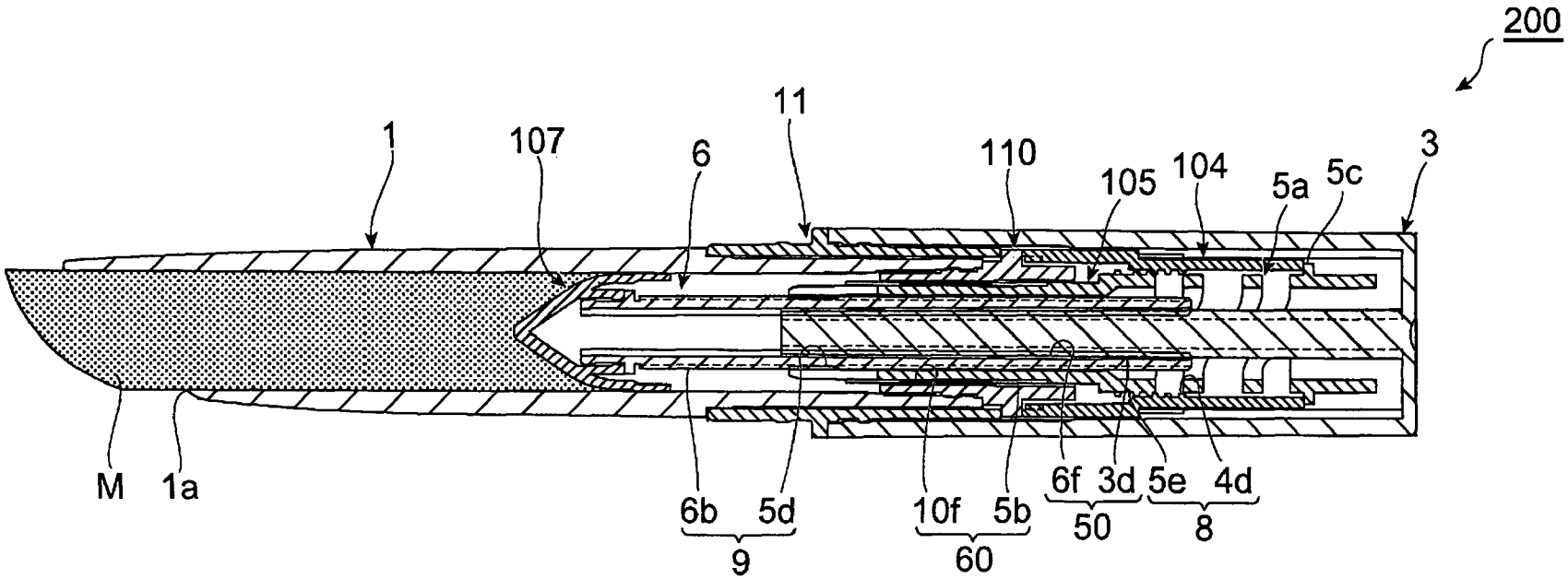
FIG. 24 is a vertical sectional view at a time when a cap is detached from a state shown in FIG. 23, and a moving thread tube and a moving body are moved forward on the basis of an operation of a user.
Figure 25:
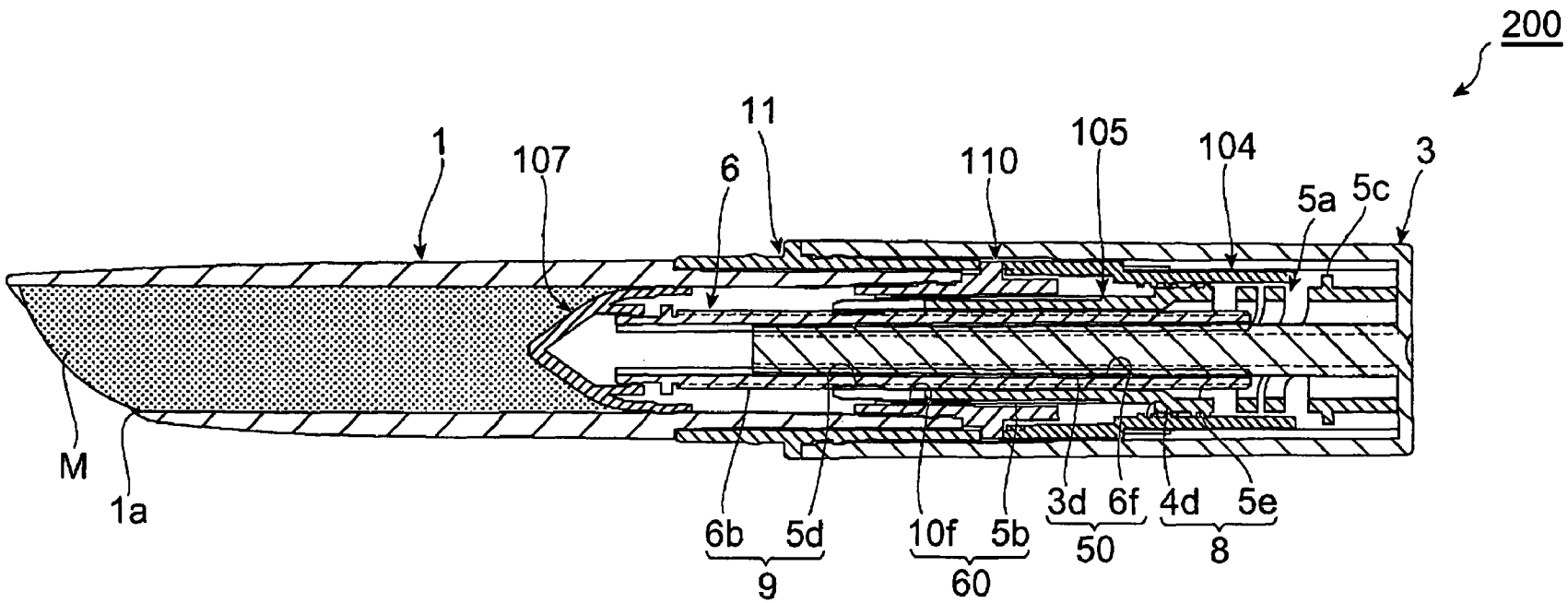
FIG. 25 is a vertical sectional view at a time when a filled material is used by the user in a state shown in FIG. 24, and the moving thread tube and the moving body are thereafter moved backward on the basis of an operation of the user and the moving thread tube is moved backward to a backward moving limit.

Further, the movable thread tube 105 is moved forward for a predetermined amount, and the collar portion 5*c* is brought into contact with the rear end surface of the thread tube 104, as shown in FIG. 24. When relative rotation in the feeding-out direction is further made, the moving thread tube 105 is moved forward while the spring portion 5*a* of the movable thread tube 105 is extended so as to accumulate energizing force, the engagement protrusions 5*e* of the movable thread tube 105 are detached from the leading end of the female thread 4*d* of the thread tube 104, engagement of the first engagement portion 8 is cancelled. According to further relative rotation in the feeding-out direction, the first engagement portion 8 is returned to be engaged by the energizing force of the spring portion 5*a* of the movable thread tube 105, and the engagement cancel and the engagement return are repeated. In this state, the movable body 6 moves forward and backward within a predetermined short range in the axial direction with respect to the piston 107 without receiving sliding resistance between the piston 107 and the inner peripheral surface of the filling member 1. Further, when they are relatively rotated further in the same direction, only the engaging action of the second engagement portion 9 works in the state in which the engagement cancel and the engagement return of the first engagement portion 8 are repeated, only the movable body 6 is slowly moved forward accompanying a click feeling, and the filled material M is extruded by the piston 107 at the leading end so as to slowly appear through the opening 1*a* and be set in a use state.

Further, when the filling member 1 and the main body tube 3 are relatively rotated in the refracting direction after being used, the first engagement portion 8 is returned to be engaged by the spring portion 5*a* of the movable thread tube 105, the engaging actions of the first engagement portion 8 and the second engagement portion 9 are operated on the basis of the further relative rotation in the same direction, the movable thread tube 105 is quickly moved backward, and the movable body 6 is slowly moved backward with respect to the movable thread tube 105. Accordingly, the movable body 6 is quickly moved backward on the basis of the cooperation of the first engagement portion 8 and the second engagement portion 9, and the filled material M is pulled back within the filling member 1 to be quickly moved backward on the basis of by sucking action generated by decompression in accordance with the backward movement of the piston 107 (refer to FIG. 25).

Further, when the movable thread tube 105 is moved backward on the basis of the further relative rotation in the same direction, the rear end surface of the movable thread tube 105 is brought into contact with the bottom surface of the main body tube 3 in the same manner as the initial state, and when they are relatively rotated further in the same direction, the movable thread tube 105 is moved backward, the engagement projections 5*e* of the movable thread tube 105 are detached from the leading end of the female thread 4*d* of the thread tube 4 and the engagement of the first engagement portion 8 is cancelled, while the spring portion 5*a* of the movable thread tube 105 is compressed so as to accumulate energizing force.

When the relative rotation in the refracting direction is further kept, the first engagement portion 8 is returned to be engaged by the energizing force of the engagement projections 5*e* of the movable thread tube 105, and such the engagement cancel and the engagement return are repeated.

In this state, the movable body 6 moves forward and backward within a predetermined short range in the axial direction with respect to the piston 107 without receiving sliding resistance between the piston 107 and the inner peripheral surface of the filling member 1. Further, when the relative rotation in the same direction is further kept, only the engaging action of the second engagement portion 9 works in the state in which the engagement cancel and the engagement return of the first engagement portion 8 are repeated, so that only the movable body 6 is slowly moved backward accompanying a click feeling.

Further, when the piston 107 is moved forward to the maximum on the basis of the relative rotation in the feeding out direction between the filling member 1 and the main body tube 3, as shown in FIG. 26, the filled material M is almost used up.

The assembling procedure of the filled material extruding container 200 mentioned above is the same as the first embodiment.

In accordance with the filled material extruding container 200 as mentioned above, needless to say, almost the same effects as the first embodiment can be obtained.

Figure 34:
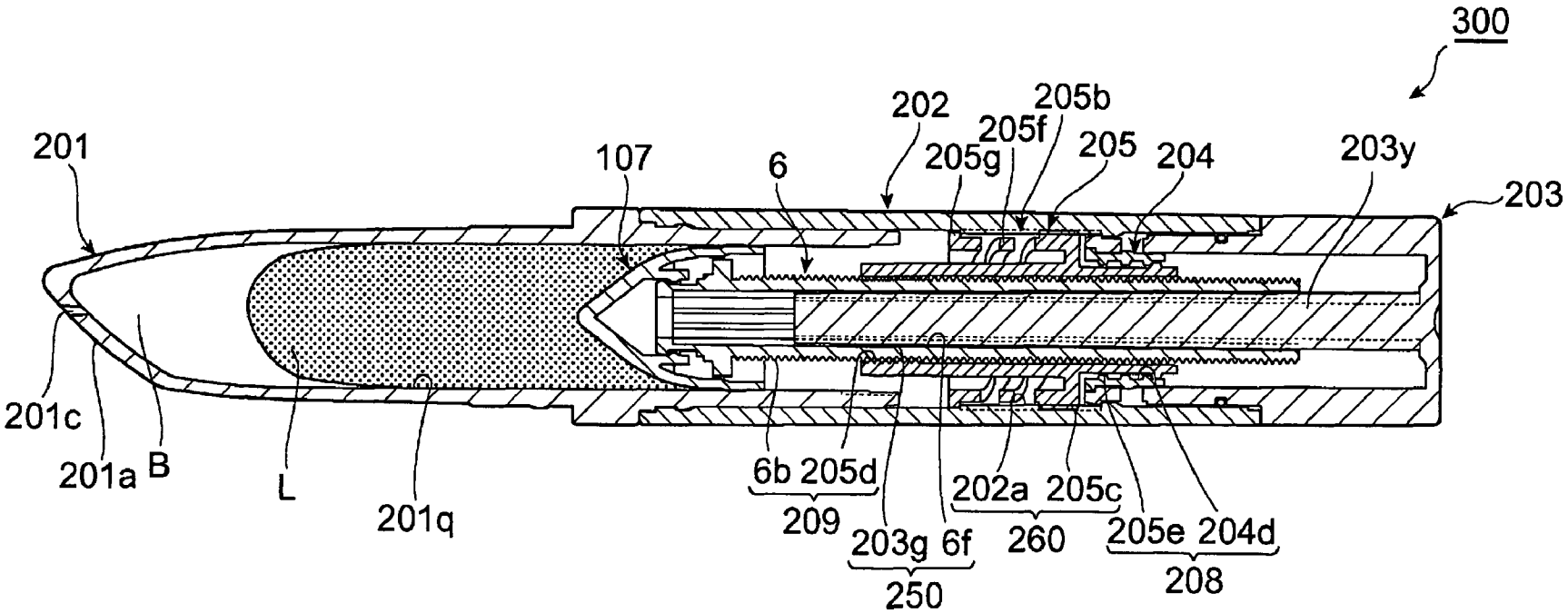
FIG. 34 is a vertical sectional view at a time when the moving body is moved backward from a state shown in FIG. 33 on the basis of an operation of the user.
Figure 35:
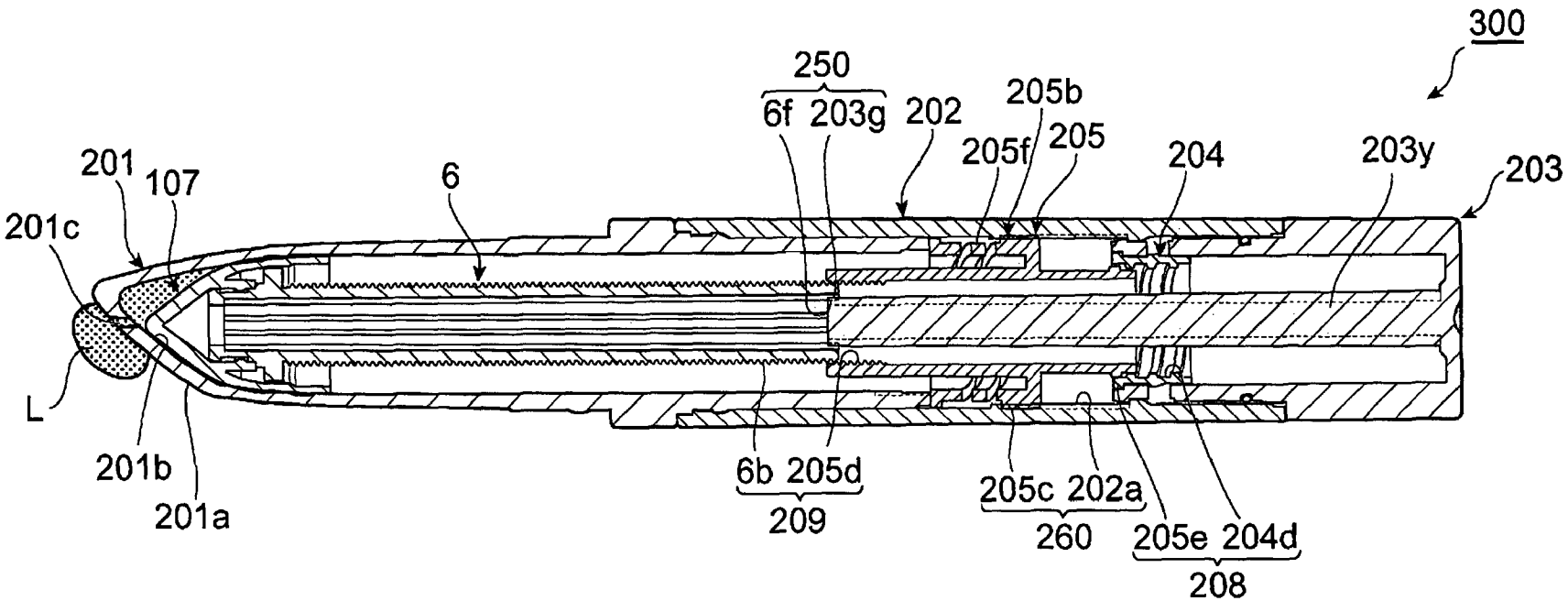
FIG. 35 is a vertical sectional view at a time when the moving body is moved backward to the maximum on the basis of an operation of the user from the state shown in FIG. 32.
Figure 36:
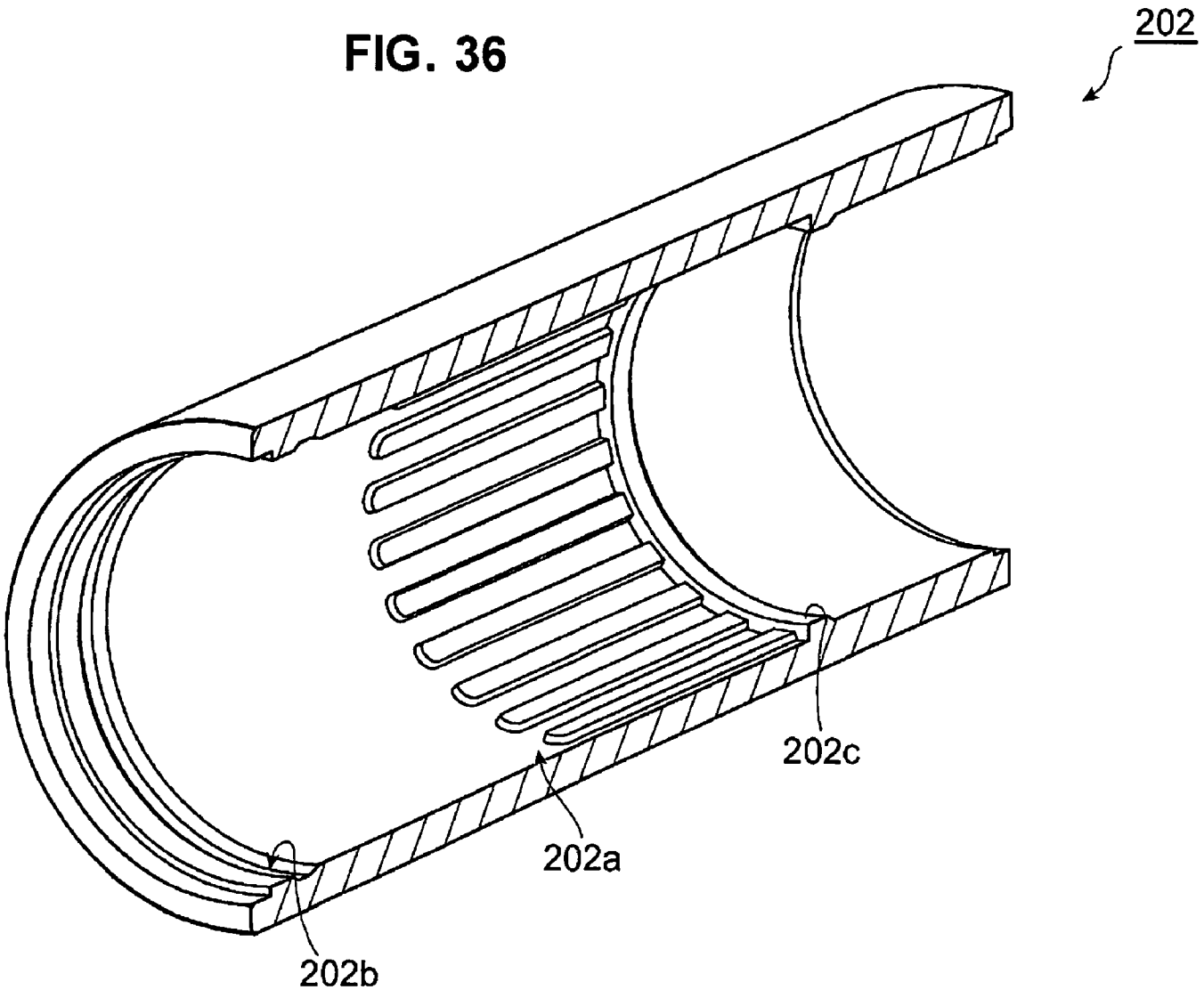
FIG. 36 is a vertical sectional perspective view showing a main body tube in FIGS. 30 to 35.
Figure 37:
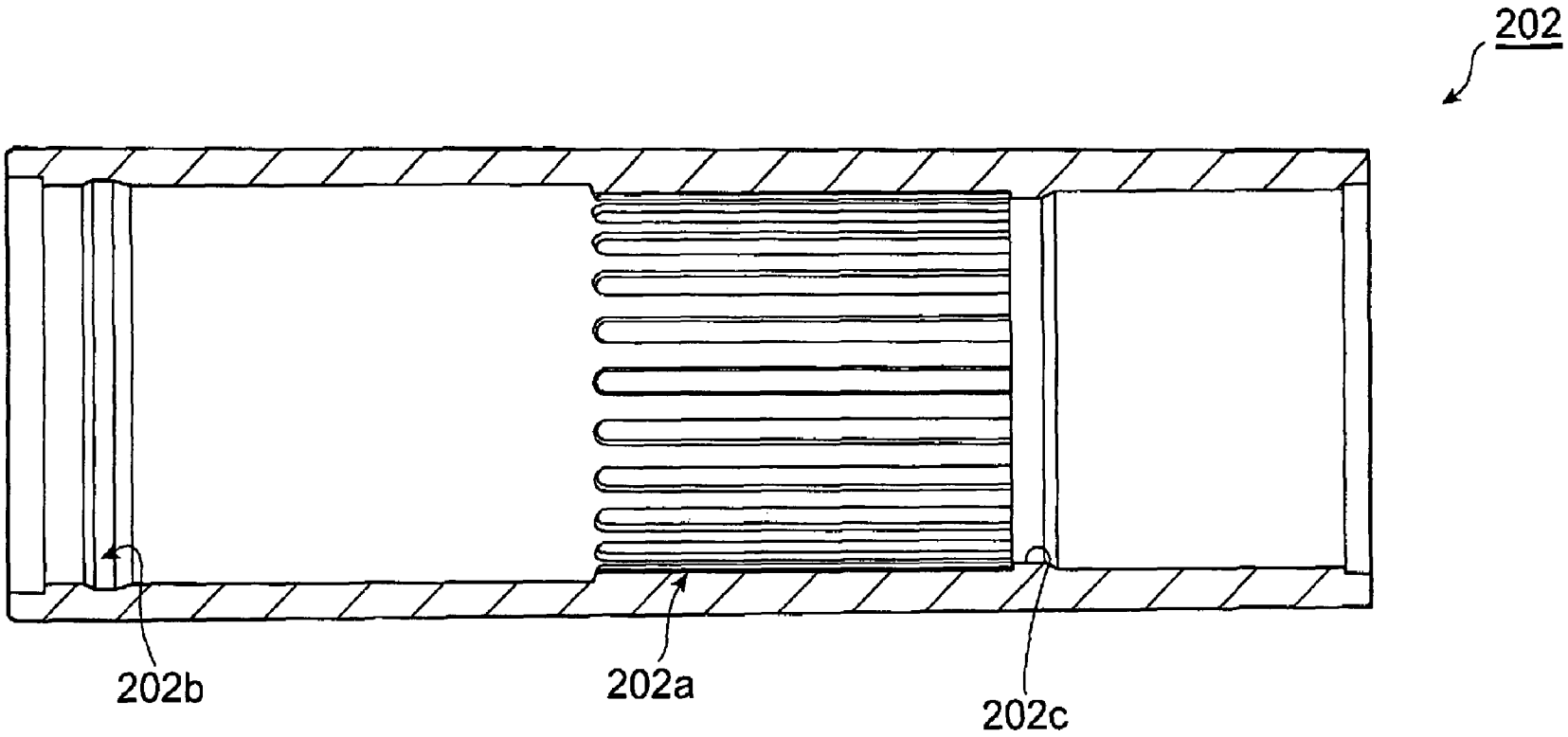
FIG. 37 is a vertical sectional view showing the main body tube in FIGS. 30 to 35.
Figure 38:
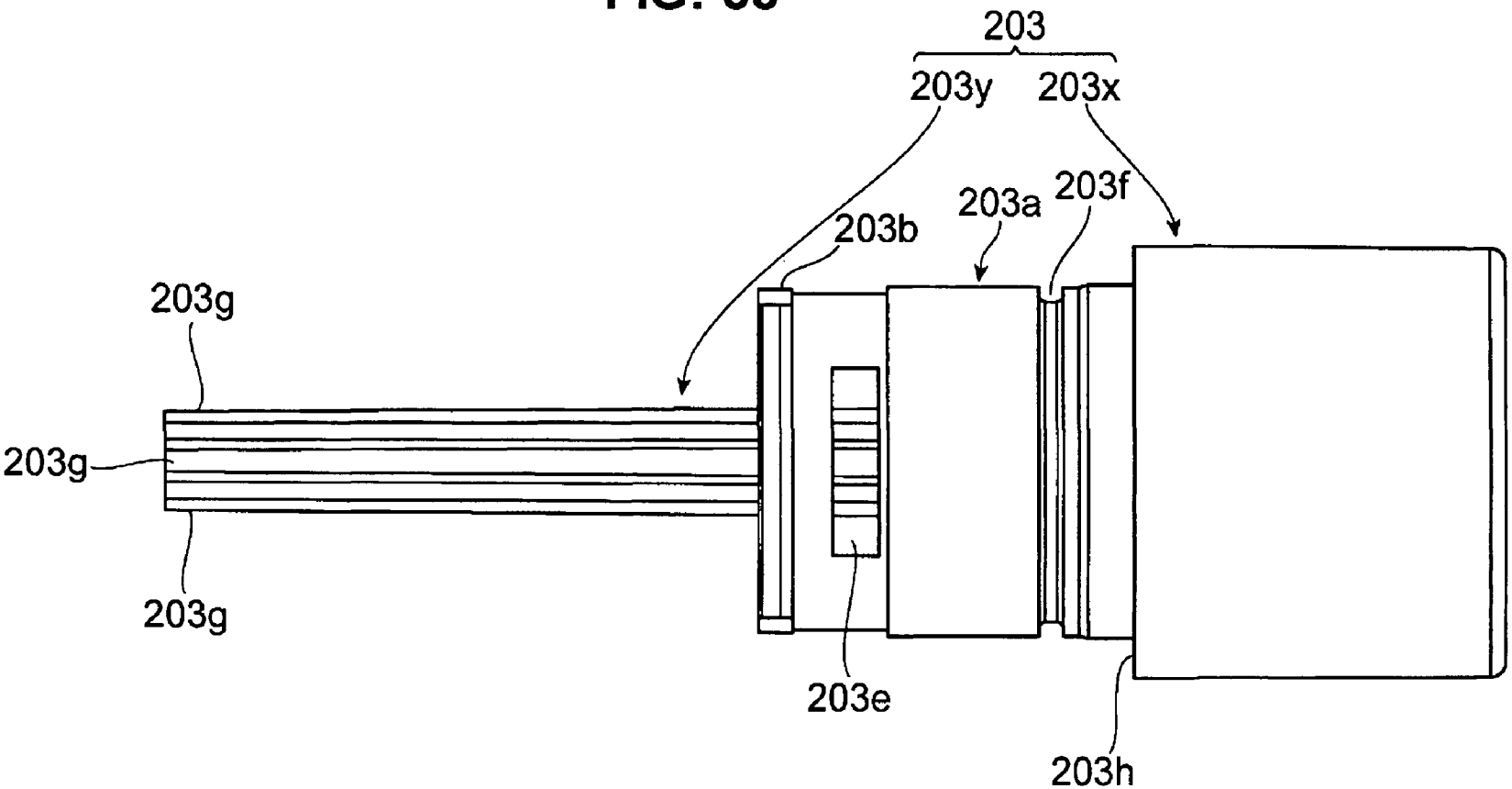
FIG. 38 is a side view showing an operation tube in FIGS. 30 to 35.
Figure 39:
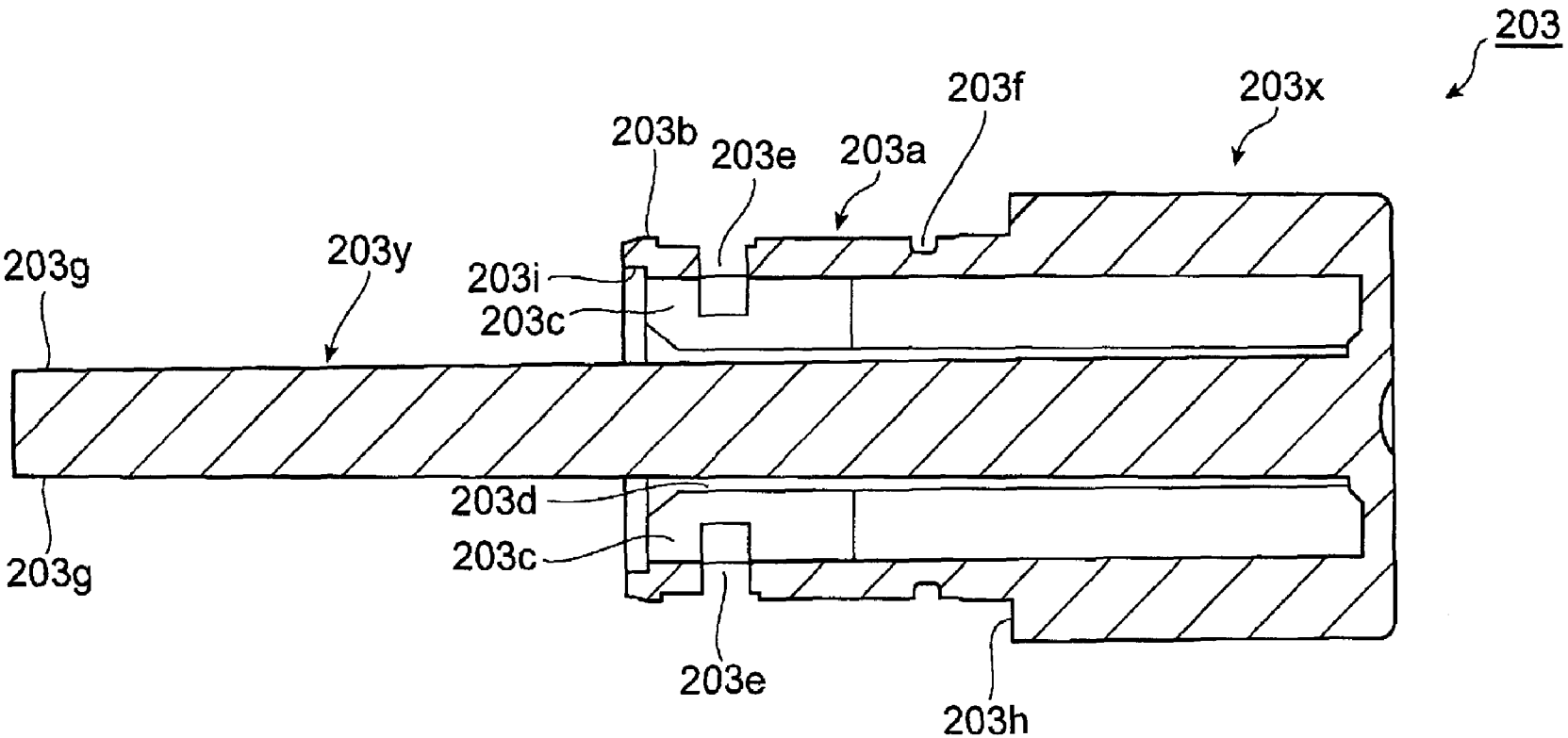
FIG. 39 is a vertical sectional view of the operation tube shown in FIG. 38.
Figure 40:
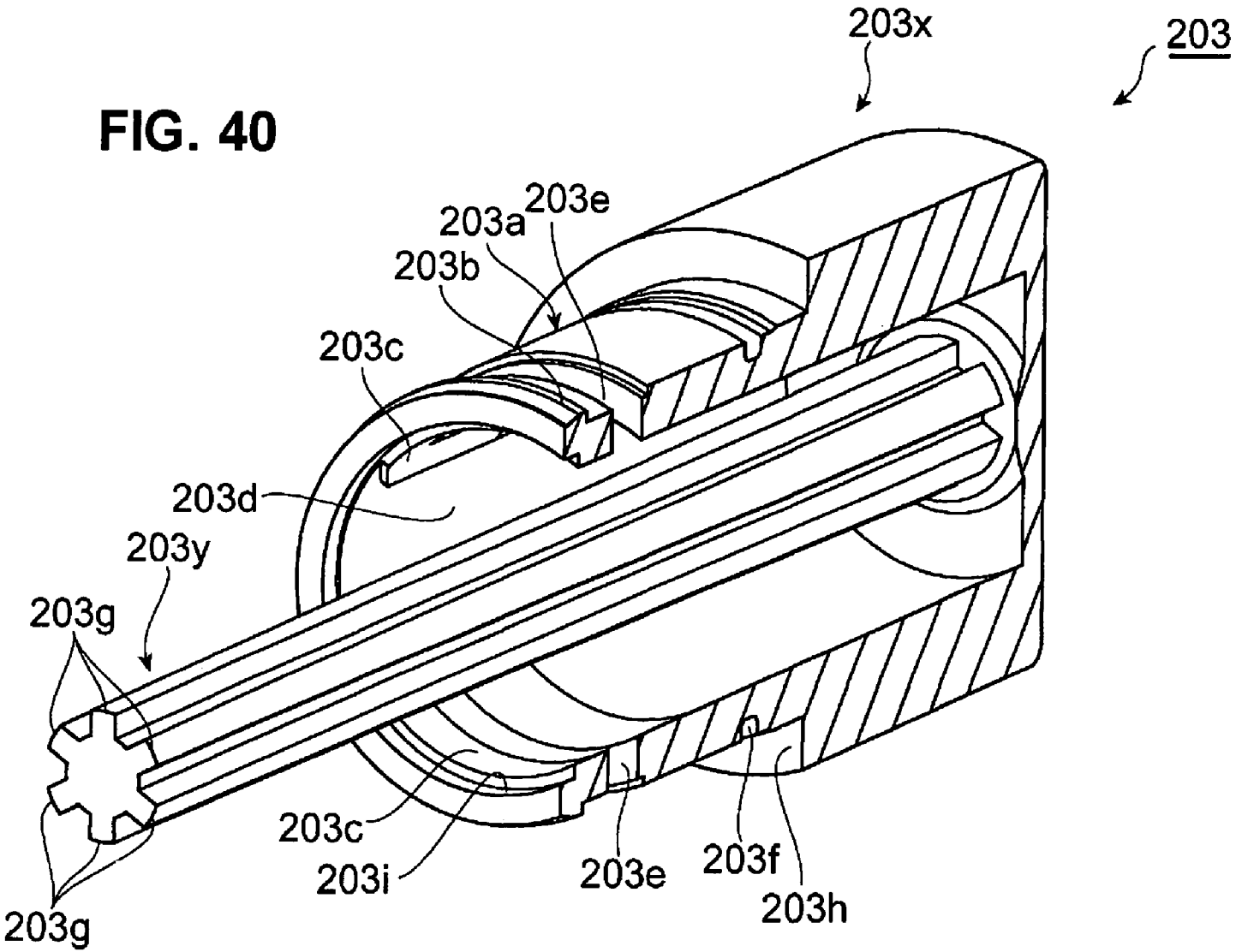
FIG. 40 is a sectional perspective view of the operation tube shown in FIG. 38.
Figure 41:
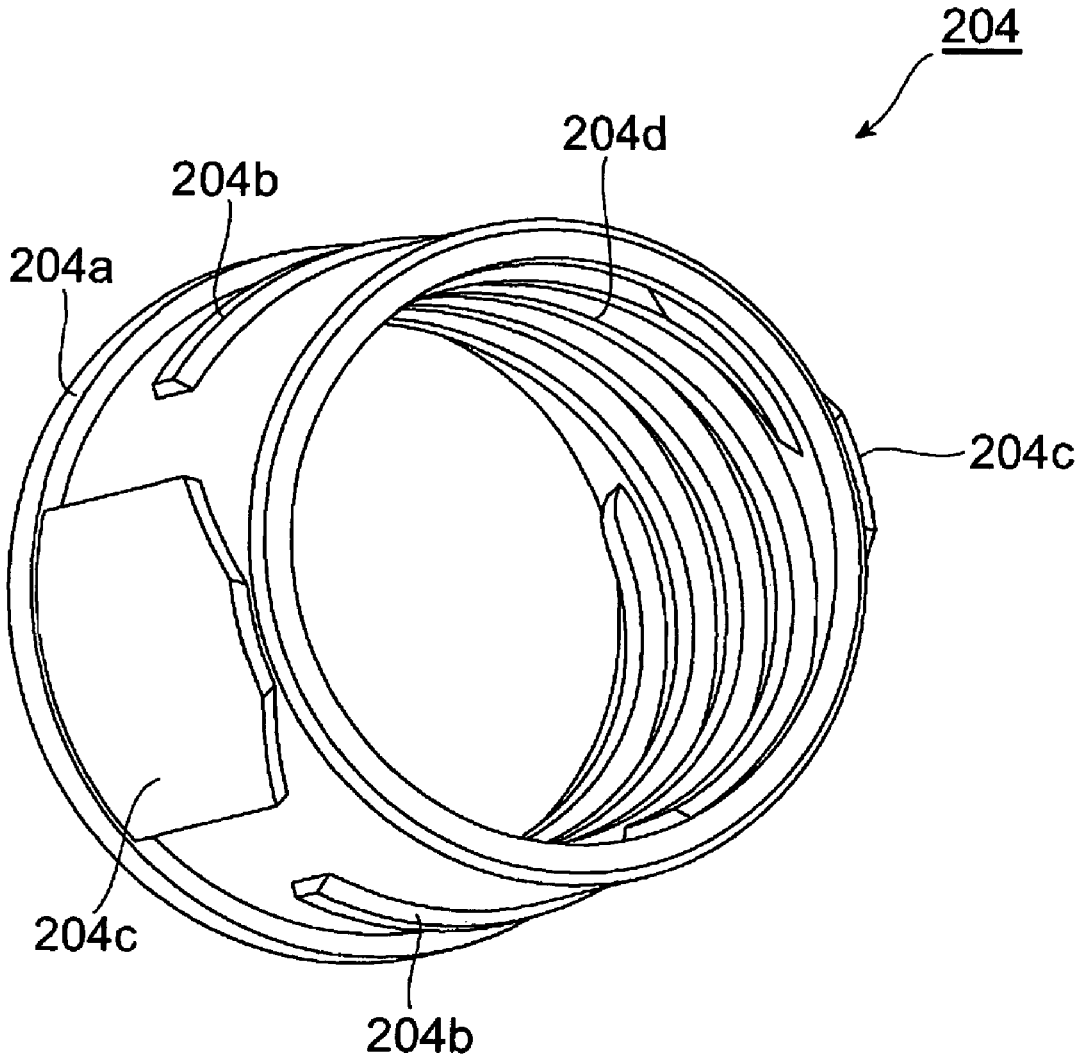
FIG. 41 is a perspective view sowing a thread tube in FIGS. 30 to 35.
Figure 42:
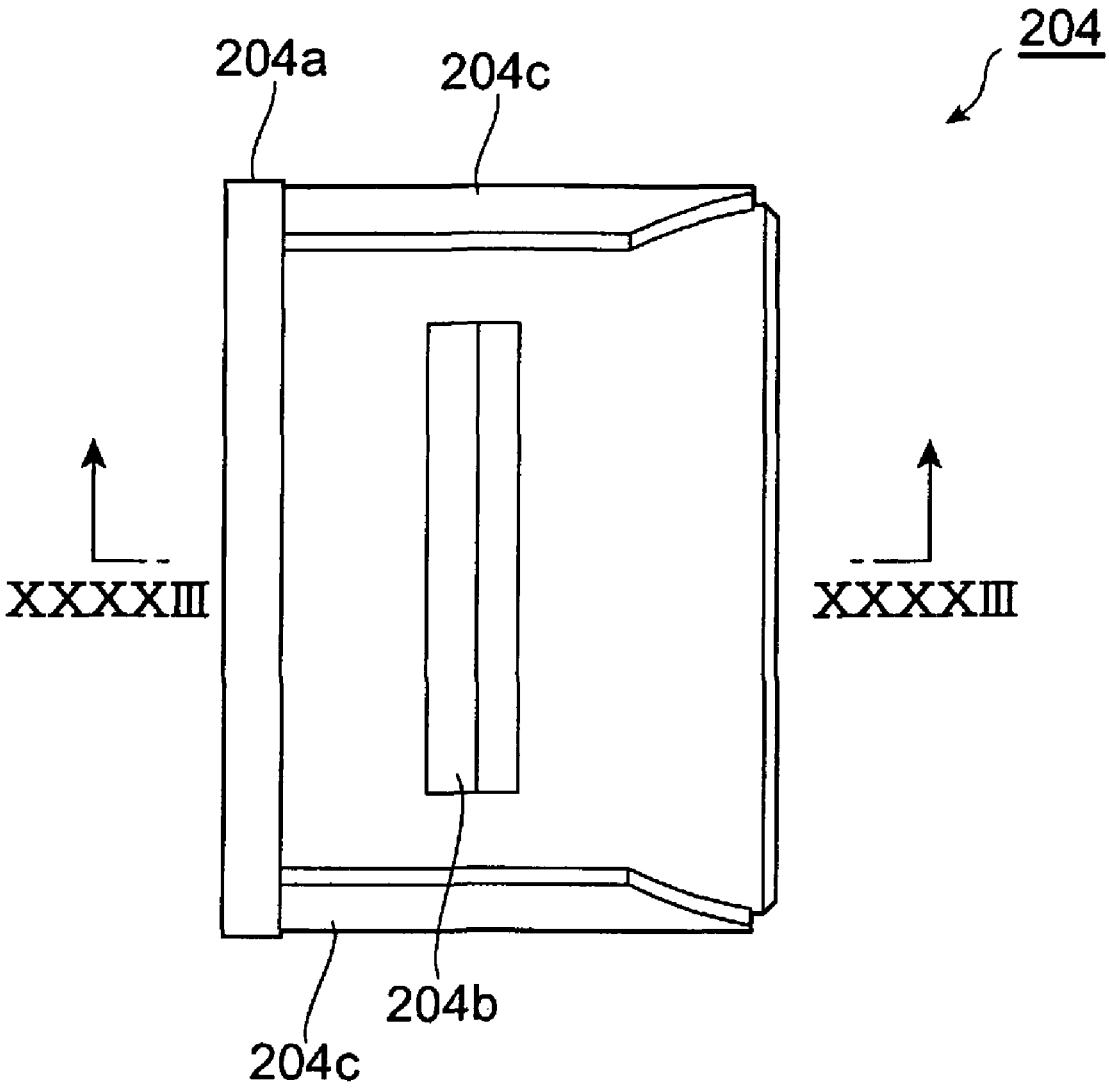
FIG. 42 is a side view showing the thread tube in FIGS. 30 to 35.
Figure 43:
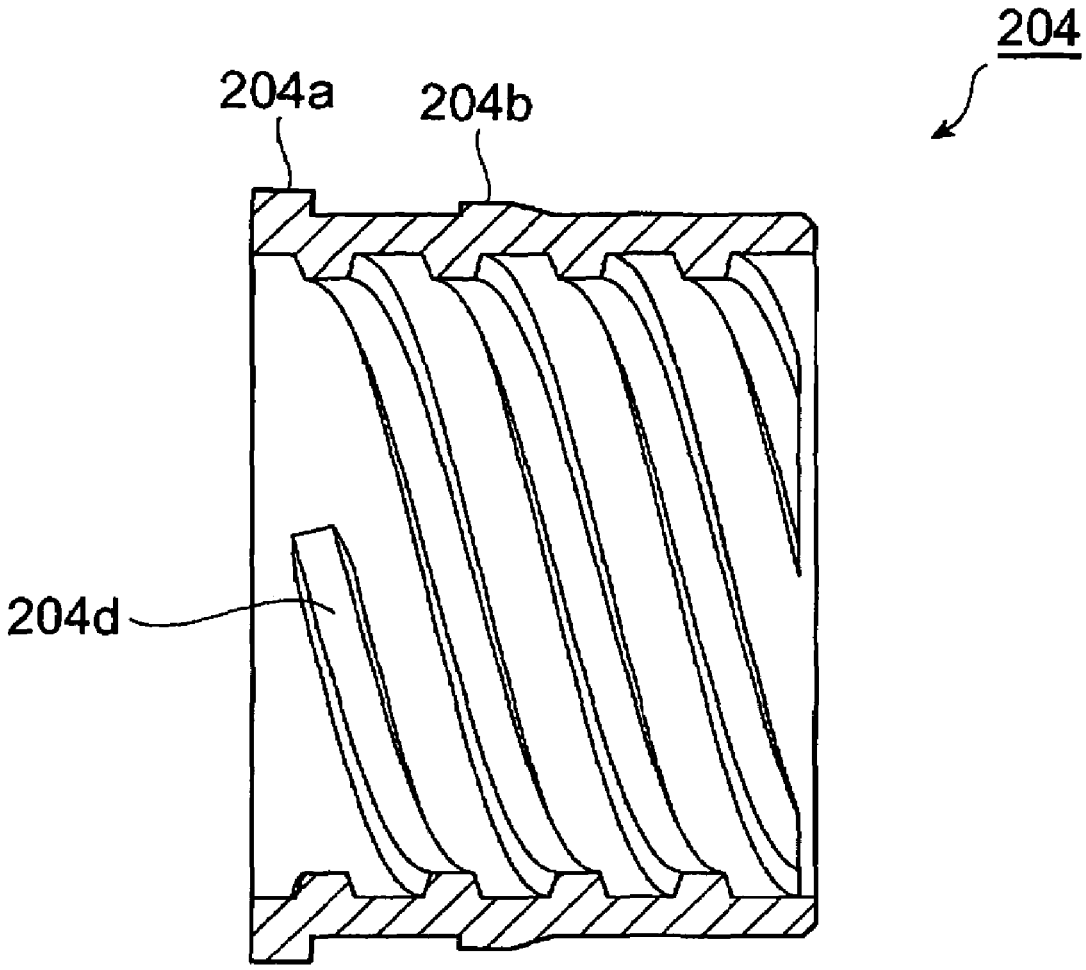
FIG. 43 is a view as seen in the direction of an arrow XXXXIII-XXXXIII in FIG. 42.
Figure 44:
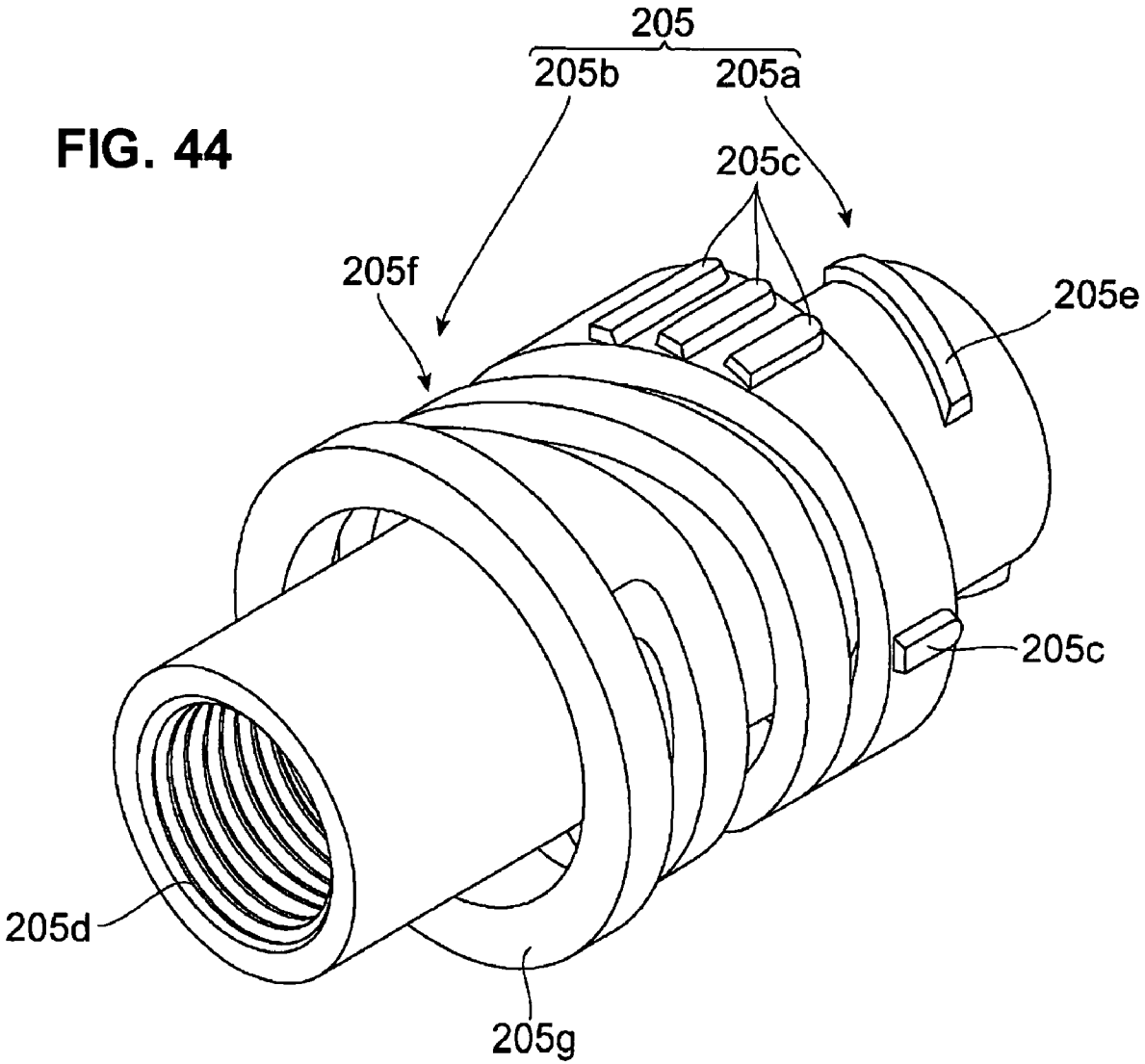
FIG. 44 is a perspective view showing a moving thread tube in FIGS. 30 to 35.
Figure 45:
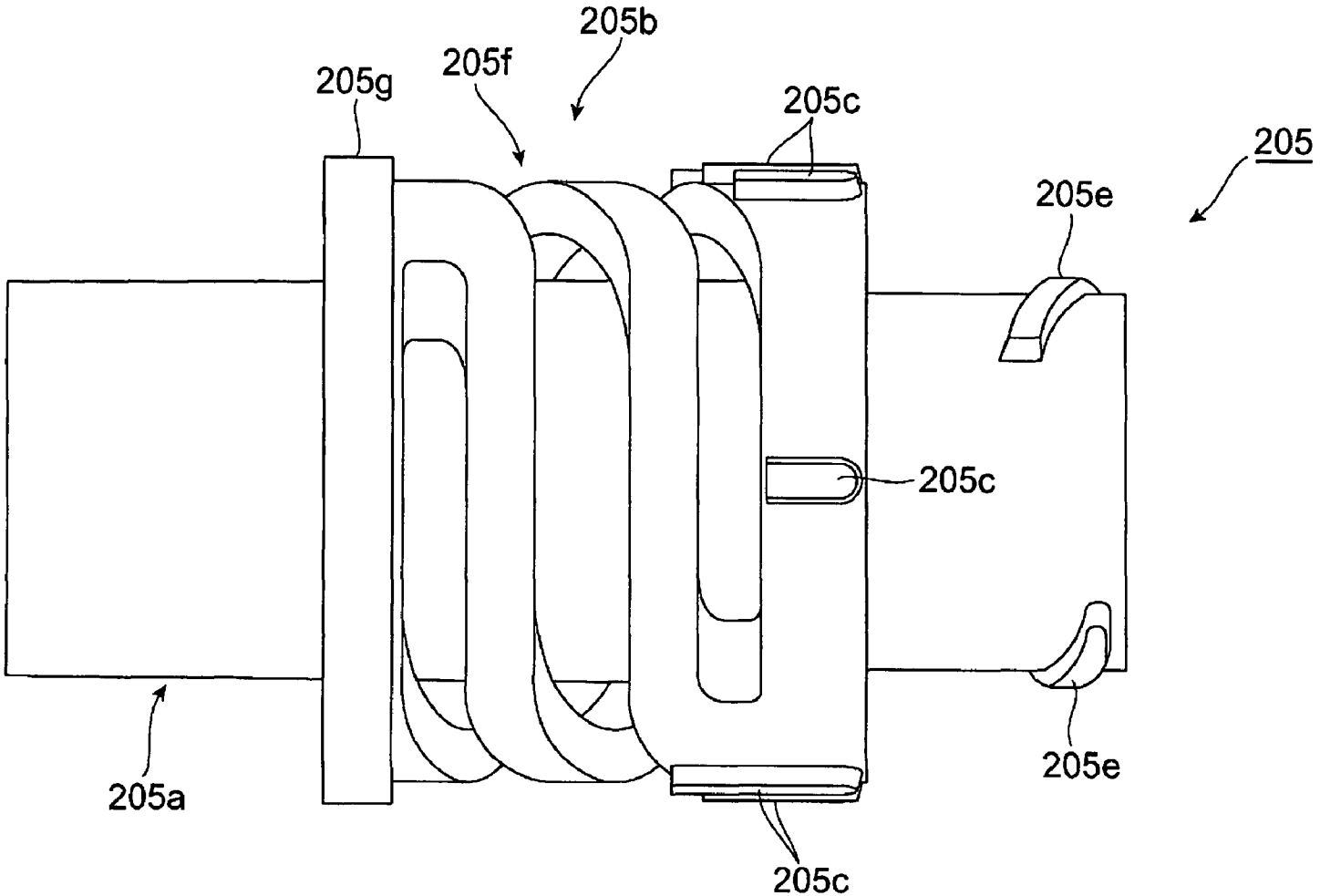
FIG. 45 is a side view showing the moving thread tube in FIGS. 30 to 35.
Figure 46:
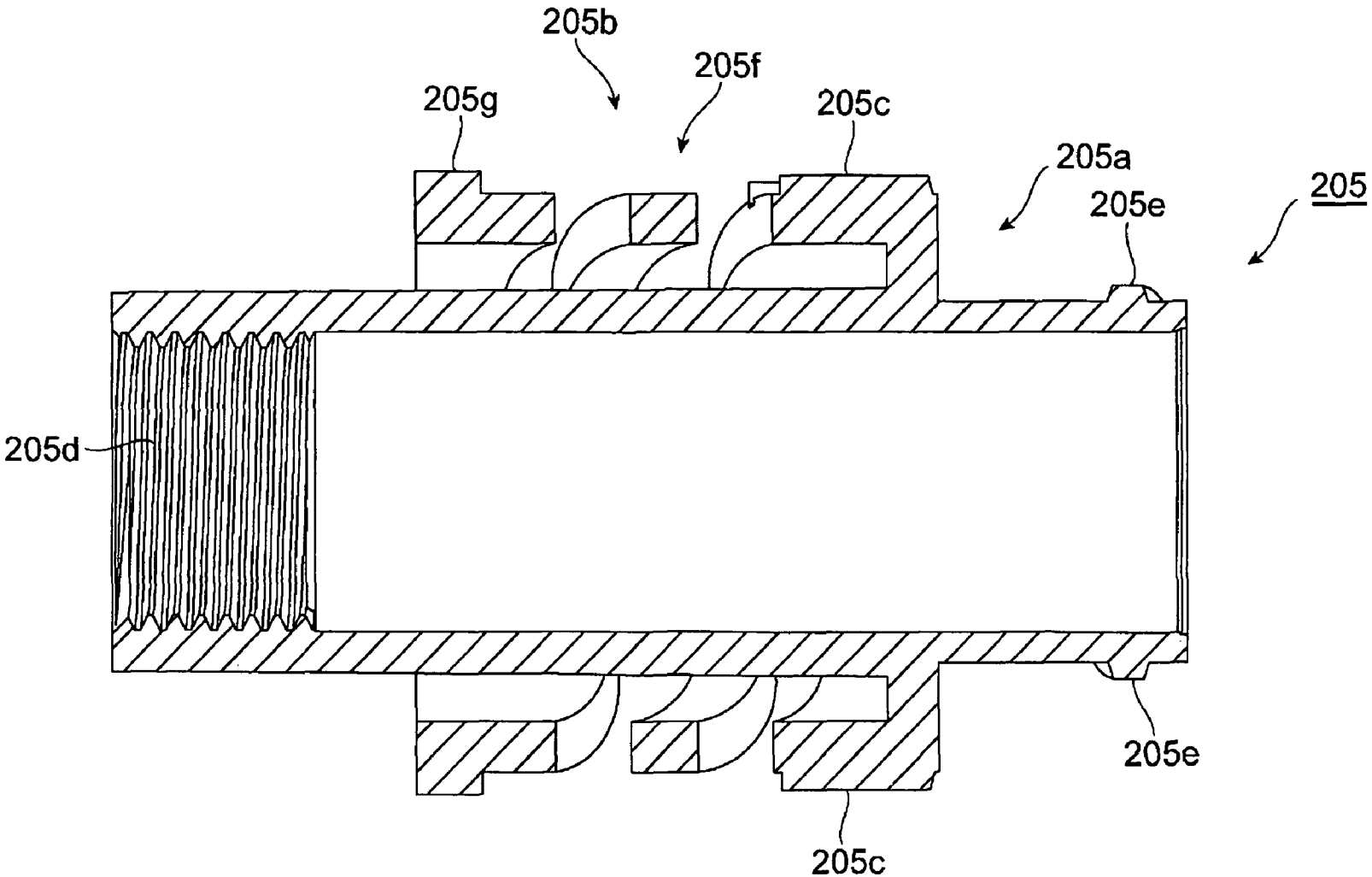
FIG. 46 is a vertical sectional view of the moving thread tube shown in FIG. 45.
Figure 47:
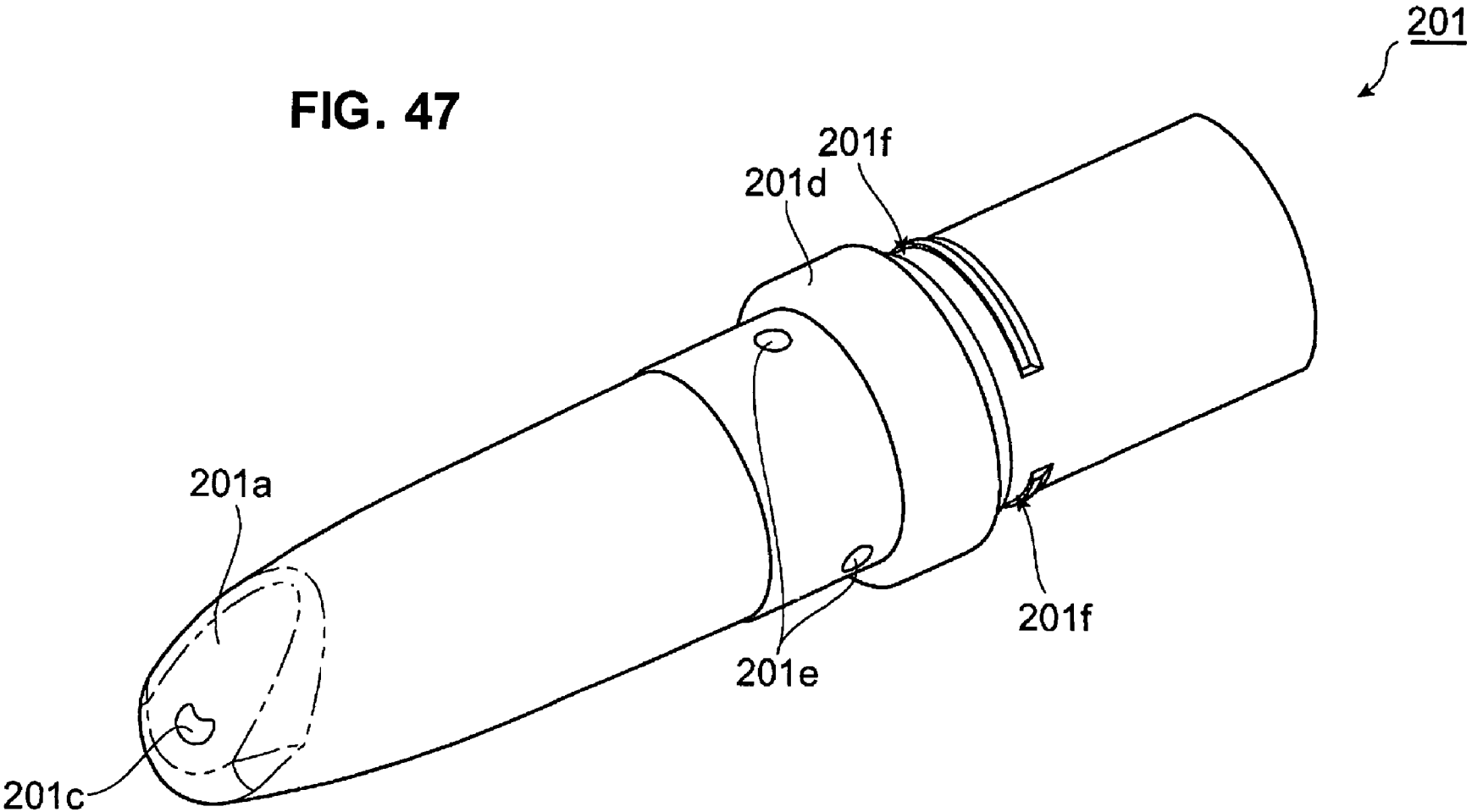
FIG. 47 is a perspective view showing a filling member in FIGS. 30 to 35.
Figure 48:
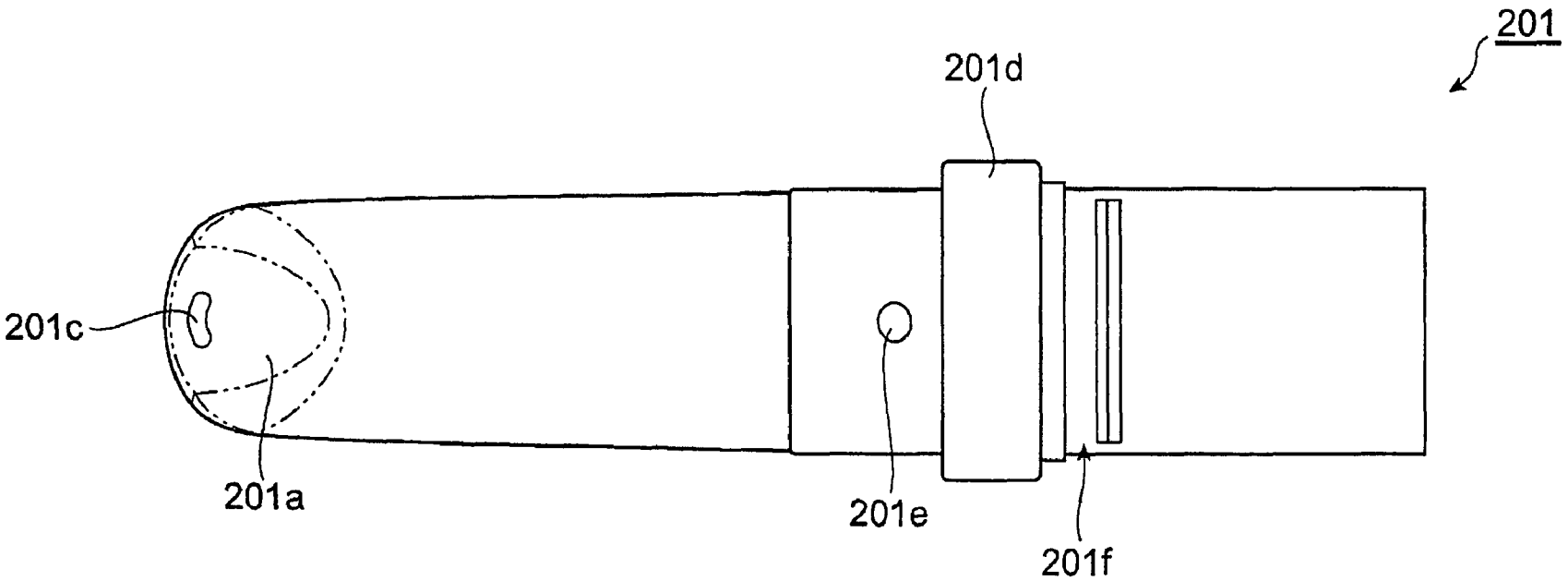
FIG. 48 is a bottom view showing the filling member in FIGS. 30 to 35.
Figure 49:
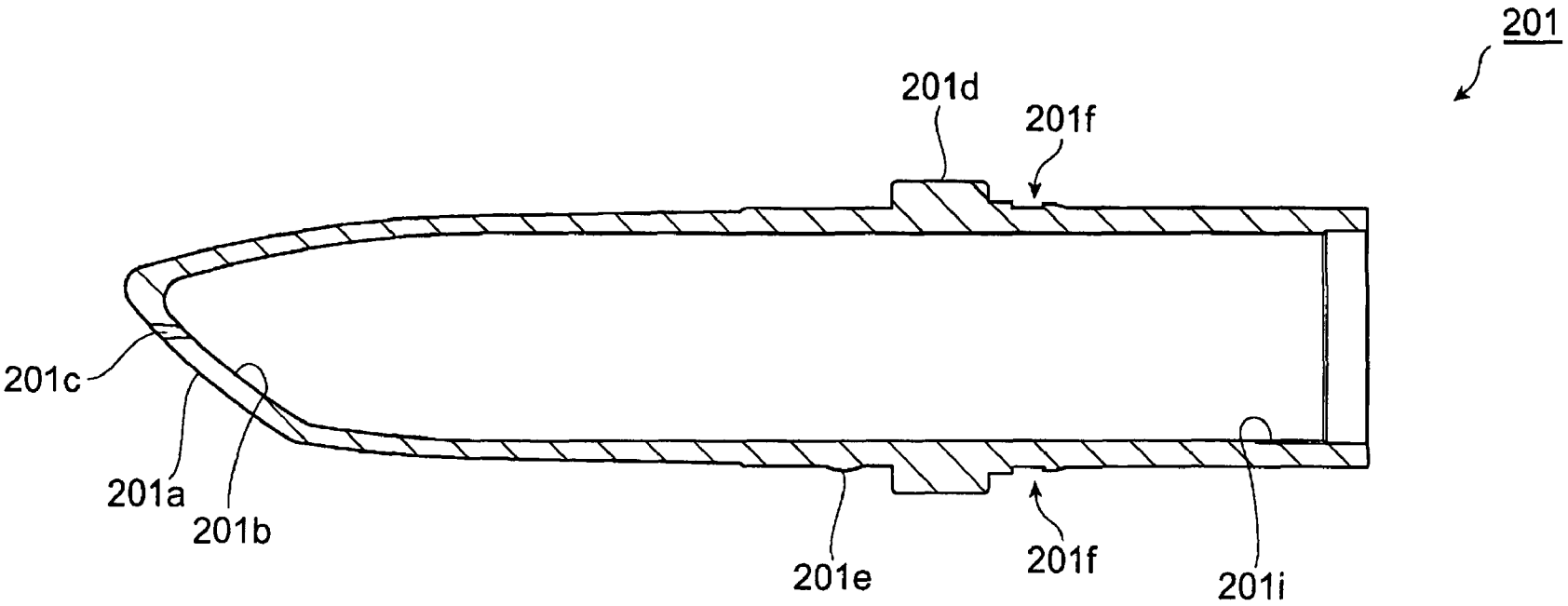
FIG. 49 is a vertical sectional view showing the filling member in FIGS. 30 to 35.
Figure 50:
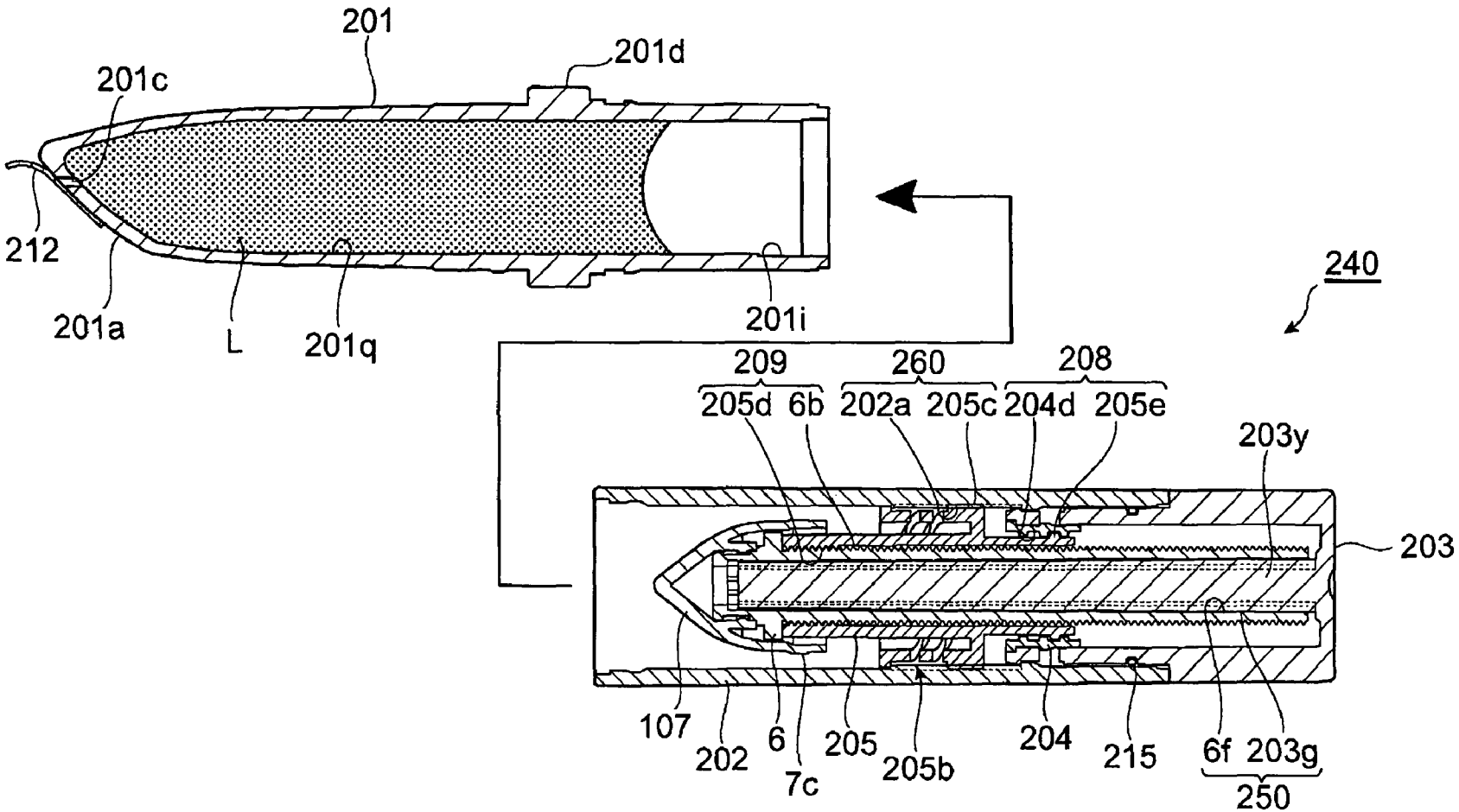
FIG. 50 is an explanatory view showing a manufacturing procedure of the filled material extruding container in accordance with the third embodiment of the present invention.

FIGS. 30 to 35 are respective vertical sectional views showing states of a filled material extruding container in accordance with a third embodiment of the present invention, FIGS. 36 and 37 show respective views showing a main body tube, FIGS. 38 to 40 are respective views showing an operation tube, FIGS. 41 to 43 are respective views showing a thread tube, FIGS. 44 to 46 are respective views showing a moving thread tube, FIGS. 47 to 49 are respective views showing a filling member, and FIG. 50 is an explanatory view showing a manufacturing procedure of the filled material extruding container.

A filled material L used here is in a liquid state and in a semisolid or a soft solid state such as a jelly state, a gel state and a paste state, including, for example, a lip gloss, a lip color, an eye color, an eye liner, an essence, a cleaning fluid, a nail enamel, a nail care solution, a nail enamel remover, a mascara, an anti-aging liquid, a hair color, a hair cosmetic, an oral care liquid, a massage oil, a keratotic plug releasing solution, a foundation, a concealer, a skin cream, an ink of a writing instrument such as a marking pen, a medical or pharmaceutical liquid product, a slurry and the like.

Figure 30:
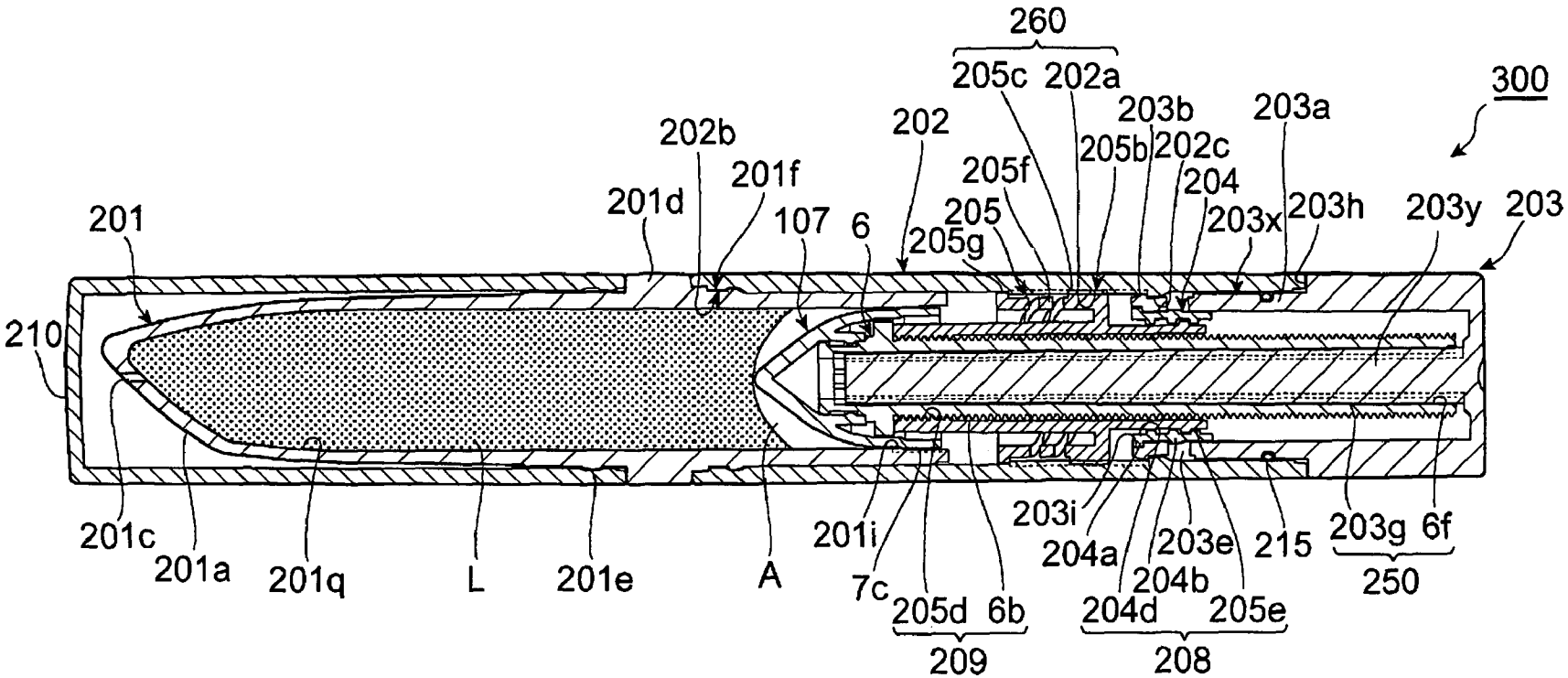
FIG. 30 is a vertical sectional view showing an initial state of a filled material extruding container in accordance with a third embodiment of the present invention.

As shown in FIG. 30, a filled material extruding container 300 is provided with a filling member 201 having a filling region 201 in which a filled material L is filled in an inner portion, a main body tube (a main body) 202 having a front half portion in which a rear half portion of the filling member 201 is inserted so as to couple the filling member 201 in such a manner as to be synchronously rotatable and be undetachable in an axial direction, and an operation tube (an operation body) 203 coupled to a rear end portion of the main body tube 202 so as to be relatively rotatable and be undetachable in the axial direction, as an outer shape structure, a container front portion is constructed by the filling member 201 and the main body tube 202, and a container rear portion is constructed by the operation tube 203.

Further, the filled material extruding container 300 is approximately provided in the inner portion thereof with the filled material L filled in the filling member 201, a thread tube 204 coupled to the operation tube 203 so as to be synchronously rotatable and be immovable in the axial direction, a moving thread tube 205 engaging with the main body tube 202 so as to be synchronously rotatable and be movable in the axial direction, engaged with the thread tube 204 via a first engagement portion 208, moving forward when the main body tube 202 (or the filling member 201) constructing the container front portion and the operation tube 203 constructing the container rear portion are relatively rotated in one direction, stopping the forward movement in the case of moving forward to a predetermined forward moving limit, moving backward when the main body tube 202 and the operation tube 203 are relatively rotated in the other direction corresponding to an opposite direction to the one direction, and stopping the backward movement in the case of moving backward to a predetermined backward moving limit, a moving body 6 having the same structure as the first and second embodiments, engaging with the operation tube 203 so as to be synchronously rotatable and be movable in the axial direction, engaged with the moving thread tube 205 via a second engagement portion 209, moving forward together with the moving thread tube 205 and simultaneously moving forward independently when the main body tube 202 and the operation tube 203 are relatively rotated in one direction, moving forward independently when the moving thread tube 205 reaches a forward moving limit and the main body tube 202 and the operation tube 203 are relatively rotated further in the same direction, moving backward together with the moving thread tube 205 and simultaneously moving backward independently when the main body tube 202 and the operation tube 203 are relatively rotated in the other direction, and moving backward independently when the moving thread tube 205 reaches the backward moving limit and the main body tube 202 and the operation tube 203 are relatively rotated further in the same direction, and a piston 107 having the same structure as the second embodiment, forming a rear end of a filling region 201*q* by being installed to a leading end portion of the moving body 6 and being inserted into the filling member 201, and sliding within the filling member 201.

As shown in FIGS. 36 and 37, the main body tube 202 is structured in a cylindrical shape and has a knurling 202*a* in which, a lot of concavo-convex portions in a peripheral direction are provided in parallel on an inner peripheral surface of a center portion in the axial direction thereof and the concavo-convex portions extend for a predetermined length in the axial direction. The knurling 202*a* is provided for engaging the moving thread tube 205 in a rotating direction, and is structured as a rotation stop constructing one part of a rotation stop portion (a rotation stop mechanism) 260 of the moving thread tube 205.

Further, an annular convexo-concave portion 202*b* for engaging the filling member 201 in the axial direction is provided on an inner peripheral surface of a leading end portion of the main body tube 202. Further, an annular protruding portion 202*c* is formed at a rear side of the knurling 202*a* on the inner peripheral surface close to the rear portion side of the main body tube 202 in such a manner as to be brought into contact with a rear surface of the knurling 202*a*. The annular protruding portion 202*c* is provided for engaging the operation tube 203 in the axial direction.

The operation tube 203 is structured, as shown in FIGS. 38 to 40, such as to be provided with a main body portion 203*x* constructed in a closed-end cylindrical shape, and a shaft body 203*y* provided in a rising manner toward a leading end side at the center of a bottom portion of the main body portion 203*x*.

The main body portion 203*x* is provided at a leading end side with a leading end tube portion 203*a* in which an outer diameter is made small, and an annular collar portion 203*b* is provided as a structure engaging with the annular protruding portion 202*c* of the main body tube 202 in the axial direction, on an outer peripheral surface of the leading end portion of the leading end tube portion 203*a*. Further, as shown in FIGS. 39 and 40, an annular concave portion 203*i* provided in a concave manner from the leading end is provided on the inner peripheral surface of the leading end portion of the leading end tube portion 203*a*. A pair of circular arc-shaped convex portions 203*c* extending along the inner peripheral surface are provided at the rear side of the concave portion 203*i* on the inner peripheral surface close to the leading end side of the leading end tube portion 203*a* in such a manner as to oppose to each other with respect to the axis, and a pair of circular arc-shaped concave portions 203*d* are formed along the peripheral direction between a pair of convex portions 203*c* in such a manner as to oppose to each other by providing a pair of the convex portions 203*c*. These convex portions 203*c* and concave portions 203*d* are provided for engaging the thread tube 204 in a rotating direction.

Further, a pair of slits 203*e* communicating between inner and outer sides and formed in a circular arc shape are provided at a position including the circular arc-shaped convex portions 203*c* of the leading end tube portion 203*a* in such a manner as to oppose to each other with respect to the axis, as shown in FIGS. 38 to 40. The slits 203*e* are provided for engaging the thread tube 204 in the axial direction. Further, an annular groove portion 203*f* is provided at a position at a rear side of the slits 203*e* on an outer peripheral surface of the leading end tube portion 203*a*. An O-ring 215 for applying good rotational resistance between the operation tube 203 and the main body tube 202 and preventing a rattle in a diametrical direction is installed in the annular groove portion 203*f* (refer to FIG. 30).

As shown in FIGS. 38 and 40, the shaft body 203*y* is structured such as to have a non-circular outer shape. Specifically, the shaft body 203*y* is formed in a non-circular cross sectional and shape provided with protrusions 203*g* which are arranged at six uniformly arranged positions along the peripheral direction on an outer peripheral surface of a columnar body in such a manner as to protrude outwardly in a radial direction and extend in the axial direction. The protrusions 203*g* are provided as a rotation stop constructing one part of a rotation stop portion (a rotation stop mechanism) 250 of the moving body 6.

Further, the operation tube 203 provided with the main body portion 203*x* and the shaft body 203*y* is inserted into the main body tube 202 from the leading end tube portion 203*a*, as shown in FIG. 30, a step surface 203*h* between the leading end tube portion 203*a* and a large-diameter closed-end tube portion at a rear side thereof is brought into contact with the rear end surface of the main body tube 202, and the collar portion 203*b* is engaged with the end surface close to the knurling 202*a* side of the annular protruding portion 202*c* of the main body tube 202 in the axial direction, thereby being installed to the main body tube 202 in such a manner as to be rotatable and be undetachable in the axial direction.

The thread tube 204 is structured in a cylindrical shape as shown in FIGS. 41 to 43, and has an annular collar portion 204*a* accommodated in the concave portion 203*i* of the operation tube 203 on an outer peripheral surface of the leading end portion thereof. A pair of protrusions 204*b* formed in a circular arc shape along an outer peripheral surface and extending in a circumferential direction are provided as a structure engaging with the slits 203*e* of the operation tube 203 in the axial direction, at opposing positions with respect to the axis on an outer peripheral surface in the middle in the axial direction of the thread tube 204, and a pair of convex portions 204*c* formed in a circular arc shape along an outer peripheral surface are formed as a structure engaging in a rotating direction between the convex portions 203*c* and 203*c* of the operation tube 203, on an outer peripheral surface between a pair of protrusions 204*b*.

Further, as shown in FIGS. 41 and 43, a female thread 204*d* constructing one part of the first engagement portion (engagement mechanism) 208 is provided from the leading end of the inner peripheral surface of the thread tube 4 to the rear end.

The thread tube 204 is inserted into the operation tube 203 from the rear end portion thereof as shown in FIG. 30, the collar portion 204*a* is brought into contact with the concave portion 203*i* of the operation tube 203 so as to be accommodated, the protrusions 204*b* enter into the slits 203*e* of the operation tube 203 so as to be engaged in the axial direction, and the convex portions 204*c* enter into the concave portions 203*d* between the convex portions 203*c* and 203*c* of the operation tube 203 (refer to FIGS. 39 and 41) so as to be engaged in the rotating direction, whereby the thread tube 204 is installed to the operation tube 203 in such a manner as to be synchronously rotatable and immovable in the axial direction. In other words, the operation tube 203 and the thread tube 204 are integrated.

The structure of the moving body 6 is the same as the first and second embodiments, and is fitted over the shaft body 203*y* of the operation tube 203 as shown in FIG. 30, and the protrusions 6*y* enter into the portions between the protrusions 203*g* and 203*g* of the shaft body 203*y* of the operation tube 203 so as to be engaged in the rotating direction, whereby the moving body 6 is installed to the operation tube 203 in such a manner as to be synchronously rotatable and be movable in the axial direction.

The structure of the piston 107 is the same as the second embodiment, and is installed to the leading end of the moving body 6 in the same manner as the second embodiment.

The moving thread tube 205 is formed as an injection molded product by a resin, and is integrated in such a manner as to have a main body portion 205*a* structured in a cylindrical shape and having a thread portion, and a spring portion 205*b* continuously provided on an outer peripheral surface at somewhat rear end side from the middle in the axial direction of the main body portion 205*a*, extending near the leading end portion and surrounding the main body portion 205*a* circumferentially, as shown in FIGS. 44 to 46.

The spring portion 205*b* is a so-called resin spring, and the other portions than the leading end side and the rear end side are formed as a compression spring (an energizing means) 205*f* having extensibility in the axial direction. Protrusions 205*c* extending for a predetermined length in the axial direction are provided as a structure engaging with the knurling 202*a* of the main body tube 202 in the rotating direction on an outer peripheral surface at a rear end side of the spring portion 205*b*. The protrusions 205*c* are structured as a rotation stop constructing the other part of the rotation stop portion (the rotation stop mechanism) 260 of the moving thread tube 205. Further, an annular collar portion 205*g* is provided at a leading end of the spring portion 205*b*. The collar portion 205*g* is brought into contact with a leading end surface of the convex portions constructing the knurling 202*a* of the main body tube 202 at a time when the moving thread tube 205 is moved backward so as to serve as a locking portion at the backward moving limit of the collar portion 205*g* of the moving thread tube 205.

On the other hand, a pair of engagement projections 205*e* constructing the other part of the first engagement portion (engagement mechanism) 208 are provided on an outer peripheral surface at a rear end side of the main body portion 205*a* formed in a cylindrical shape so as to oppose to each other, and a female thread 205*d* constructing the other part of the second engagement portion (engagement mechanism) 209 is provided on an inner peripheral surface at a leading end side, as shown in FIGS. 44 and 46.

The moving thread tube 205 is fitted over the moving body 6 and inserted into the main body tube 22, as shown in FIG. 30. Further, the moving thread tube 205 is structured such that a rear end portion is inserted into the thread tube 204, the female thread 205*d* is engaged with the male thread 6*b* of the moving body 6, a leading end surface of the moving thread tube 205 is brought into contact with the rear end surface of the collar portion 6*a* of the moving body 6, the engagement projections 205*e* is engaged with the female thread 204*d* of the thread tube 204 and reaches the rear end of the female thread 204*d*, the collar portion 205*g* is brought into contact with the leading end surfaces of the convex portions constructing the knurling 202*a* of the main body tube 202, and the protrusions 205*c* are engaged with the knurling 202*a* of the main body tube 202 in the rotating direction in this state, whereby the moving thread tube 205 is coupled to the main body tube 202 so as to be synchronously rotatable and be movable in the axial direction.

In the first engagement portion 208 constituted by the engagement projections 205*e* of the moving thread tube 205 and the female thread 204*d* of the thread tube 204, and the second engagement portion 209 constituted by the female thread 205*d* of the moving thread tube 205 and the male thread 6*b* of the moving body 6, the lead of the first engagement portion 208 is made larger than the lead of the second engagement portion 209, in the same manner as the first and second embodiments, as shown in FIGS. 43 and 46.

Further, as shown in FIG. 50, in the main body side tube body constituted by the main body tube 202 and the operation tube 203, there are incorporated the rotation stop portion 260 of the moving thread tube 205 constructed by the knurling 202*a* of the main body tube 202 and the protrusions 205*c* of the spring portion 205*b* of the moving thread tube 205, the rotation stop portion 250 of the moving body 6 constructed by the protrusions 203*g* of the shaft body 203*y* of the operation tube 203 and the protrusions 6*f* of the moving body 6, the extruding mechanism provided with the first and second engagement portions 208 and 209, the thread tube 204, the moving thread tube 205, the moving body 6 and the piston 107, whereby the main body side assembly 240 is structured.

The filling member 201 is provided for filling the filled material L in the filling region 201*q* in the inner portion, as shown in FIG. 30, and is provided also for discharging the filled material L from the leading end portion in accordance with an operation by a user. It is preferable that a material of the filling member 201 is an injection molded plastic such as a polyethylene terephthalate (PET), a polypropylene (PP) or the like, and it is preferable that a transparent member or a colored member having a color of the filled material L is employed for enabling to check a color tone and a filling state of the filled material L.

The filling member 201 is formed in a cylindrical shape, and is structured such that a leading end has a tapered closed shape and an outer surface 201*a* of the leading end portion is formed as an inclined surface inclined in a predetermined direction, as shown in FIGS. 47 to 49. Further, at the leading end portion of the filling member 201, as shown in FIG. 49, an inclined inner surface 201*b* is formed at a back side of the outer surface 201*a* thereof so as to have a fixed thickness with respect to the outer surface 201*a*, and a discharge port (an opening portion at the leading end of the container) 201*c* communicating between the inner surface 201*b* and the outer surface 201*a* is provided therein. The number of the discharge port 201*c* is set to one in the present embodiment, as shown in FIG. 47, however, may be set to a plural number. Further, the inclined outer surface 201*a* at the leading end portion is formed as an applying portion for applying the filled material L discharged through the discharge port 201*c* to a portion to be applied. The outer surface 201*a* serving as the applying portion is formed as an inclined surface which is preferable for applying to a portion to be applied such as, for example, a skin or the like.

Further, an outer peripheral surface of the filling member 201 is provided with a collar portion 201*d* in which an outer diameter is made larger so as to be brought into contact with the open end at the leading end side of the main body tube 202, approximately at a middle portion in the axial direction, as shown in FIGS. 47 to 49, and three protruding portions (so-called dowels) 201*e* for detachably locking a cap 210 (refer to FIG. 30) covering a front side from the collar portion 201*d* of the filling member 201 in the axial direction are provided at front side positions close to the collar portion 201*d* so as to be spaced uniformly along the peripheral direction.

Further, the outer peripheral surface of the filling member 201 is provided with a pair of circular arc-shaped protrusions extending for a predetermined length along the peripheral direction at rear side positions close to the collar portion 201*d* so as to oppose to each other, and a pair of concavo-convex portions 201*f* are structured by the protrusions and a front side portion from the protrusions so as to oppose to each other, and are provided as a structure engaging with the annular convexo-concave portion 202*b* of the main body tube 202 in the axial direction. Further, as shown in FIG. 49, an air vent groove 201*i* opening at a rear side and extending to the leading end side for a short length is provided on an inner peripheral surface of the rear end portion of the filling member 201.

The filling member 201 is inserted into the main body tube 202 from the rear portion side, as shown in FIG. 30, the rear end surface of the collar portion 201*d* is brought into contact with the open end at the leading end side of the main body tube 202, the concavo-convex portion 201*f* is engaged with the annular convexo-concave portion 202*b* of the main body tube 202 in the axial direction, and the outer peripheral surface thereof comes into pressure contact with the main body tube 202, thereby being installed to the main body tube 202 so as to be synchronously rotatable and be undetachable in the axial direction, and being integrated with the main body tube 202. In this state, a predetermined space for the moving thread tube 205 moving forward is provided between the rear end surface of the filling member 201 and the leading end surface of the spring portion 205*b* of the moving thread tube 205. In this case, the predetermined space may be omitted. Further, the cap 210 is detachably installed to the filling member 201.

Next, a description will be given of one example of an assembling procedure of the filled material extruding container 300 having the structure mentioned above with reference to FIG. 50. An operation tube assembly is obtained by first installing the thread tube 204 to the operation tube 203, next installing the O-ring 215 to the operation tube 203, and then installing the main body tube 202 to the operation tube 203. On the other hand, the moving thread tube 205 is screwed to the moving body 6. In this case, the moving thread tube 205 is not screwed to the end, but the screwing is finished at a position at which a moving amount of the moving body 6 on the basis of the rotation at a time of screwing the moving thread tube 205 into the thread tube 204 to the end is left. At a time of leaving the moving amount, it is preferable to position the moving thread tube 205 in the axial direction by using a jig. Further, the piston 107 is installed to the moving body 6, and the moving body assembly is obtained.

Next, the moving body assembly is inserted from the opening side of the main body tube 202 of the operation tube assembly, the moving body 6 is fitted over the shaft body 203*y* while engaging the protrusions 6*f* of the moving body 6 between the protrusions 203*g* and 203*g* of the shaft body 203*y* of the operation tube 203, the moving thread tube 205 is inserted into the main body tube 202 while engaging the protrusions 205*c* of the moving thread tube 205 with the knurling 202*a* of the main body tube 202 in the rotating direction, and the operation tube 203 is rotated in the retracting direction to a stop position while energizing the leading end (the open end) of the spring portion 205*b* of the moving thread tube 205 in a direction (right side in FIG. 50) against the energizing force of the spring portion 205*b* by a tubular jig. On the basis of the rotation in the retracting direction of the operation tube 203, the first engagement portion 208 is engaged, the engaging action is activated, the moving thread tube 205 is screwed into the thread tube 204 to the end on the basis of the cooperation with the rotation stop portion 260 of the moving thread tube 205, the engaging action of the second engagement portion 209 is activated, the moving body 6 which is not screwed to the moving thread tube 205 to the end is screwed from the midway position to the end on the basis of the cooperation with the rotation stop portion 250 of the moving body 6, and the main body side assembly 240 is obtained.

Further, as another example of the assembling procedure of the main body side assembly 240, the main body side assembly 240 may be obtained by screwing the moving thread tube 205 to the moving body 6 to the end so as to obtain the moving body assembly, next inserting the moving body assembly from the opening side of the main body tube 202 of the same operation tube assembly as mentioned above, fitting and engaging the moving body 6 to the shaft body 203*y* of the operation tube 203, inserting and engaging the moving thread tube 205 to the main body tube 202, temporarily rotating the operation tube 203 in the feeding out direction while energizing the leading end of the spring portion 205*b* of the moving thread tube 205 in the direction against the energizing force of the spring portion 205*b* by the tubular jig, activating the engaging action of the second engagement portion 209 on the basis of the rotation in the feeding out direction of the operation tube 203, moving forward the moving body 6 with respect to the moving thread tube 205 on the basis of the cooperation with the rotation stop portion 250 of the moving body 6 so as to secure the same moving amount in the retracting direction of the moving body 6, and then rotating the operation tube 203 in the retracting direction to the stop position.

On the other hand, the filling member 201 is reversed after the discharge port 201*c* is closed by a seal 212, and a predetermined amount of filled material L is filled in the filling region 201*q* so as to form a state in which no space exists within the leading end of the filling member 201. Further, the leading end side of the main body side assembly 240 is fitted over the filling member 201 filled with the filled material L from the above, and the filling member 201 is installed to the main body tube 202 while inserting the piston 107 into the filling member 201.

At this time, the filling member 201 is engaged with the main body tube 202 while the inner peripheral surface thereof comes into slidable contact with a annular protruding portion 7*c* for securing watertightness of the piston 107. At this engaging time, as shown in FIG. 30, the air vent groove 201*i* on the inner peripheral surface of the filling member 201 is positioned in such a manner as to cross the annular protruding portion 7*c* of the piston 107 in the axial direction, the air at the filled material side is well bled to the rear side through the air vent groove 201*i*.

When the installation of the filling member 201 is finished, somewhat of gap A is left between the filled material L filled in the filling member 201 and the piston 107 inserted to the filling member 201, as shown in FIG. 30. In this case, the gap A is formed at a front side of a whole surface of the piston 107. The gap A is formed as mentioned above because there is a risk that the filled material L may be extruded by the piston 107 so as to appear from the filling member 201 if the gap between the filled material L and the piston 107 is set to 0 in the structure in which the filling member 201 filled with the filled material L is assembled in the main body side assembly 240 and the piston 107 is inserted to the filling member 201. In the present embodiment, the gap A is provided for avoiding this.

Further, the filled material extruding container 300 in the initial state shown in FIG. 30 is obtained by finally peeling the seal 212.

In this state, the piston 107 is closely attached to the inner peripheral surface of the filling member 201, and the filled material L is in the state of being closely attached to the inner peripheral surface of the filling member 201.

In accordance with the filled material extruding container 300 structured as mentioned above, since the filling member 201 filled with the filled material L is structured such as to be inserted to the leading end side of the main body side assembly 240 so as to be installed, as shown in FIG. 50, it is easy to make assembly after filling the filled material L in the filling member 201.

Further, in the filled material extruding container 300 in the initial state shown in FIG. 30, when the cap 210 is detached by a user and the main body tube 202 and the operation tube 203 are relatively rotated in the feeding out direction, the engaging action of the first engagement portion 208 is activated, the moving thread tube 205 is quickly moved forward on the basis of the cooperation with the rotation stop portion 260 of the moving thread tube 205, the engaging action of the second engagement portion 209 is simultaneously activated, and the moving body 6 is slowly moved forward with respect to the moving thread tube 205 on the basis of the cooperation with the rotation stop portion 250 of the moving body 6. Accordingly, the moving body 6 is quickly moved forward on the basis of the cooperation of the first and second engagement portions 208 and 209.

Figure 31:
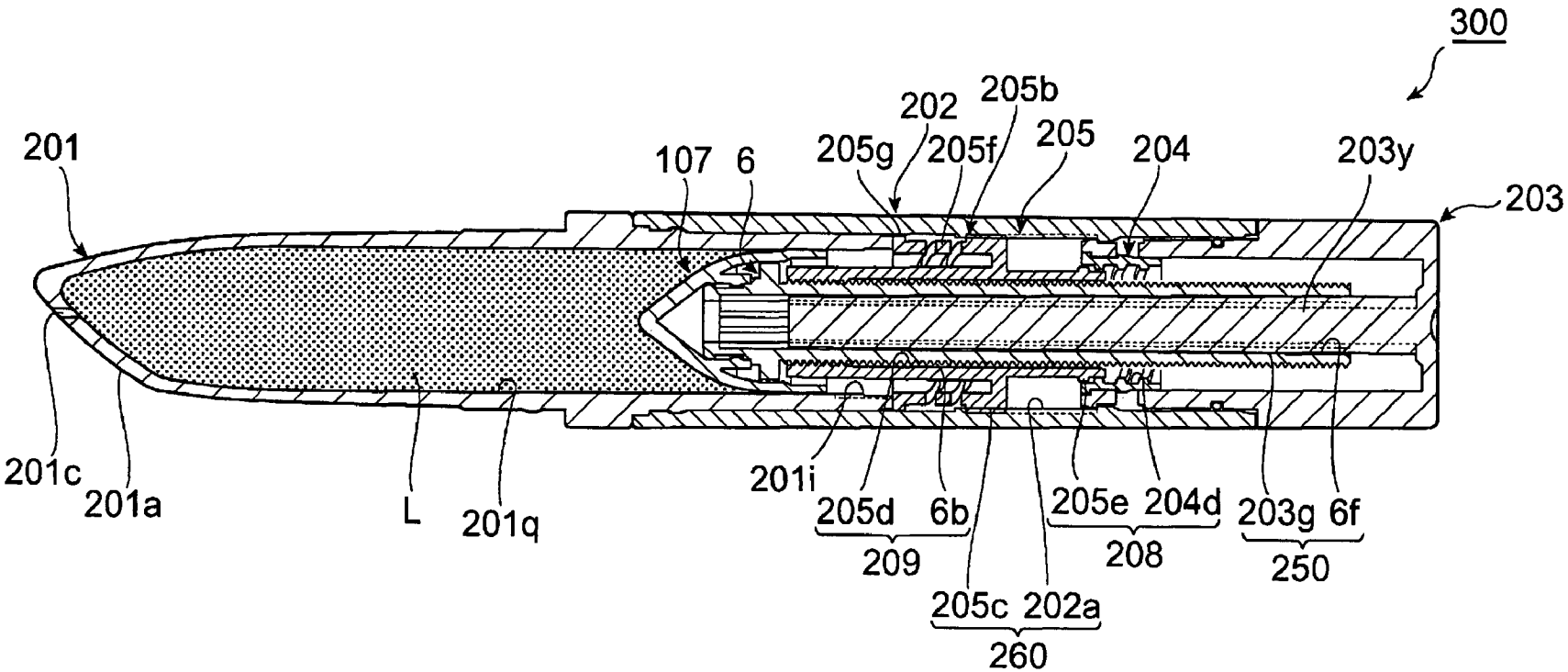
FIG. 31 is a vertical sectional view at a time when a cap is detached from a state shown in FIG. 30, and a moving thread tube and a moving body are moved forward and the moving thread tube is moved forward to a forward moving limit on the basis of an operation of a user.

Further, as shown in FIG. 30, when the piston 107 is quickly moved forward for a predetermined amount while sliding within the filling member 201, from the initial state shown in FIG. 30, that is, the state in which the air vent groove 201*i* opens the ventilation for releasing the air in the space A, the air in the space A is well released to the rear side through the air vent groove 201*i*, the space A is immediately removed as shown in FIG. 31, the ventilation of the air vent groove 201*i* is closed, and the piston 107 and the filled material L are set to a state in which they are in contact airtighly within the filling member 201.

As mentioned above, since the piston 107 is quickly moved forward, it is possible to reduce a preliminary rotation for releasing the air in the space A. In this case, if the space A is left, the piston 107 is moved forward so as to compress the air, whereby a delay of the appearance of the filled material L from the leading end is undesirably generated. However, in the present embodiment, the space A is immediately removed on the basis of the forward movement of the piston 107 as mentioned above.

Figure 32:
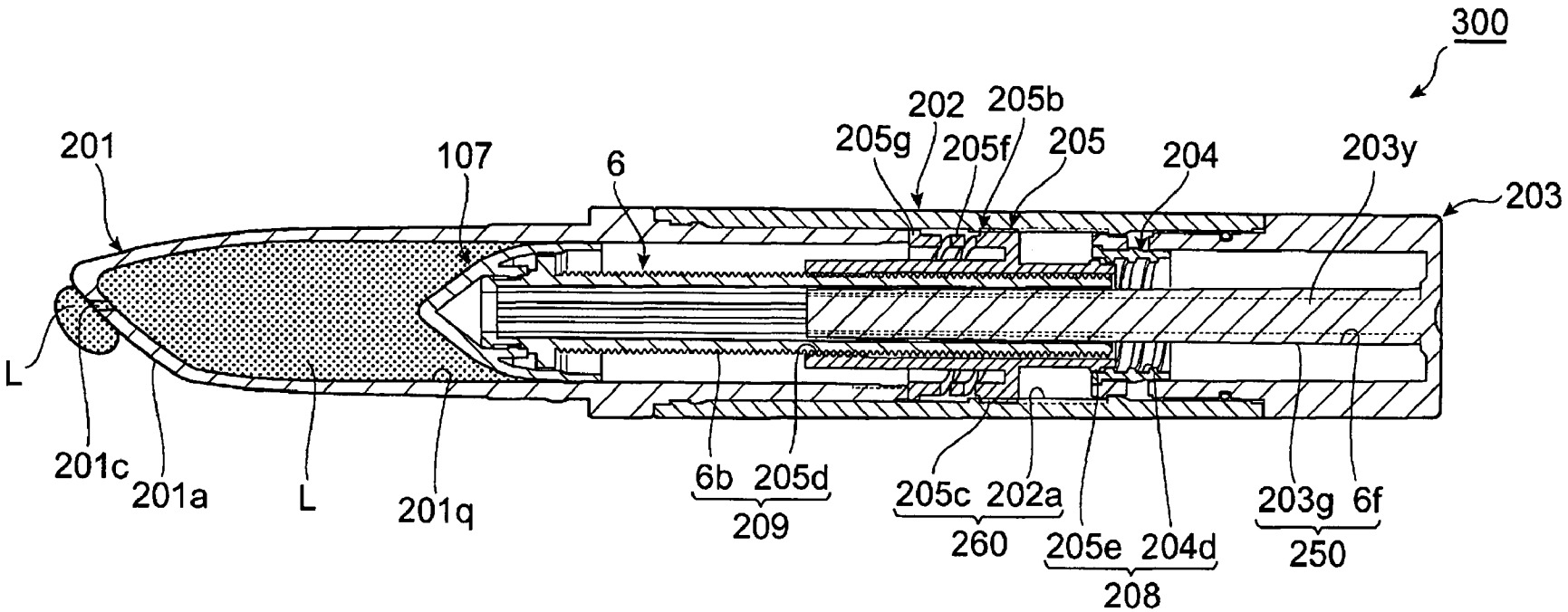
FIG. 32 is a vertical sectional view at a time when the moving body is moved forward from a state shown in FIG. 31 on the basis of an operation of the user.

Further, the moving thread tube 205 is quickly moved forward for the predetermined amount as mentioned above, the collar portion 205*g* of the spring portion 205*b* is brought into contact with the rear end surface of the filling member 201 as shown in FIG. 31, and when the relative rotation in the feeding out direction is further done, the moving thread tube 205 is moved forward and the engagement projections 205*e* of the moving thread tube 205 is detached from the leading end of the female thread 204*d* of the thread tube 204 while the compression spring 205*f* of the moving thread tube 205 is compressed so as to accumulate the energizing force, whereby the engagement of the first engagement portion 208 is cancelled, the first engagement portion 208 is returned to be engaged on the basis of the energizing force of the compression spring 205*f* of the moving thread tube 205 in accordance with the further relative rotation in the feeding out direction, and the engagement cancellation and the engagement return are repeated. In this state, the moving body 6 moves and backs within the predetermined short range in the axial direction with respect to the piston 107 without being exposed to sliding resistance between the piston 107 and the inner peripheral surface of the filling member 201. When they are relatively rotated further in the same direction, only the engaging action of the second engagement portion 209 is activated in the state in which the engagement cancellation and the engagement return of the first engagement portion 208 are repeated, only the moving body 6 is slowly moved forward accompanying the click feeling, and the filled material L is properly extruded by the piston 107 at the leading end so as to appear through the discharge port 201*c* and become to be in a use state, as shown in FIG. 32. Accordingly, the filled material L does not erroneously appear excessively.

Further, since the space A is removed as shown in FIG. 31 on the basis of the quick forward movement of the moving thread tube 205 as mentioned above, and the filled material L is filled with no gap in the filling region 201*q* between the inner side of the leading end of the filling member 201 and the piston 107, the filled material L is immediately discharged from the discharge port 201*c* on the basis of the forward movement of only the moving body 6.

Further, when the main body tube 202 and the operation tube 203 are relatively rotated in the retracting direction after being used, the first engagement portion 208 is returned to be engaged by the compression spring 205*f* of the moving thread tube 205, the engaging action of the first engagement portion 208 is activated on the basis of the further relative rotation in the same direction, the moving thread tube 205 is quickly moved backward on the basis of the cooperation with the rotation stop portion 260 of the moving thread tube 205, the engaging action of the second engagement portion 209 is activated at the same time, and the moving body 6 is slowly moved backward with respect to the moving thread tube 205 on the basis of the cooperation with the rotation stop portion 250 of the moving body 6. Accordingly, the moving body 6 is quickly moved backward on the basis of the cooperation of the first and second engagement portions 208 and 209.

Figure 33:
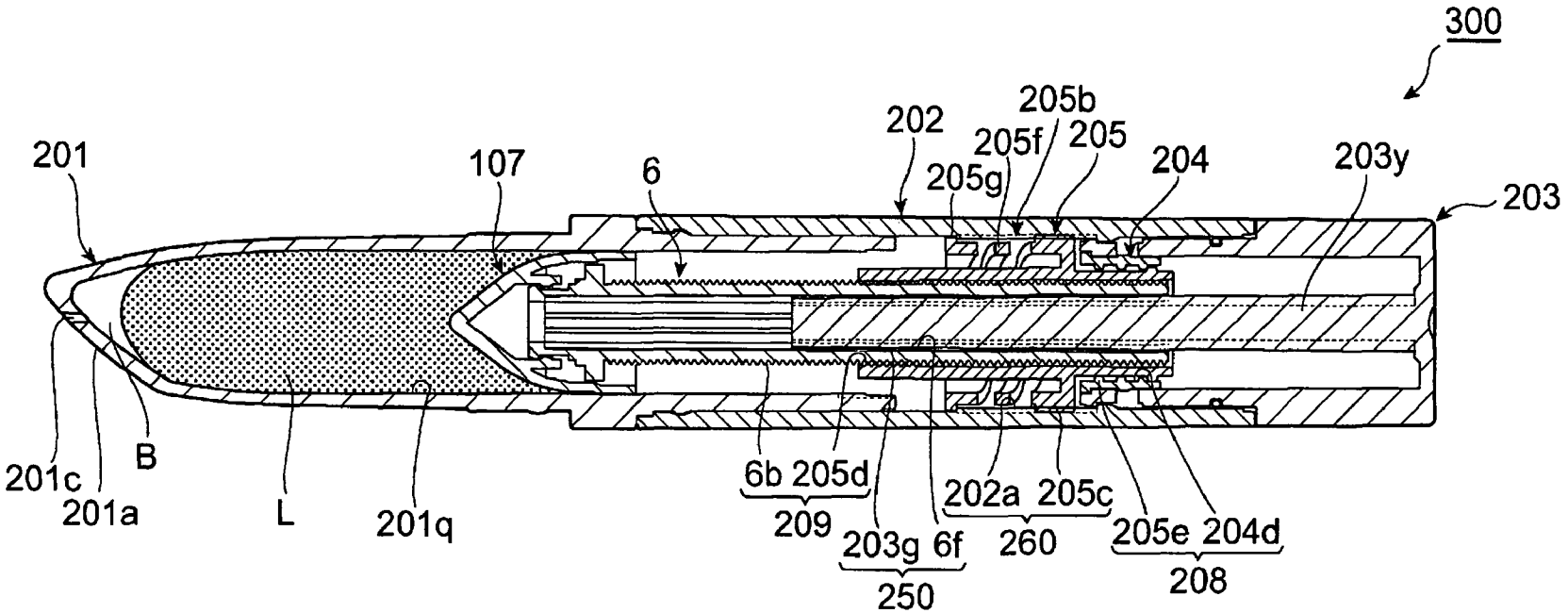
FIG. 33 is a vertical sectional view at a time when a filled material is used by the user in a state shown in FIG. 32, and the moving thread tube and the moving body are thereafter moved backward on the basis of an operation of the user and the moving thread tube is moved backward to a backward moving limit.

At this time, on the basis of the sucking effect caused by pressure reduction in accordance with the backward movement of the piston 107, the filled material L is drawn back from the discharge port 201*c* of the filling member 201 so as to be quickly moved backward, as shown in FIG. 33, and a predetermined space B is immediately formed at the inner side from the discharge port 201*c* of the filling member 201. Accordingly, the filled material L left on the outer surface 201*a* of the leading end portion of the filling member 201 is reduced so as to achieve an economic effect.

Further, when the moving thread tube 205 is moved backward on the basis of the further relative rotation in the same direction, the collar portion 205*g* of the spring portion 205*b* of the moving thread tube 205 is brought into contact with the leading end surfaces of the convex portions constructing the knurling 202*a* of the main body tube 202. When relative rotation in the retracting direction is further done, the moving thread tube 205 is moved backward and the engagement projections 205*e* of the moving thread tube 205 are detached from the rear end of the female thread 204*d* of the thread tube 204 while the compression spring 205*f* of the moving thread tube 205 is expanded so as to accumulate the energizing force, whereby the engagement of the first engagement portion 208 is cancelled, the first engagement portion 208 is returned to be engaged on the basis of the energizing force of the compression spring 205*f* of the moving thread tube 205 in accordance with the further relative rotation in the retracting direction, and the engagement cancellation and the engagement return are repeated. In this state, the moving body 6 moves and backs within the predetermined short range in the axial direction with respect to the piston 107 without being exposed to sliding resistance between the piston 107 and the inner peripheral surface of the filling member 201. When they are relatively rotated further in the same direction, only the engaging action of the second engagement portion 209 is activated in the state in which the engagement cancellation and the engagement return of the first engagement portion 208 are repeated, only the moving body 6 is slowly moved backward accompanying the click feeling, as shown in FIG. 34.

Further, in the state in which the moving body 6 at an optional forward moved position is moved backward on the basis of the relative rotation in the retracting direction between the main body tube 202 and the operation tube 203, the filled material L filled in the filing region 201*q* and the air mixed into the filled material L are prevented from leaking from the discharge port 201*c* of the filled material L on the basis of the predetermined space B provided in the inner side of the discharge port 201*c*, even if the filled material L and the air are expanded due to a temperature change and an air pressure change.

When the main body tube 202 and the operation tube 203 are relatively rotated in the feeding out direction again by the user to set the filled material L in the use state from the state mentioned above, that is, the state in which the moving thread tube 205 and the moving body 6 are retracted, the engaging action of the first engagement portion 208 is activated in the same manner as mentioned above, the moving thread tube 205 is quickly moved forward on the basis of the cooperation with the rotation stop portion 260 of the moving thread tube 205, the engaging action of the second engagement portion 209 is activated, and the moving body 6 is slowly moved forward with respect to the moving thread tube 205 on the bass of the cooperation with the rotation stop portion 250 of the moving body 6. Accordingly, the moving body 6 is quickly moved forward on the basis of the cooperation of the first and second engagement portions 208 and 209.

Since the piston 107 is quickly moved forward as mentioned above, it is possible to reduce the preliminary rotation for releasing the air in the space B.

Further, as shown in FIG. 35, when the piston 107 is moved forward to the maximum on the basis of the relative rotation in the feeding out direction between the main body tube 202 and the operation tube 203, the piston 107 having the bell shape is brought into contact with the inner surface 201*b* of the leading end portion of the filling member 201, and the filled material L in the filling region 201*q* can be almost used up.

As mentioned above, in accordance with the filled material extruding container 300 on the basis of the present embodiment, needless to say, it is possible to obtain approximately the same effects as the first embodiment, and there can be additionally obtained an effect that it is possible to reduce the preliminary rotation for releasing the air in the spaces A and B.

In this case, it is possible to check the color of the filled material L through the collar portion 201*d* of the filling member 201 in the state in which the cap 210 is put on the leading end portion, as shown in FIG. 30, by making the filling member 201 transparent.

In this connection, the user may carry out the relatively rotating operation between the main body tube 202 and the operation tube 203 moving the piston 107 for the predetermined amount so as to remove the space A for releasing the air in the space A after purchasing, as mentioned above, or a factory may carry out such the relatively rotating operation after assembling the filled material extruding container 300.

The description is specifically given above of the present invention on the basis of the embodiments thereof, however, the present invention is not limited to the embodiments mentioned above. For example, the feeding out mechanism of the moving body 6 in accordance with the first and second embodiments may be applied to the third embodiment, or the feeding out mechanism in accordance with the third embodiment may be applied to the first and second embodiments.

Further, the male thread and the female thread may be constituted by a structure serving the same function as the thread such as an intermittently arranged projection group or a spirally and intermittently arranged projection group, and the engagement projections may be constituted by continuous threads.

What is claimed is:

1. A filled material extruding container comprising:

a material filled in a filling region within the container;

a container front portion;

a container rear portion provided so as to be relatively rotatable with respect to said container front portion; and a moving body arranged within said container;

the moving body moving forward and backward so as to push and get forward said filled material or pull and get backward said filled material, when the container front portion and the container rear portion are relatively rotated, wherein a first engagement portion and a second engagement portion are provided within said container, wherein, when said container front portion and said container rear portion are relatively rotated in one direction, both of engaging actions of said first engagement portion and said second engagement portion operate and said moving body moves forward, wherein, when the engaging action of said first engagement portion operates in a fixed section corresponding to the relative rotation between said container front portion and said container rear portion in said one direction, the engagement of said first engagement portion is cancelled, and wherein, when they are further relatively rotated in said one direction, only the engaging action of said second engagement portion operates and said moving body moves forward and backward.

2. A filled material extruding container as claimed in claim 1, wherein said container front portion is constituted by a filling member provided with said filling region, a locking portion at a rear end side of said filling member is coupled to a locking portion of a rotating member rotatably arranged within said container rear portion so as to be synchronously rotatable, and said moving body is synchronously rotatable and movable in an axial direction with respect to said container rear portion and moves forward and backward on the basis of the relative rotation between said container front portion and said container rear portion.

3. A filled material extruding container as claimed in claim 2, wherein said container further comprises an energizing means for energizing in such a manner that the first engagement portion is returned to be engaged, when said moving body is moved forward and backward in said fixed section and the engagement of said first engagement portion is cancelled.

4. A filled material extruding container as claimed in claim 1, wherein said container front portion is constituted by a filling member provided with said filling region and a main body tube, said container rear portion is constituted by an operation tube, and said moving body is synchronously rotatable and movable in an axial direction with respect to said operation tube and moves forward and backward on the basis of the relative rotation between said filling member and said main body tube, and said operation tube.

5. A filled material extruding container as claimed in claim 4, wherein said container further comprises an energizing means for energizing in such a manner that the first engagement portion is returned to be engaged, when said moving body is moved forward and backward in said fixed section and the engagement of said first engagement portion is cancelled.

6. A filled material extruding container as claimed in claim 1, wherein said container further comprises an energizing means for energizing in such a manner that the first engagement portion is returned to be engaged, when said moving body is moved forward and backward in said fixed section and the engagement of said first engagement portion is cancelled.

7. A filled material extruding container comprising:

a material filled in a filling region within the container;

a container front portion;

a container rear portion provided so as to be relatively rotatable with respect to said container front portion; and a moving body arranged within said container;

the moving body moving forward and backward so as to push and get forward said filled material or pull and get backward said filled material, when the container front portion and the container rear portion are relatively rotated, wherein a first engagement portion and a second engagement portion are provided within said container, wherein, when said container front portion and said container rear portion are relatively rotated in one direction, both of engaging actions of said first engagement portion and said second engagement portion operate and said moving body, which has moved forward for an optional amount, moves backward, wherein, when the engaging action of said first engagement portion operates in a fixed section corresponding to the relative rotation between said container front portion and said container rear portion in said one direction, the engagement of said first engagement portion is cancelled, and wherein, when they are further relatively rotated in said one direction, only the engaging action of said second engagement portion operates and said moving body moves forward and backward.

8. A filled material extruding container as claimed in claim 7, wherein said container front portion is constituted by a filling member provided with said filling region, a locking portion at a rear end side of said filling member is coupled to a locking portion of a rotating member rotatably arranged within said container rear portion so as to be synchronously rotatable, and said moving body is synchronously rotatable and movable in an axial direction with respect to said container rear portion and moves forward and backward on the basis of the relative rotation between said container front portion and said container rear portion.

9. A filled material extruding container as claimed in claim 8, wherein said container further comprises an energizing means for energizing in such a manner that the first engagement portion is returned to be engaged, when said moving body is moved forward and backward in said fixed section and the engagement of said first engagement portion is cancelled.

10. A filled material extruding container as claimed in claim 7, wherein said container front portion is constituted by a filling member provided with said filling region and a main body tube, said container rear portion is constituted by an operation tube, and said moving body is synchronously rotatable and movable in an axial direction with respect to said operation tube and moves forward and backward on the basis of the relative rotation between said filling member and said main body tube, and said operation tube.

11. A filled material extruding container as claimed in claim 10, wherein said container further comprises an energizing means for energizing in such a manner that the first engagement portion is returned to be engaged, when said moving body is moved forward and backward in said fixed section and the engagement of said first engagement portion is cancelled.

12. A filled material extruding container as claimed in claim 7, wherein said container further comprises an energizing means for energizing in such a manner that the first engagement portion is returned to be engaged, when said moving body is moved forward and backward in said fixed section and the engagement of said first engagement portion is cancelled.

* * * * *